US006824258B2

(12) United States Patent
Yamamoto et al.

(10) Patent No.: US 6,824,258 B2
(45) Date of Patent: Nov. 30, 2004

(54) LIQUID CONTAINER, LIQUID SUPPLY SYSTEM AND INK JET RECORDING APPARATUS UTILIZING THE SAME, AND METHOD OF MOUNTING LIQUID CONTAINER ON RECORDING APPARATUS

(75) Inventors: Hajime Yamamoto, Kanagawa (JP); Eiichiro Shimizu, Kanagawa (JP); Takeshi Kono, Kanagawa (JP); Masaya Uetsuki, Kanagawa (JP); Nobuyuki Hatasa, Kanagawa (JP); Hiroshi Koshikawa, Kanagawa (JP); Tatsuo Nanjo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 10/067,358

(22) Filed: Feb. 7, 2002

(65) Prior Publication Data

US 2002/0122103 A1 Sep. 5, 2002

(30) Foreign Application Priority Data

Feb. 9, 2001 (JP) ..... 2001-033558
Feb. 9, 2001 (JP) ..... 2001-033562
Feb. 5, 2002 (JP) ..... 2002-028419

(51) Int. Cl.[7] ..... B41J 2/175
(52) U.S. Cl. ..... 347/86
(58) Field of Search ..... 347/85–87, 93, 347/92

(56) References Cited

U.S. PATENT DOCUMENTS 3,708,798 A * 1/1973 Hildenbrand et al. ..... 347/86
3,929,071 A 12/1975 Cialone et al. ..... 101/335
5,187,498 A 2/1993 Burger
5,742,309 A 4/1998 Tajima et al. ..... 347/86
6,039,442 A 3/2000 Hagiwara et al. ..... 347/89
6,142,617 A 11/2000 Barinaga et al. ..... 347/85
6,585,359 B1 * 7/2003 Gasvoda et al. ..... 347/86
6,644,778 B2 * 11/2003 Rotering ..... 347/35
2002/0109758 A1 8/2002 Kono ..... 347/85

FOREIGN PATENT DOCUMENTS

CN 1208695 2/1999
EP 1013445 6/2000
JP 05-096744 * 4/1993 ..... 347/86
JP 6-320732 11/1994
JP 9-85962 3/1997
JP 2000-43287 2/2000

* cited by examiner

*Primary Examiner*—Michael S. Brooke
(74) *Attorney, Agent, or Firm*—Fitzpatrick, Cella, Harper & Scinto

(57) ABSTRACT

A liquid container which supplies ink to its exterior until the ink is almost depleted and allows simple detection of the remaining ink amount, is constructed to distribute components of the ink even after a prolonged standing. The liquid container is provided with a connecting portion for connection to an ink deriving tube and an air introduction tube of an ink jet printer. Both the ink deriving tube and the air introduction tube are positioned for connection to the connecting portion at a position deviated from a center of the bottom of the liquid container. The deviation facilitates mixing of ink components as ink is supplied from the container.

17 Claims, 36 Drawing Sheets

LIQUID CONTAINER, LIQUID SUPPLY SYSTEM AND INK JET RECORDING APPARATUS UTILIZING THE SAME, AND METHOD OF MOUNTING LIQUID CONTAINER ON RECORDING APPARATUS

BACKGROUND OF THE INVENTION

1. Field of the Invention

The present invention relates to a liquid container detachably mounted on an ink jet recording apparatus, and a recording apparatus utilizing such liquid container.

2. Related Background Art

The liquid container mounted on an ink jet recording apparatus, for executing recording by discharging liquid droplet onto a recording sheet, is generally classified into two types, namely a type detachably mounted in the recording apparatus but used in a fixed state, and a type used in a moving state together with a recording head in the transversal direction of the recording sheet in a recording apparatus of so-called serial scan type. The serial scanning means a system in which the recording head is moved in a direction crossing the conveying direction of the recording sheet.

In the so-called on-demand ink jet recording which is a currently prevailing system among various ink jet recording methods and forms a recorded image by discharging a liquid droplet onto a sheet (such as paper) in response to a recording signal, it is essential to maintain a somewhat negative pressure relative to the atmospheric pressure at the nozzle end (also called orifice) of the recording head, in order to discharge the liquid droplet always in a stable manner in response to the recording signal.

The liquid container of the latter type moving together with the recording head of serial scan type is also called an on-carriage tank and is employed widely, because the recording head and the liquid container, containing liquid to be supplied to the recording head, are positioned close whereby the ink supply path can be made shorter and the recording apparatus can be realized compact.

Also as a configuration capable of retaining the liquid therein and supplying the liquid to the exterior, there is commonly used a liquid container utilizing a foamed member such as urethane foam or an entangled fibrous member such as of polypropylene fibers as a capillary force generating member.

However, in case of the latter on-carriage tank, the liquid container mountable together with the recording head on the carriage has a certain limitation in size. More specifically, if a large liquid container is employed in order to reduce the frequency of replacement of the liquid container, there is required an enormous space in order not to hinder the movement of such liquid container, so that the recording apparatus itself becomes large. This drawback becomes more serious in a 4-color or 6-color recording apparatus.

In consideration of such fact, there is increasingly employed the recording apparatus having the ink tank in detachable manner in a fixed position in the apparatus instead of mounting the ink tank on the carriage supporting the recording head, particularly in case of a wide format printer utilizing a very wide recording sheet (liquid supply amount per sheet being accordingly large) or a network printer which is a recording apparatus of a very high working rate. The liquid container in such recording apparatus corresponds to the former and, particularly in case of the recording apparatus of serial scan type, is called an out-carriage tank or an off-carriage tank because the liquid container is fixed in the recording apparatus independently from the movable carriage.

However, such conventional liquid containers have been associated with drawbacks to resolve. Such issues will be explained in the following by the examples of the prior art.

FIG. 22 shows a liquid container 101 having two fluid connection ports 102, 103 with the exterior, approximately at the center of an upper face 101*a* of the liquid container. The connection port 102 is exclusively for deriving liquid 105 from the upper face 101*a* through an internal supply pipe 104 so provided as to reach the bottom 101*b*, in order to securely extract the liquid while the liquid level is lowered by the liquid extraction, until the container becomes almost empty. The other connection port 103 is exclusively for opening to the external air and is so constructed as to directly communicate with the air present above the liquid level in the container.

In such liquid container 101, the liquid level open to the air therefore varies from the upper part 101*a* of the container to the bottom 101*b* thereof. Consequently such liquid container, if directly connected to the ink jet recording head, shows a wide range in the supplied negative pressure, so that the liquid container cannot be made very large (particularly in the direction of gravity).

Also, if there is employed a supply system which once transfers the liquid from the liquid container to the exterior and stabilizes the negative pressure by a relaying tank, there will be required additional components such as a transfer pump and a relaying tank. Furthermore, the connection pipe 103 open to the air is not in contact with the contained liquid 105 in the liquid container and cannot therefore be used as a conductive electrode for detecting the remaining ink amount in combination with the other connection pipe 102, so that there is required another method such as forming a hole in the container bottom 101*b* and inserting an electrode for detecting the remaining amount of the contained liquid. Such method inevitably leads to additional drawbacks of an increase in the cost and possible liquid leakage.

FIG. 23 shows a liquid container 201 of lateral mounting type, in which a connection port 202 for liquid extraction is formed on a lateral face close to the bottom 201*b* of the liquid container 201 and a connection port for opening to the air is formed on a lateral face close to the upper part 201*a* of the liquid container 201. Such liquid container does not require the internal supply pipe but other drawbacks are same as those of the liquid container shown in FIG. 22.

In the ink jet recording technology, there are being required clarity, water resistance, light fastness etc. of the print, and it is proposed to use pigment as the coloring agent of the ink as one of the methods for meeting such requirements. In the pigment-based ink, the pigment is dispersed in ink solvent, and the pigment, having a specific gravity larger than that of the solvent, tends to precipitate after a prolonged standing. For this reason, the pigment concentration becomes different between the upper part and the lower part of the ink contained in the ink tank, thereby generating fluctuation in the print density.

An ink tank disclosed in the Japanese Patent Applications Laid-open Nos. 9-164698, 11-348308 etc. is provided, on the bottom of the container, with a connection port which is positioned close to a lateral wall of the container, but such arrangement of the connection port is determined by the position of an ink supplying pump and does not provide any solution to the pigment precipitation in case pigment is used in the ink.

Also an ink tank disclosed in the Japanese Patent No. 2,929,804 is provided at the bottom thereof with a connection port into which a connection needle communicating with the air and a connection needle for liquid derivation are to be inserted and which is positioned at the center of the tank. Such container configuration is not suitable for a replaceable container since a strong force is required at the connecting operation and the inserting positions of the needles cannot be fixed at each insertion. However there are not taught the issue of pigment precipitation and the position for ink extraction.

Also an ink tank disclosed in the Japanese Patent Application Laid-open No. 10-337879 and the U.S. Pat. No. 6,074,042 has a complex configuration in which an ink chamber is composed of a flexible bag that can be flattened in order to use up the ink contained therein and such flexible bag is pressurized in a casing. Consequently the ink containing space is generally small within the ink tank casing and such configuration is difficult to use for the purpose of providing a tank of a high containing efficiency within a limited space.

Also an ink tank disclosed in the Japanese Patent Application Laid-open No. 10-286972 (cf. FIGS. 1, 6, 7 etc. therein) is provided on the bottom thereof with plural joint points each of which is a free joint composed of an elastic seal member impinging on a substantially flat portion of the tank bottom and an ink supply pipe (with a filter on top) contacting a capillary member contained in the tank for retaining ink therein, wherein an ink supply pipe is positioned at the center of the elastic member. There is thus disclosed a joint portion for an independent ink chamber.

Also an ink tank disclosed in the Japanese Patent Application Laid-open No. 10-95129 (cf. FIG. 6 therein) is provided with plural joint portions for an ink chamber, and such plural joint portions are all for ink derivation. Also the joint portion is composed of an ink absorbent member.

Also an ink tank disclosed in the Japanese Patent Application Laid-open No. 8-132635 (cf. FIGS. 1 and 7 therein) is also provided on the tank bottom with plural joint portions, each of which is so constructed that a plastic ink supply pipe (having a small hole in the tapered portion) penetrates and is pinched by an elastic seal member provided in a port on the tank bottom. Also a portion where the elastic seal member is provided constitutes a small ink chamber directly containing ink, above which provided, across a filter, is a chamber containing a capillary member for retaining ink. Thus, there is disclosed a joint portion for an independent small ink chamber.

Also an ink tank disclosed in the Japanese Patent Publication Nos. 2000-218817 (cf. FIG. 7 therein) and 2000-218824 (cf. FIGS. 6 and 22 therein) is provided with a memory medium for memorizing the tank interior information, but such memory medium is provided on a lateral face of the tank and is fixed in position.

An ink tank disclosed in the Japanese Patent Application Laid-open No. 9-85962 (cf. FIG. 1 therein) is provided in the lower part of the tank with two connection ports for air introduction and for liquid derivation, but there is not taught the issue of pigment precipitation in case of using pigment in the ink. The illustrated tank has two connection ports respectively on both ends, but there is not mentioned the positional relationship of the connection port for liquid derivation and that for air introduction.

On the other hand, in a tank having the connection port downwards, the elastic member employed for sealing the connection port is always in contact with the ink and is therefore not only susceptible to deterioration by the ink but also has to achieve the closing action by wiping off the needle with the elastic member so as to cut off the ink. Particularly in case of employing a needle of a diameter of 1.5 mm or larger in order to improve the ink supplying ability, ink dripping may result before the elastic member completes the sealing action even with the commonly adopted ink properties (specific gravity 1 to 2.2, viscosity 2 to 4 cp, surface tension 25 to 50 mPa·s).

Also in a configuration of detecting the presence or absence of remaining ink by providing the tank bottom with two independent conductive connection needles and applying a voltage therebetween, though the casing need not be newly provided with a penetrating portion for the electrode, ink dripping may still result because two needles are constantly immersed in the ink until the ink tank becomes empty and also because one of the needles communicates with the external air.

In addition, in the ink jet recording, there is being introduced pigment-based ink superior in water resistance and color development in comparison with the dye-based ink as explained in the foregoing, and there is also used ink containing fine resinous particles in order to improve fixation to the recording sheet.

In the aforementioned conventional off-carriage ink tank system, since the ink tank is fixed in position even during the recording operation and the pigment or fine resinous particles contained in the ink are insoluble in solvent water, such pigment or fine resinous particles precipitate to the tank bottom with the lapse of time under the influence of gravity. Such precipitation of pigment or fine resinous particles results in a difference in concentration between the upper part and the lower part of the ink tank, thereby affecting the density or fixability of the formed record or eventually leading to the clogging of the nozzles of the recording head, resulting from the supply of concentrated ink thereto.

For avoiding such drawbacks, it is conceivable to provide the ink tank with an agitating mechanism for forcedly agitating the ink in the ink tank. However, it is not desirable to add an agitating mechanism to the ink tank since the ink tank is so-called consumable to be replaced by a new one when the ink contained in the ink tank is depleted.

In the foregoing, there have been explained the drawbacks of the prior technologies by taking ink tanks as examples, but the aforementioned drawbacks resulting from precipitation may occur not only in the ink tank but also in a liquid container which contains liquid containing an insoluble substance in a dispersed state and is required to supply such liquid to the exterior without causing concentration change therein.

SUMMARY OF THE INVENTION

In consideration of the foregoing, an object of the present invention is to provide a novel liquid container provided with a connection port at the bottom and with, inside the connection port, a common chamber directly containing ink without employing a capillary member for ink retaining, capable of stably supplying the ink to the exterior until the container is almost depleted and also capable of achieving simple detection of remaining ink amount and resolving the uneven distribution of the ink component in standing over a prolonged period.

Another object of the present invention is to provide a liquid container and a liquid supply system capable of supplying liquid to the exterior with a stable concentration by a simple structure, and a method of agitating the liquid in such liquid container. Still another object of the present invention is to provide an ink jet recording apparatus capable of supplying the recording head with ink of stable concentration, thereby achieving recording of high quality.

The above-mentioned objects can be attained, according to an embodiment of the present invention, by a liquid container to be detachably mounted on a vertically upward port, having a flat shape and Phi provided at the bottom with two independent fluid connection ports for communicating the liquid chamber with the exterior of the container wherein the two connection ports are provided close to an end of the bottom.

In the above-mentioned liquid container, the external shape and the internal space thereof are preferably pointed toward the bottom of the container.

Also, the aforementioned two fluid connection ports are preferably positioned on a line passing through the approximate center of the shorter side of the flat shape of the liquid container.

Also, the fluid connection port closer to the end of the bottom of the liquid container is preferably used for allowing derivation of the liquid in the liquid chamber. As the liquid is derived from such fluid connection port, the liquid itself flows in the liquid chamber whereby the pigment can be diffused and homogenized in case the pigment is used as a component of the contained liquid. In the fluid connection port closer to the end of the bottom of the liquid container of flat shape, the nearby space is surrounded by three walls directed to the ceiling of the container, the liquid in the vicinity is moved and is easily agitated even with a low derivation amount of the liquid.

Also there is preferably provided a member for filtering the derived liquid, so as to cover the fluid connection port closer to the aforementioned end.

Also the fluid connection port closer to the center of the bottom of the liquid container is preferably used for allowing air introduction. In case the contained liquid employs the pigment as a component thereof, since the internal space (liquid chamber) of the container is pointed toward the bottom and the fluid connection port is provided closer to the center of the bottom of the container, when air is introduced in an amount matching the derived amount of the contained liquid, bubbles float at the approximate center, where the pigment tends to be concentrated, in the pigment precipitation area at the bottom of the liquid chamber thereby agitating the contained liquid to achieve diffusion and homogenization thereof.

Also, a tubular member is preferably provided protruding toward the ceiling part of the liquid chamber so as to surround the aforementioned fluid connection port closer to the center of the liquid chamber. The lateral face of such tubular member serves as a wall to the fluid connection port closer to the end of the bottom of the liquid container of flat shape, the bubbles from the fluid connection port closer to the center do not easily move to the fluid connection port closer to the end, and, in case of liquid derivation from the aforementioned fluid connection port closer to the end, the contained liquid is moved and is agitated more easily even at a low liquid derivation amount, in comparison with a case where the tubular member is absent. Also in the presence of such tubular member, by forming two connection needles, to be respectively connected to the two fluid connection ports on the bottom of the container, with a conductive material and maintaining the connected needles at a position lower than the upper end of the tubular member, it is rendered possible to easily judge the remaining amount of the contained liquid by the conductive state between the connection needles.

Also, by providing a structure disturbing the rising movement of the bubbles in an upper space in which the air bubbles rise from the bottom portion of the tubular member along with the liquid derivation, it is rendered possible suppress and recover the uneven distribution or precipitation of the pigment or specified component. Also, such structure may serve also as a rib, which connects the two opposed faces of largest area of the liquid container of flat shape and prevents crushing or inflation of the liquid container.

Also the aforementioned two fluid connection ports are preferably provided with elastic members for sealing the liquid chamber.

Also there is preferably provided an identification information structure for mechanically memorizing the identification information of the liquid container, in such a manner as to substantially perpendicularly protrude from a face continued to and crossing the longitudinal end of the oblong bottom of the liquid container. In this manner, in case of using several liquid containers containing different liquids as a set in a liquid supply system or a recording apparatus, it is rendered possible to securely prevent erroneous mounting, in the specified mounting position of each liquid container, of a wrong liquid container.

Also, in an area of the bottom of the liquid container where the fluid connection ports are not provided, there is preferably provided an information memory element based on an electric, magnetic, optical or combined system and capable of holding identification information for the liquid container.

Such information memory element is preferably capable, in addition to readout of the memorized information from the exterior of the liquid container, of alteration, deletion or additional writing of the memorized information.

According to another embodiment of the present invention, there is provided a liquid supply system employing the aforementioned liquid container, wherein an air introducing connection needle and a liquid deriving connection needle are respectively connected to the two connection ports in the bottom of the liquid container.

According to still another embodiment of the present invention, there is provided a liquid supply system employing the aforementioned liquid container, wherein the system is provided with an air introducing connection needle and a liquid deriving connection needle to be respectively connected to the two connection ports in the bottom of the liquid container, the air introducing connection needle is so positioned as to remain within the aforementioned tubular member and the liquid deriving connection needle is provided at a height approximately same as that of the air introducing connection needle.

Also, in the liquid supply system of these embodiments, there is preferably provided a liquid discharge head which is connected, through a liquid supply tube, to an end of the liquid deriving connection needle opposite to the connection end thereof to the liquid container. Such liquid discharge head is preferably an ink jet head for causing a liquid droplet to fly by pushing out the liquid in a nozzle by thermal or vibration energy.

According to still another embodiment, there is provided an ink jet recording apparatus on which the aforementioned liquid container is detachably mountable.

There is furthermore provided a method of mounting on an ink jet recording apparatus comprising:

a step of guiding the liquid container principally utilizing the external shape portion in the projection plane in the inserting direction until the front end portion of a connection member of the recording apparatus enters a connection member introduction guide member of the liquid container, which enables smooth connection to the two fluid connection ports in the bottom of the liquid container;

a step of relaxing the positional defining by the aforementioned external shape portion after the front end portion of the connection member enters the guide portion of the fluid connection port in the bottom of the liquid container;

a succeeding step of executing entry of the connection member into the fluid connection port; and a succeeding step of starting the connection of a connector corresponding to an information memory element with the information memory element.

Furthermore, the aforementioned objects can be attained, according to the present invention, by a liquid container comprising:

a liquid chamber containing liquid;

a liquid supply portion provided in the bottom portion of the liquid chamber for supplying the liquid in the liquid chamber to the exterior;

an air introducing portion provided in the bottom portion of the liquid chamber and adapted to introduce air into the liquid chamber so as to maintain a constant pressure in the liquid chamber along with the liquid supply by the liquid supply portion; and a liquid agitating structure provided inside the liquid chamber and adapted to agitate the liquid in the liquid chamber, utilizing liquid flow generated in the liquid chamber by the air introduction from the air introducing portion into the liquid chamber.

As the liquid agitating structure, there can be utilized at least a rib structured member provided protruding from the internal wall of the liquid chamber.

In the liquid container of the present invention, when air is introduced from the air introducing portion into the liquid chamber, the introduced air rises as bubbles in the liquid. The movement of the bubbles generates a liquid flow in the liquid chamber, in the vicinity of the air introducing portion. Such flow collides with the liquid agitating structure and is thus disturbed, whereby the agitation of the liquid in the liquid chamber is accelerated to achieve supply of the liquid of a stable concentration from the liquid supply portion to the exterior.

The liquid agitating structure can be realized by an extremely simple structure such as a rib protruding from the internal wall of the liquid chamber. In order to effectively agitate the liquid flow, the rib is preferably provided higher than the air introducing portion. Also by forming the rib between the air introducing portion and the liquid supply portion, the liquid to be agitated in the vicinity of the air introducing portion is prevented from gathering in the vicinity of the liquid supply portion. Also by forming ribs on mutually opposed positions on the mutually opposed two internal walls of the liquid chamber, the liquid flows respectively directed to the lateral walls and deflected by the ribs mutually collide to further stimulate the liquid agitation.

In case it is difficult to direct the liquid flow in the liquid chamber to the lateral wall, the rib may be formed as a pillar-shaped member connecting the mutually opposed two internal wall of the liquid chamber. In such case, the pillar-shaped member may be provided in a position to be collided by the rising liquid flow generated in the liquid chamber or in a position above the air introducing portion and between the liquid supply portion and the air introducing portion, thereby achieving more efficient liquid agitation.

Also the liquid supply system of the present invention comprises:

an aforementioned liquid container of the present invention;

liquid supply means connected with the liquid supply portion of the liquid container for supplying the liquid in the liquid chamber to the exterior of the liquid chamber; and air introducing means connected with the air introducing portion of the liquid container thereby causing the interior of the liquid chamber to communicate with the air.

Presence of the aforementioned liquid supply means and air introducing means allows effective exploitation of the functions of the aforementioned liquid container of the present invention, thereby enabling supply of the liquid of stabilized concentration to the exterior.

Also the ink jet recording apparatus of the present invention is an ink jet recording apparatus for recording on a recording medium by discharging liquid ink, comprising:

holding means for detachably holding a recording head for executing recording by discharging ink;

the aforementioned liquid container of the present invention for containing ink to be supplied to the recording head;

a liquid supply unit for connecting the recording head and the aforementioned liquid supply portion of the liquid container thereby supplying ink in the aforementioned liquid chamber to the recording head along with the ink discharge from the recording head and communicating the interior of the liquid chamber with the air through the aforementioned air introducing portion of the liquid container; and suction for forcedly sucking the ink in the recording head.

In the ink jet recording apparatus of the present invention, prior to the recording by the recording head, the suction means forcedly sucks the ink in the recording head thereby sucking the ink in the liquid container through the liquid supply system, whereby the ink in the liquid container is agitated as described in the foregoing. In this manner ink of stable concentration is used for recording, thereby enabling formation of a satisfactory image with stable density.

The liquid agitating method of the present invention is to agitate the liquid in a liquid container comprising a liquid chamber containing liquid; a liquid supply portion provided in the bottom portion of the liquid chamber for supplying the liquid in the liquid chamber to the exterior; an air introducing portion provided in the bottom portion of the liquid chamber and adapted to introduce air into the liquid chamber; and a rib provided on the internal wall of the liquid chamber, the method comprising:

a step of supplying the liquid in the liquid chamber from the liquid supply portion to the exterior; and a step of introducing air from the air introducing portion into the liquid chamber so as to maintain constant the pressure in the liquid chamber, decreasing by the liquid supply from the liquid supply portion to the exterior, and generating a flow in the liquid in the liquid chamber directed directly or indirectly toward the rib.

By introducing air into the liquid chamber along with the supply of the liquid from the liquid chamber to the exterior thereby generating a liquid flow toward the rib in the liquid chamber, the flow generated in the liquid chamber is disturbed by the rib whereby the liquid in the liquid chamber is effectively agitated.

In the present invention, words upper, lower and bottom used for indicating the position or direction means upper, lower and bottom of the container in the state of use thereof.

DESCRIPTION OF THE PREFERRED EMBODIMENTS

Now the present invention will be clarified in detail by embodiments thereof, with reference to the accompanying drawings.

At first there will be explained the configuration of the liquid container with reference to FIGS. 1, 2, 3A, 3B, 4, 5, 6, 7, 8A and 8B.

Figure 1:
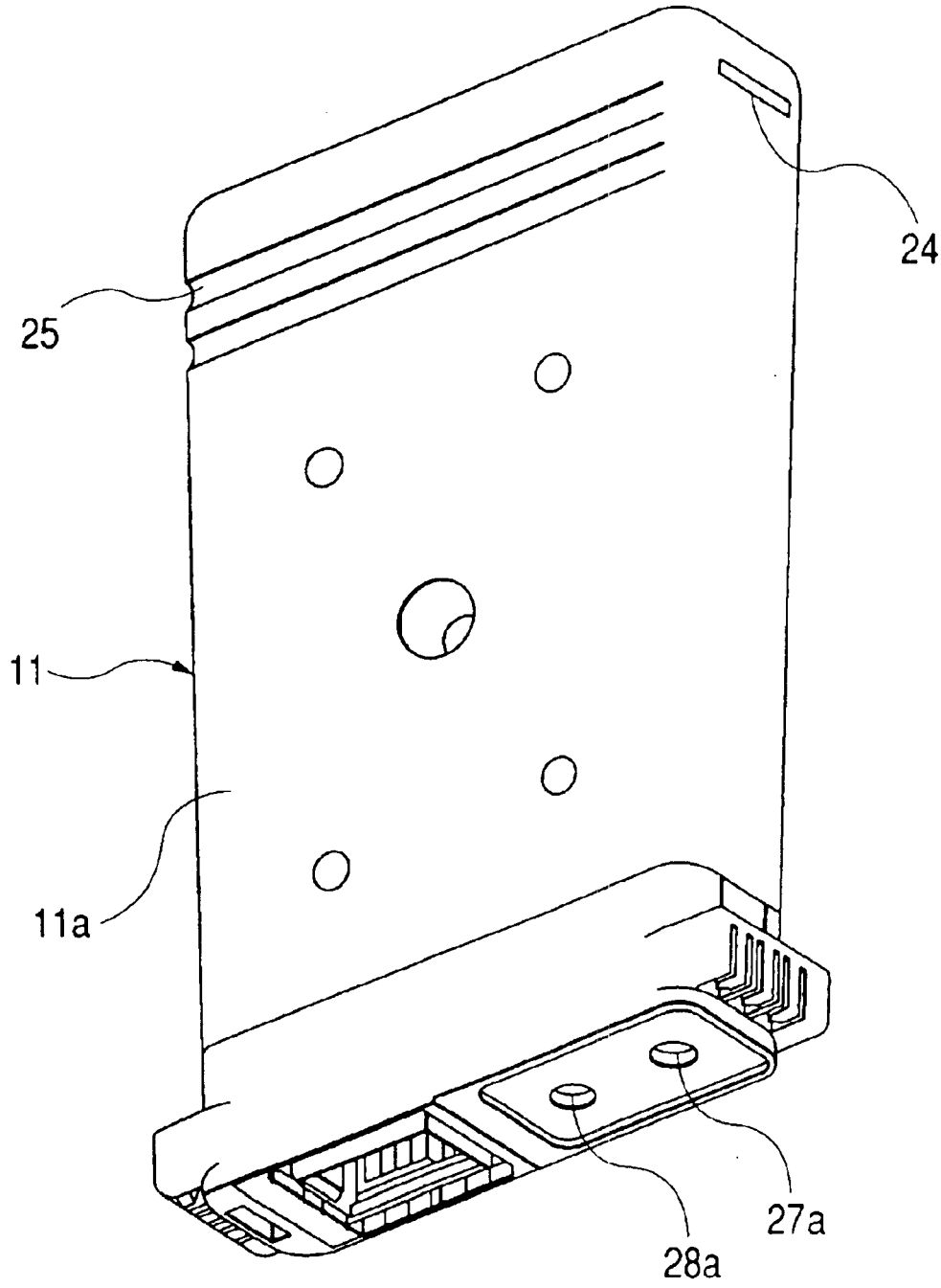
FIG. 1 is an external view of a liquid container of the present invention prepared by direct blow molding, seen from diagonally below.
Figure 2:
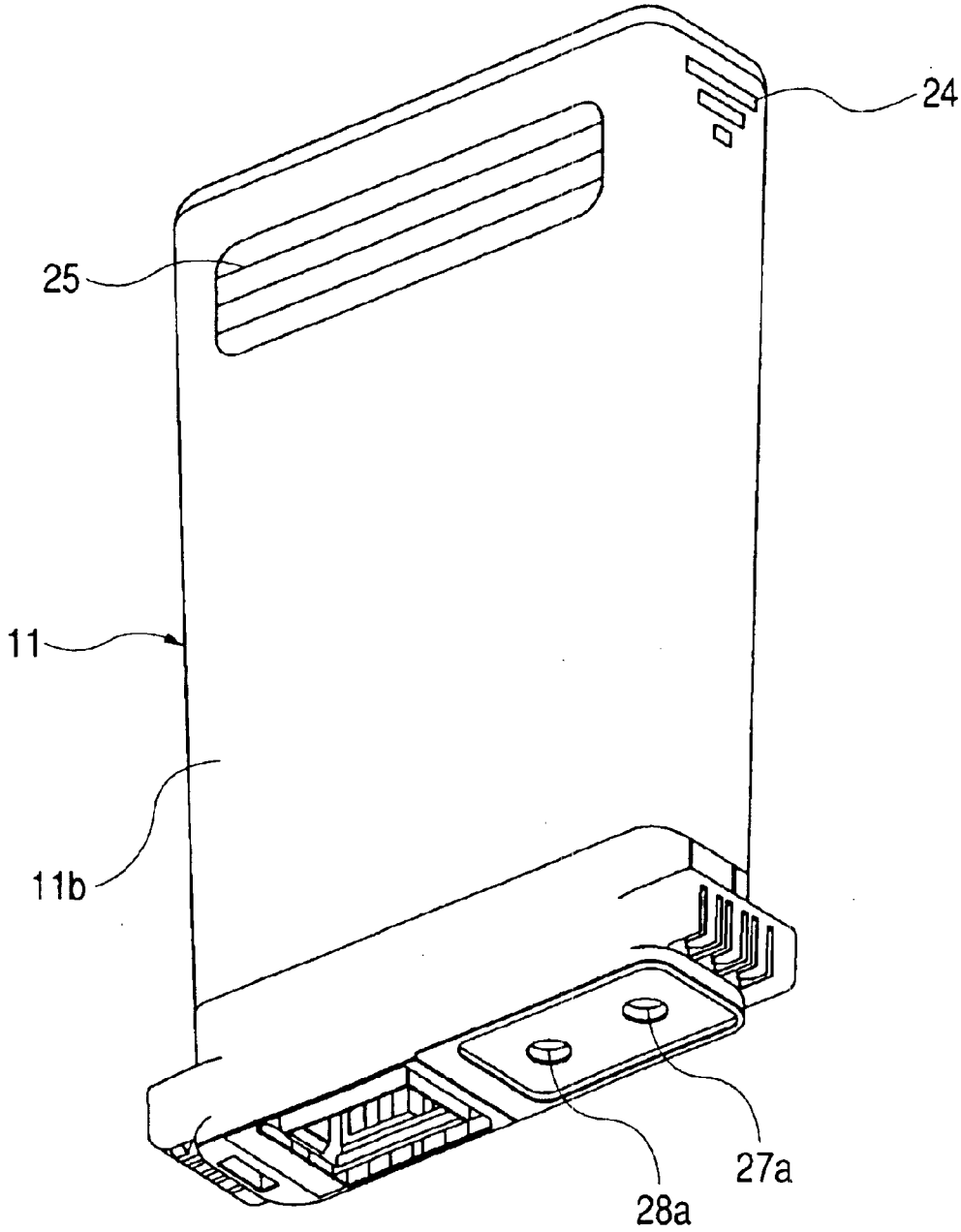
FIG. 2 is an external view of a liquid container of the present invention prepared by injection molding, seen from diagonally below.
Figure 3B:
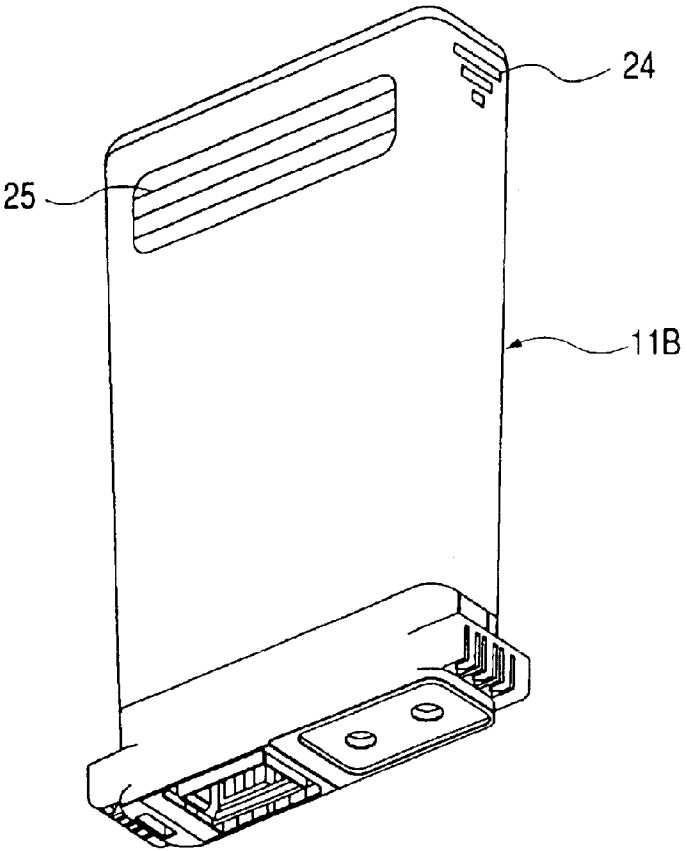
FIGS. 3A and 3B are views of a liquid container of a substantially flat shape of the present invention, shown in two forms which are different in the width in the substantially vertical direction of a face with largest area.
Figure 3A:
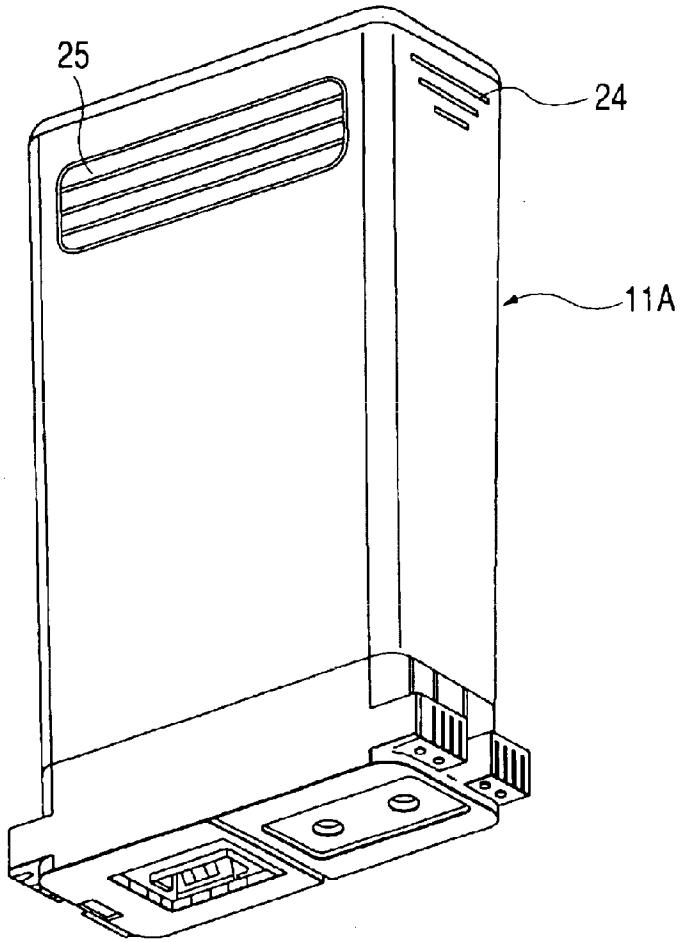
Figure 4:
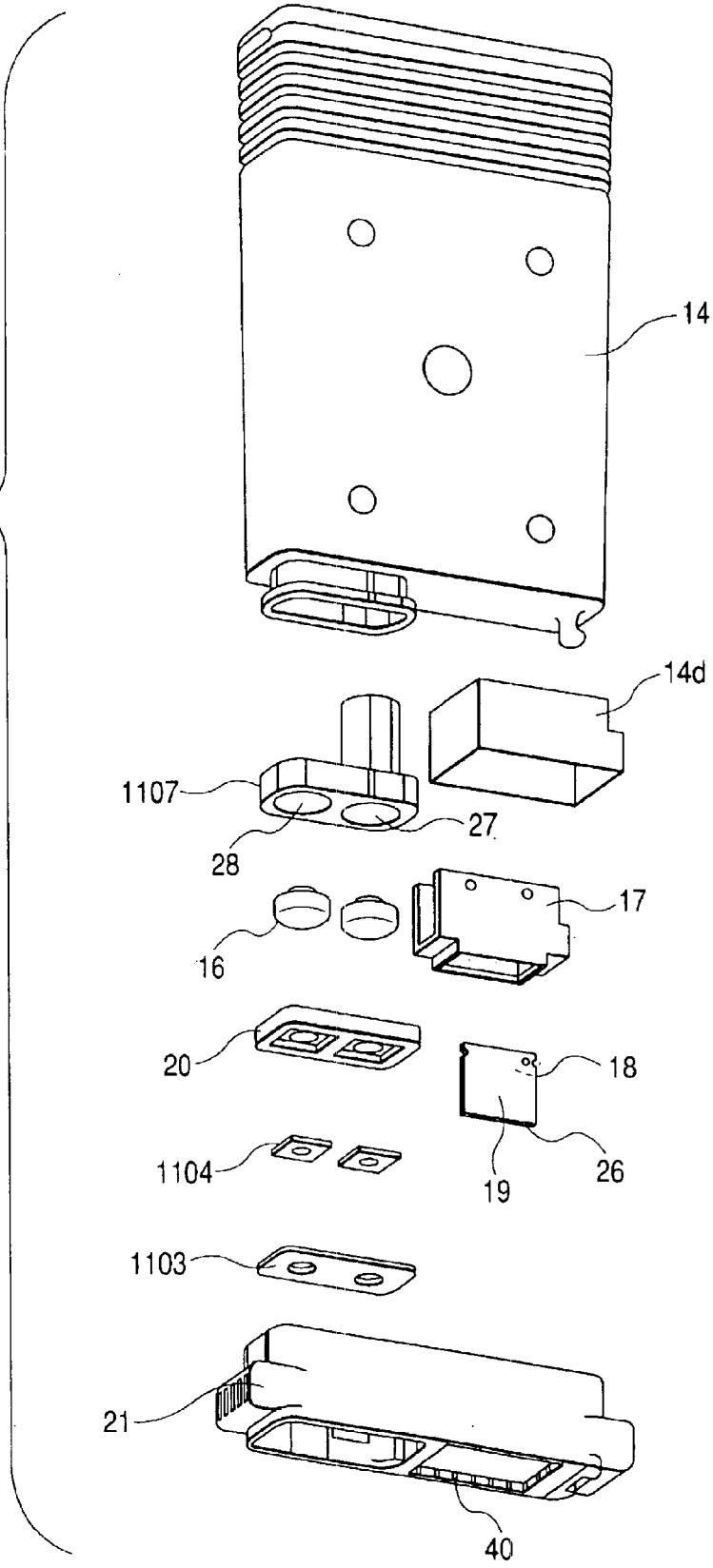
FIG. 4 is an exploded perspective view showing components constituting an embodiment of the liquid container of the present invention.

The liquid container of the present invention has, as shown in FIGS. 1, 2, 3A and 3B, an approximately flat shape so as to be arranged in plural units in mutually adjacent manner. The liquid container is composed of a liquid containing portion 11*a* by blow molding as shown in FIG. 1 or a liquid containing portion 12*b* by injection molding as shown in FIG. 2. Also the liquid container 11 may be prepared as a large container 11A as shown in FIG. 3A or as a small container 11B as shown in FIG. 3B.

Figure 5A:
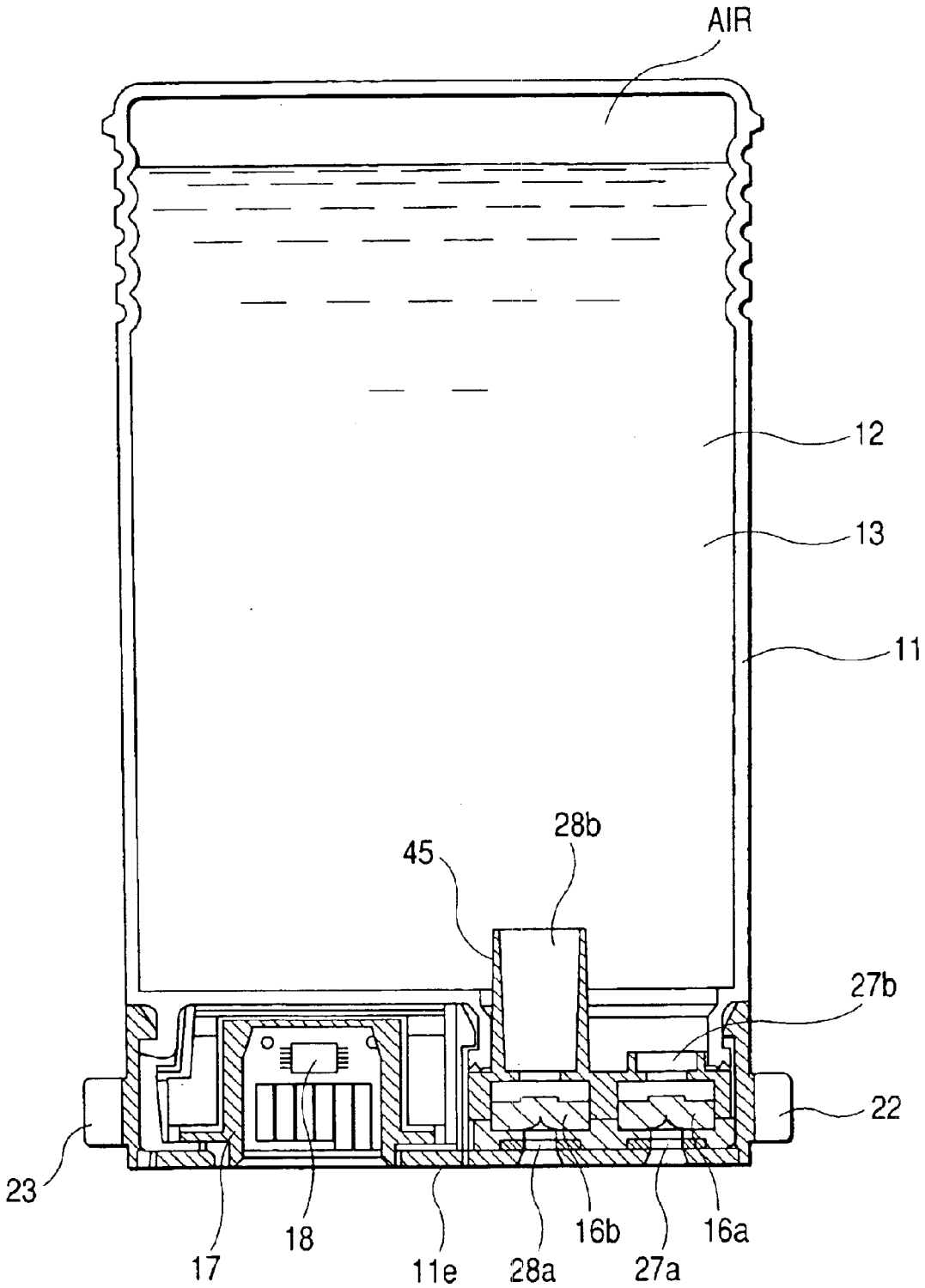
FIG. 5A is a cross-sectional view of an embodiment of the liquid container of the present invention shown in FIG. 4, along a line passing through the center in the shorter side of the flat shape.
Figure 5B:
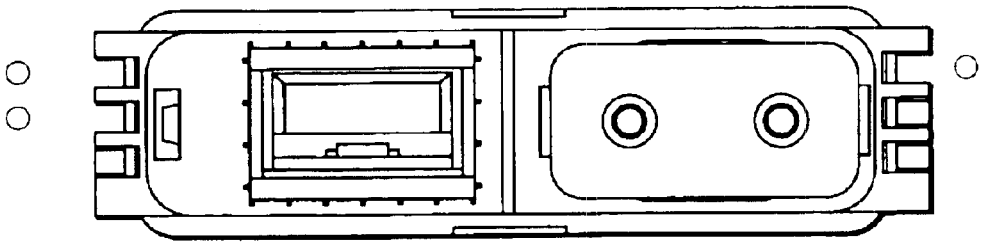
FIGS. 5B, 5C and 5D are end views of such liquid container in different states.
Figure 5C:
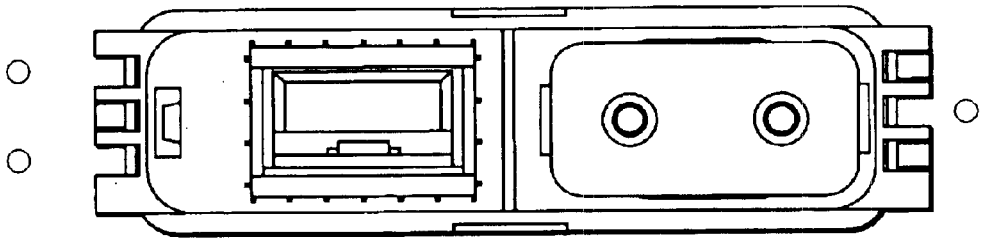
Figure 5D:
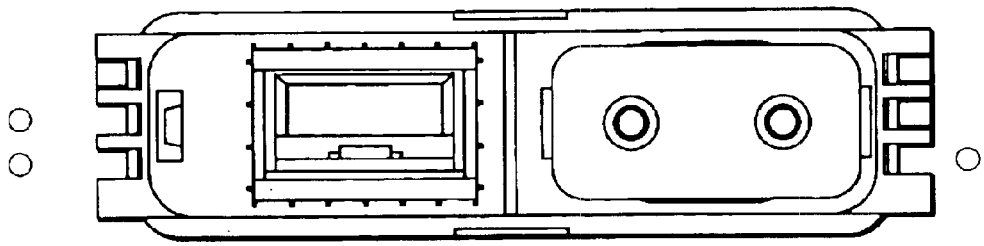
Figure 6:
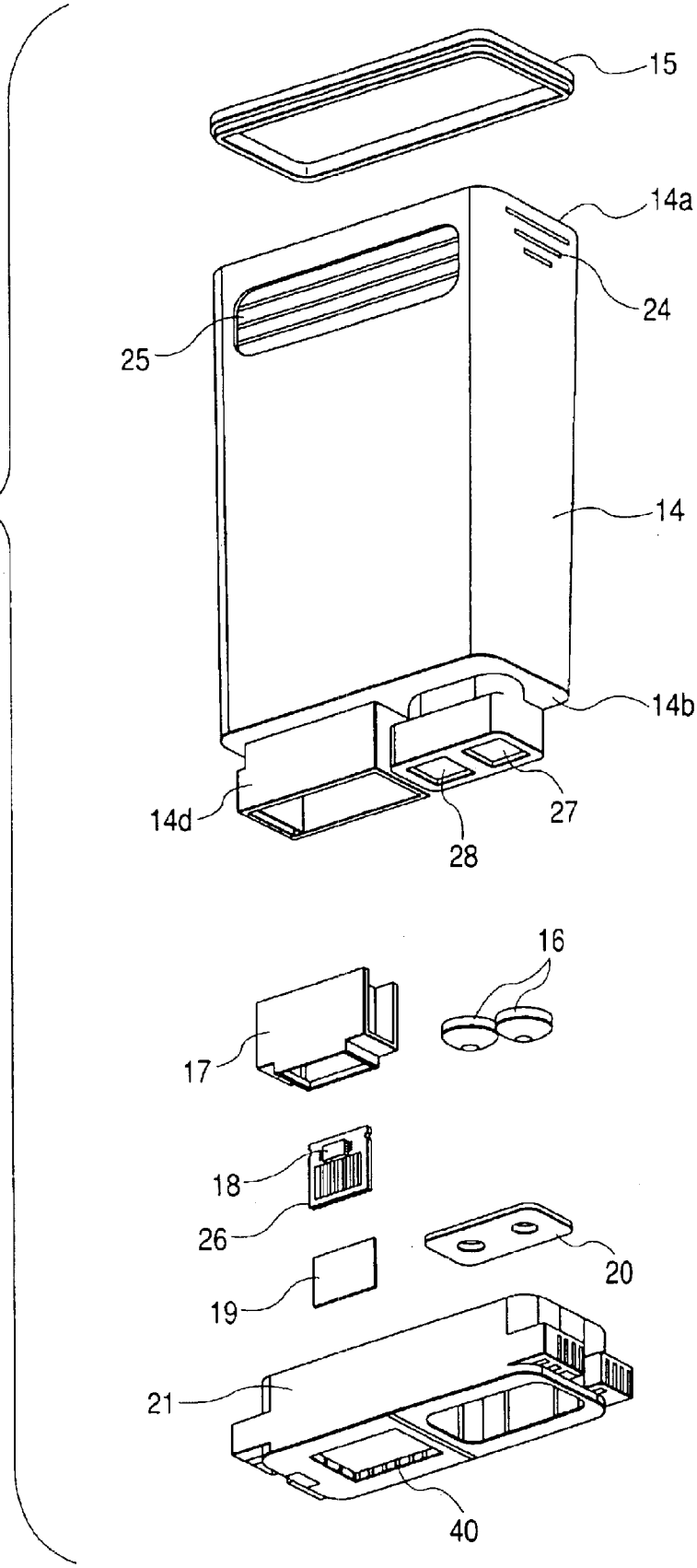
FIG. 6 is an exploded perspective view showing components constituting an embodiment of the liquid container of the present invention.

FIGS. 4, 5A to 5D, 6 and 7 show components of the liquid container of the present embodiment, wherein FIGS. 4 and 5A to 5D show an example of the small container 11B by blow molding shown in FIGS. 1 and 3B, and FIGS. 6 and 7 show an example of the large container 11A by injection molding shown in FIGS. 2 and 3A. The following description will be made principally with reference to FIG. 6. As shown in FIG. 6, the liquid container is composed of a liquid containing portion 14, a cover 15, elastic members 16, a memory medium holder 17, a memory medium 18, a double-sided adhesive tape 19, a fixing member 20 and a bottom cover 21. Such composition of the components is similar also in the small container 11B shown in FIG. 3B. It is also similar in the embodiment shown in FIG. 4, which in particular shows a configuration composed of a liquid containing portion 14 integrally containing the liquid containing portion and the cover by blow molding, a housing 1107 (including a port guide portion 14*c*) independent from a bottom portion 14*b*, a memory medium holder containing member 14*d*, an absorbent member 1104 provided below elastic members 16 and penetrated by a connection member from the exterior, and an absorbent member cover 1103.

The liquid containing portion 14 has an aperture at a top face 14*a* and has a flat shape for directly containing the liquid therein. A cover 15 closes the aperture on the top face 14*a* of the liquid containing portion 14.

On an external bottom portion 14*b* of the liquid containing portion 14, there is provided a port guide portion 14*c* for forming communication of an unrepresented liquid deriving connection needle and an unrepresented air introducing connection needle with the internal space of the liquid containing portion 14 through the elastic members 16. Two apertures (connection ports 27, 28) of the port guide portion 14*c* for passing the liquid deriving connection needle and the air introducing connection needle are provided on a center line in the shorter side of the flat shape of the liquid container and are both positioned close to an end of the flat container bottom. More specifically, a connection port for a connection needle is positioned closer to the end of the container bottom, while the other connection port is positioned close to the end of the container bottom but closer to the center thereof. In the two apertures of the port guide portion 14*c*, the elastic members 16 are respectively inserted and fixed by the fixing member 20.

The port guide portion 14*c* is provided closer to the end of an area among two areas divided in the longitudinal direction of the bottom 14*b*. In the other area there is provided the memory medium holder containing portion 14*d*. In the memory medium holder containing portion 14*d*, there is contained a memory medium holder 17, with a gap therearound, on which an electric wiring board 26 having a memory medium 18 electrically storing the identification information (ID) of the liquid container is fixed with the double-sided adhesive tape 19.

On the bottom portion 14*b*, a bottom cover 21 is mounted to cover the port guide portion 14*c* in which the elastic members 16 are fixed and the memory medium holder containing portion 14*d* containing, with a gap, the memory medium holder 17 holding the memory medium 18. After the assembly of the liquid container, the memory medium holder 17, being contained with a gap in the bottom cover 21, can move therein without deformation within a predetermined range.

The space containing the memory medium holder 17 is closed except for an aperture formed on the bottom of the liquid container for accepting a connector to the memory medium 18, and is so constructed that the leaking liquid, in case of a breakage or a leak in the vicinity of the elastic members 16 fixed in the port guide portion 14*c*, does not reach the memory medium holder 18. Such structure is also same in the configuration shown in FIG. 4 where the memory medium holder containing member is independent.

Also in the space constituting the gap between the memory medium holder 17 and the memory medium holder containing portion 14*d*, there are provided capillary grooves 40 capable of absorbing the liquid which may eventually enters the memory medium holder 17 from the bottom of the liquid container through the external wall thereof, thereby allowing to prevent entry of the liquid into the memory medium holder 17. Such grooves also serve to prevent entry of the liquid droplets around the connection port on the container bottom into the memory medium holder 17 even in case the liquid container is inverted to a position where the bottom there is positioned above.

The identification information memory medium 18 can be any medium such as of magnetic, magnetooptical, electric or mechanical type capable of identification information by information acquiring means, such as a flash memory or a write-once magnetic medium. In case the liquid container of the present embodiment is employed as an ink tank for an ink jet recording apparatus, the memory medium 18 can be composed of an EEPROM which is capable not only of the holding of the identification information and the information reading from the ink jet recording apparatus but also of the addition of memorized information from the ink jet recording apparatus and the alteration or deletion of the memorized information. The electric wiring board 26, supporting the memory medium 18, is provided with a contact portion with an electrical connector fixed on the ink jet recording apparatus. However, the above-described configuration is not restrictive, and it is also possible to provide the ink tank with an electronic medium having an antenna on the electric wiring board having no power source but capable of non-contact information exchange by electromagnetic power generation and to provide the recording apparatus with a connector-shaped proximity antenna, and it is also possible to employ a combination of an optical writing head and a recording medium.

Figure 7:
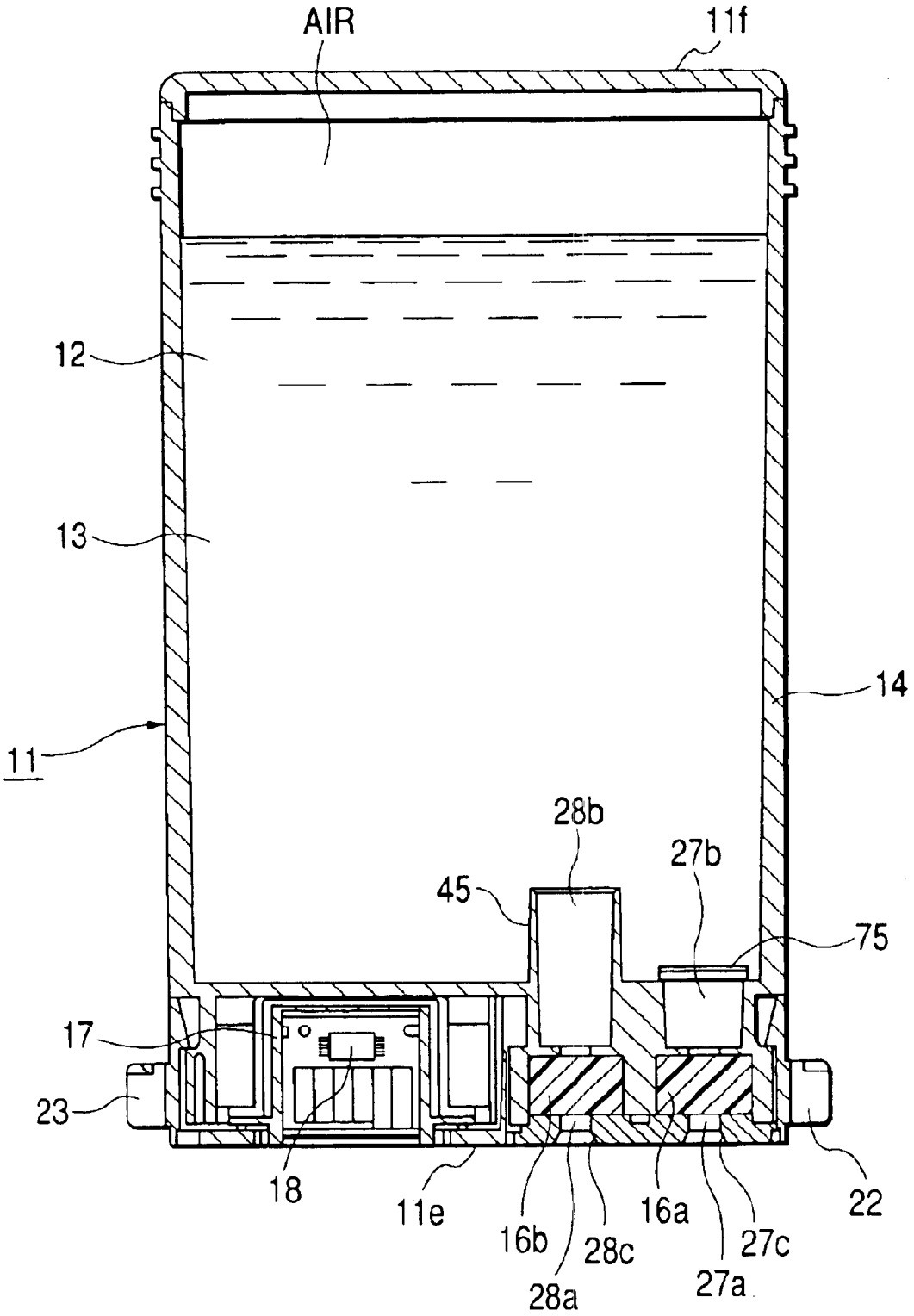
FIG. 7 is cross-sectional view of an embodiment of the liquid container of the present invention shown in FIG. 6, along a line passing through the center in the shorter direction of the flat shape.

In the liquid container 11 composed of such components, there is formed, as shown in FIG. 7, a closed liquid chamber 13 for containing ink 12 for recording a color for example on an ink jet recording apparatus. When the liquid container 11 is mounted on the ink jet recording apparatus (cf. FIG. 33), the liquid chamber 13 is positioned at the upper side of the liquid container 11.

Also the external shape of the flat liquid container 11 is pointed toward the bottom of the container. The wall constituting the liquid chamber 13 has a substantially uniform thickness, so that the space itself inside the wall is also pointed toward the container bottom. Consequently, as the liquid level is lowered by the consumption of the ink, the ink smoothly gathers to the container bottom while maintaining a flat liquid surface.

On the bottom portion lie of the liquid container 11, there are provided a first connection port 27*a* and a second connection port 28*a* for connecting the liquid deriving connection needle and the air introducing connection needle (not shown) to the liquid chamber 13. The entrances of the first connection port 27*a* and the second connection port 28*a* are form as a first introducing portion 27*c* and a second introducing portion 28*c* of a tapered shape for facilitating introduction of the connection needles.

Figure 8A:
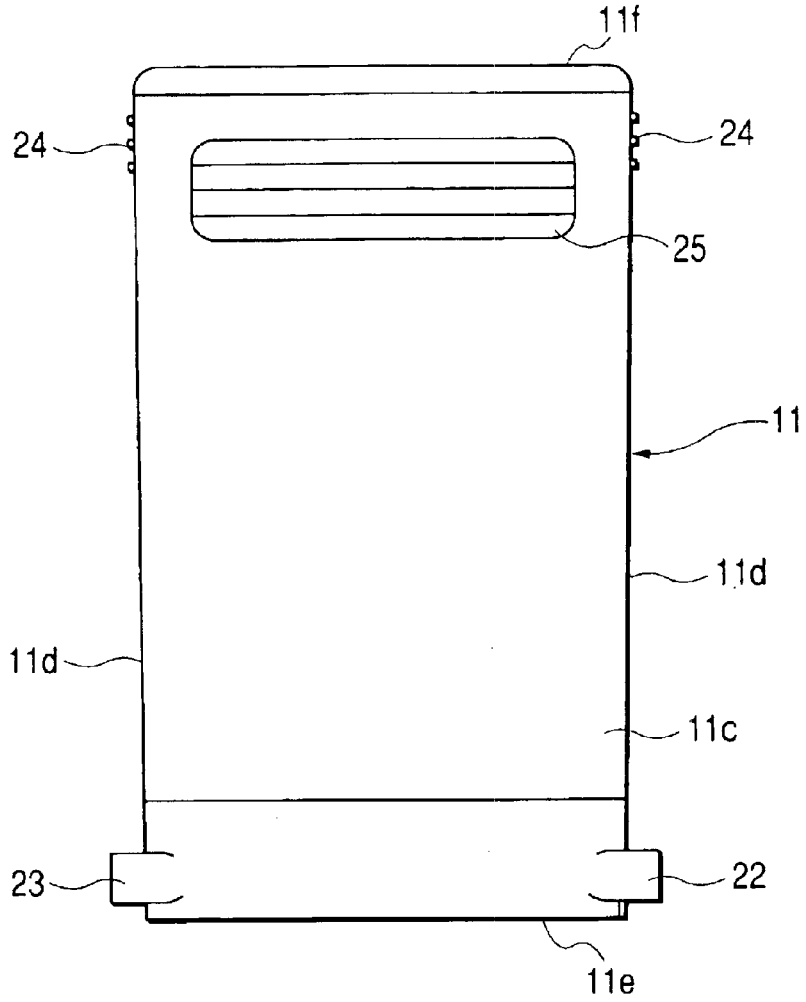
FIGS. 8A and 8B are respectively an external view seen from the face of largest area and an external view seen from the container bottom, of an embodiment of the liquid container of the present invention.
Figure 8B:
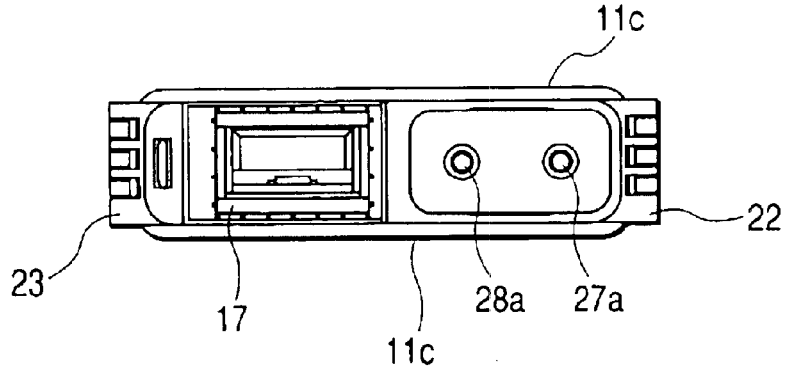

Also, as shown in FIGS. 8A and 8B, the liquid container 11 of flat shape has two continuous faces 11*d* sandwiched between and connected to two faces 11*c* of largest area. On the two continuous faces 11*d*, in the vicinity of the tank bottom 11*c*, there are respectively provided a first tank ID portion 22 and a second ID portion 23 which perpendicularly protrude from the respective faces and extend partially toward a ceiling portion 11*f* of the container. The protruding portion is in a position slightly displaced from the bottom 11*c* of the container toward the container ceiling 11*f*. The information identified by such mechanical identification information unit overlaps with the information memorized in the electrical identification information memory medium, but is particularly limited to the information specific to the type (color) of the ink.

On the two largest area faces 11*c* and the two continuous faces 11*d* of the liquid container 11, in the vicinity of the ceiling portion 11*f* thereof, there are provided projections 24 or recesses 25 to be used as holding portions for attaching or detaching the liquid container 11 to or from the ink jet recording apparatus. In the present embodiment, the recesses 25 are provided on the largest area faces 11*c* while the projections 24 are provided on the continuous faces 11*d*, but the present invention is not limited to such configuration.

In the following there will be explained, with reference to FIGS. 9, 10A, 10B, 11A, 11B, 12A, 12B, 13A, 13B, 14A, 14B, 15A, 15B, 16A and 16B, a process for connecting the liquid deriving connection needle and the air introducing connection needle respectively to the two connection ports of on the bottom 11*e* of the liquid container 11.

Figure 9:
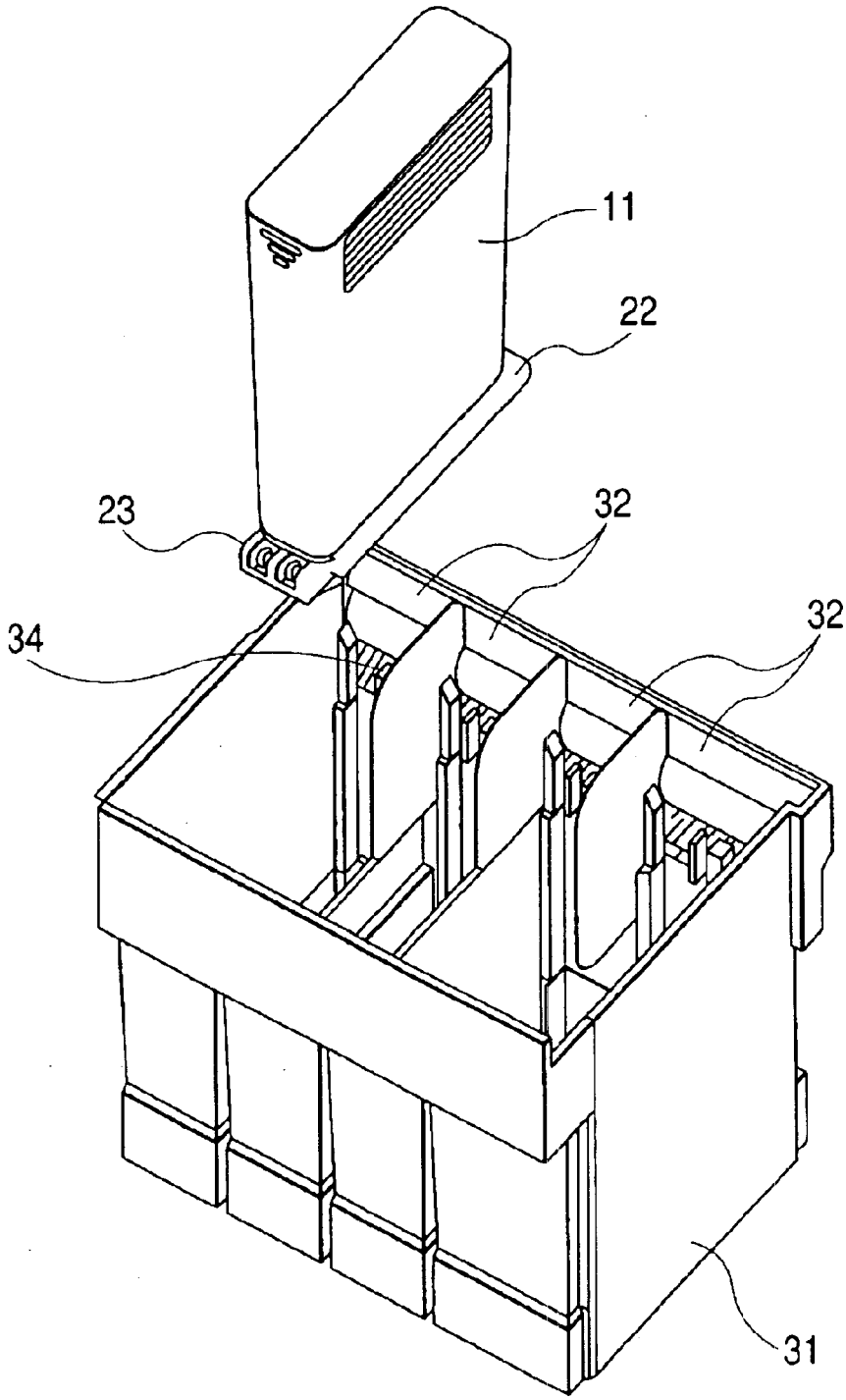
FIG. 9 is a view showing an example of connection of an air introducing connection pipe and a liquid deriving connection pipe to connection ports of an embodiment of the liquid container of the present invention.
Figure 10A:
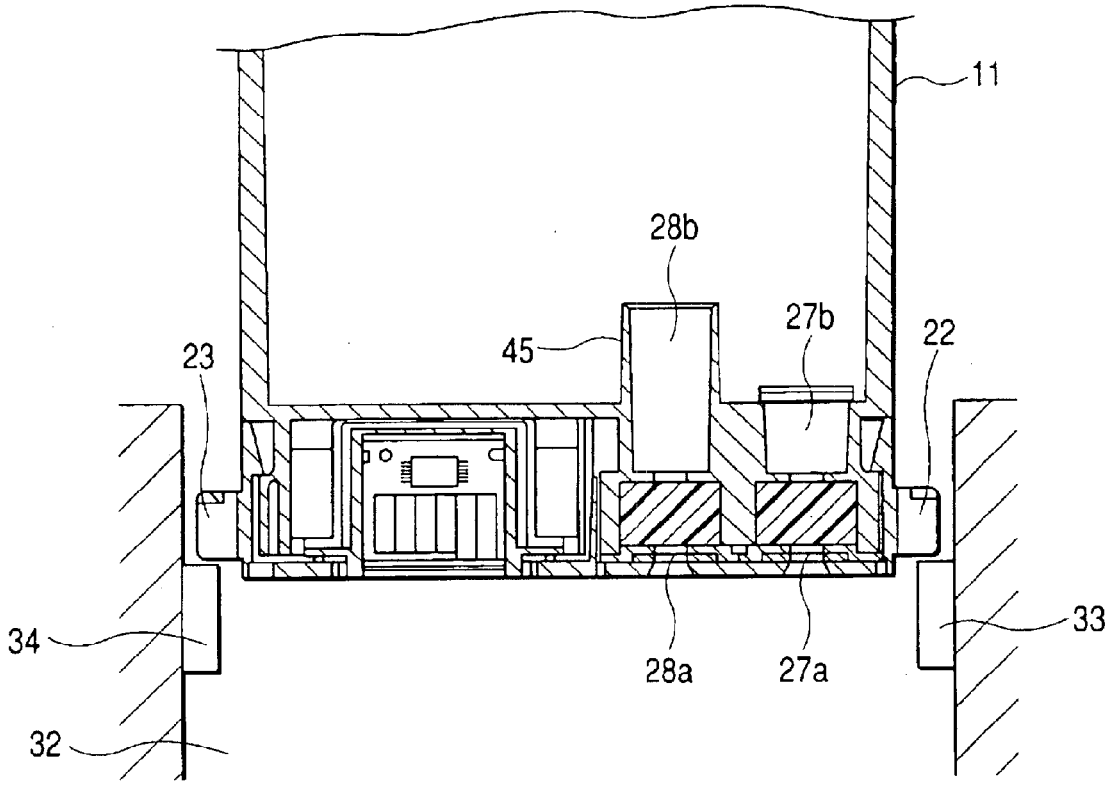
FIGS. 10A and 10B are respectively a cross-sectional view of the liquid container along a line passing through the center of the shorter side of the flat shape and an end view thereof, showing a part of the mounting process of the liquid container in a station base shown in FIG. 9, in a state immediately before the entry of a tank ID portion of the liquid container into a main body ID portion of a slot.
Figure 10B:
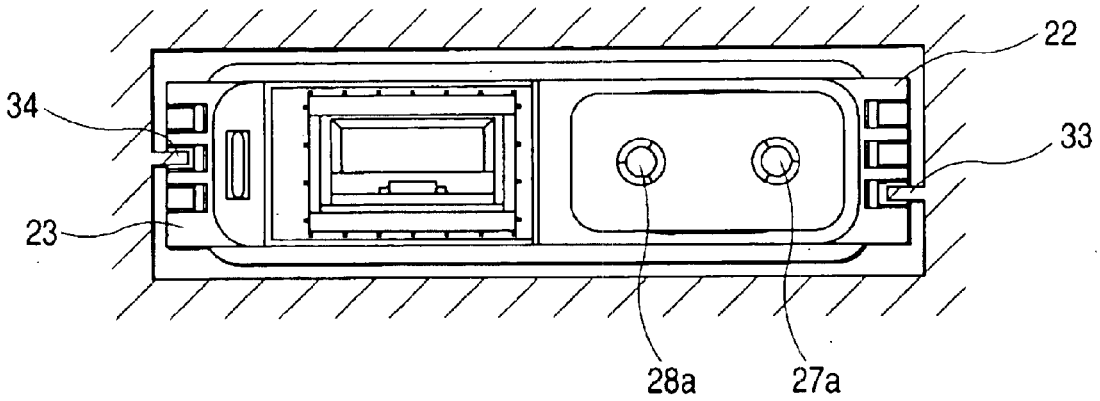
Figure 11A:
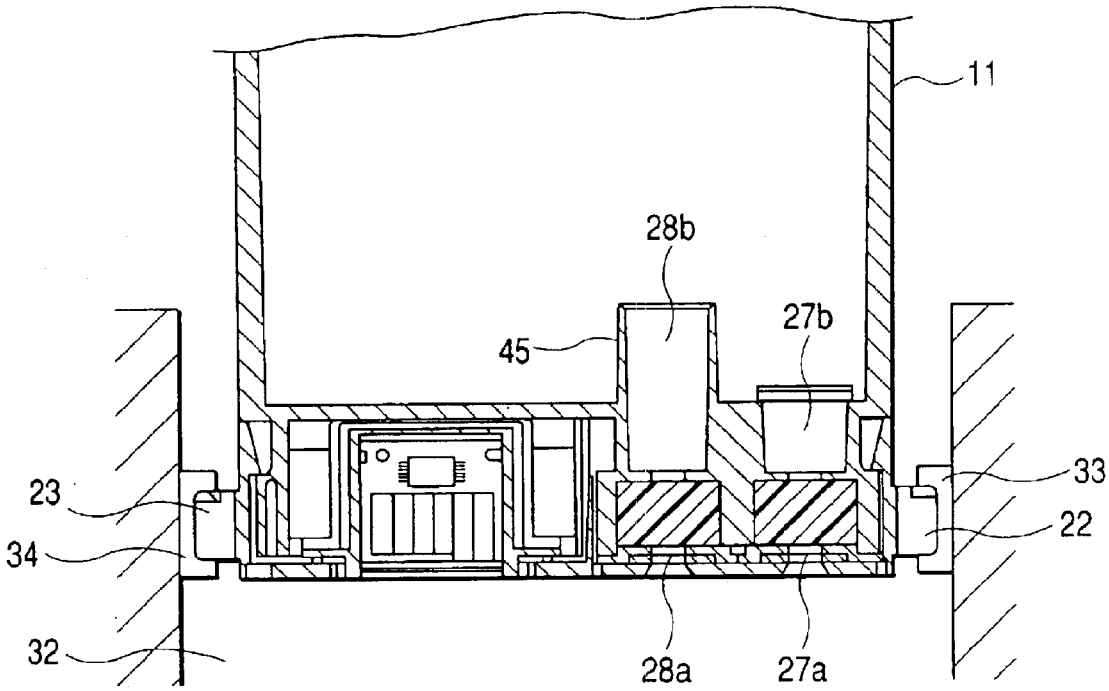
FIGS. 11A and 11B are respectively a cross-sectional view of the liquid container along a line passing through the center of the shorter side of the flat shape and an end view thereof, showing a part of the mounting process of the liquid container in a station base shown in FIG. 9, in a state during the passing of the tank ID portion of the liquid container through the main body ID portion of a slot.
Figure 11B:
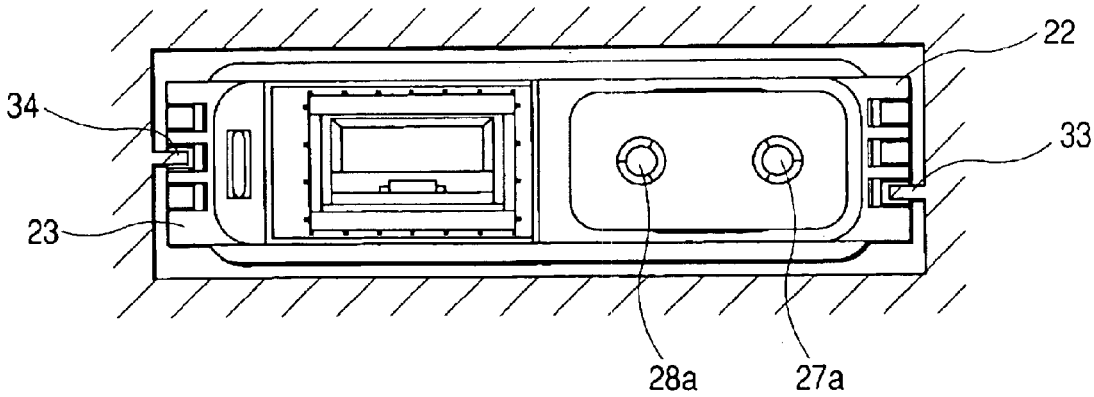
Figure 12A:
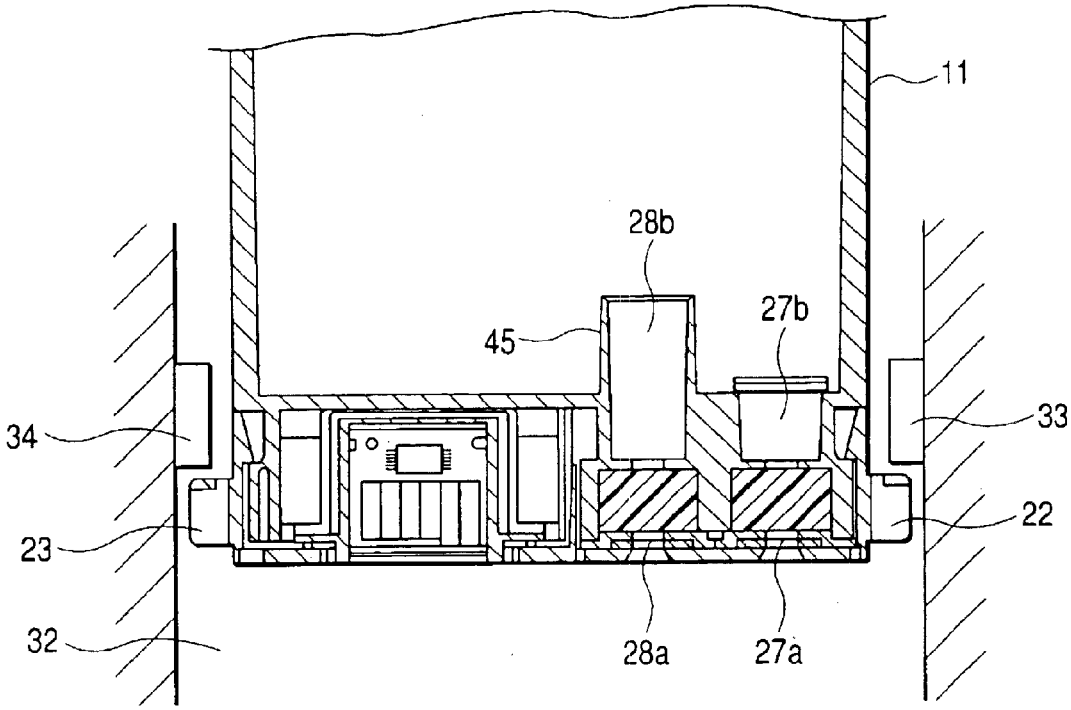
FIGS. 12A and 12B are respectively a cross-sectional view of the liquid container along a line passing through the center of the shorter side of the flat shape and an end view thereof, showing a part of the mounting process of the liquid container in a station base shown in FIG. 9, in a state after the passing of the tank ID portion of the liquid container through the main body ID portion of a slot.
Figure 12B:
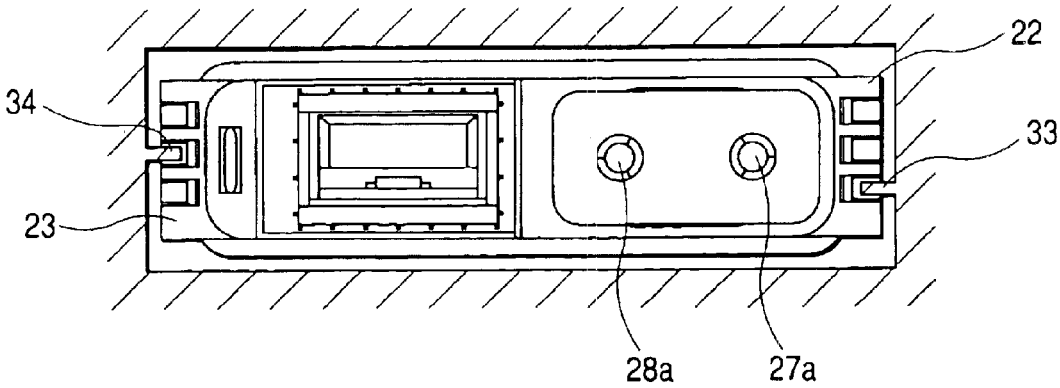

The liquid deriving connection needle and the air introducing connection needle are provided on the bottom of a slot 32 in a station base 31 as shown in FIG. 9, into which the liquid container 11 is to be inserted from the bottom portion 11*e* thereof. The station base is provided with slots 32 having apertures substantially vertically upwards, for accommodating the liquid containers 11 of respective colors.

The liquid deriving connection needle and the air introducing connection needle have a same length and a same shape, and the front ends thereof are tapered so as to respectively penetrate the two elastic members (for example rubber stoppers) provided at a substantially same height in the bottom of the liquid container 11. Inside each connection needle, there is formed a tubular path closed at the front end of the needle, and slightly below the tapered portion at the front end of the connection needle, namely in the vicinity of the starting part of the straight portion, there is provided a longitudinally oblong hole communicating with the tubular path inside the connection needle (cf. FIGS. 13A, 13B, 14A, 14B, 15A, 15B, 16A and 16B). The liquid deriving connection needle and the air introducing connection needle are fixed on the bottom of the slot 32 in such a manner that the front ends of the needles are at substantially same heights, and the needle holes are also at substantially same height.

When the liquid container 11 starts to be inserted into the slot 32, the first tank ID portion 22 and the second tank ID portion 23 formed on the external lateral faces of the liquid tank 11 can pass through a first main body ID portion 33 and a second main body ID portion 34 formed on the internal lateral faces of the slot 32 as shown in FIGS. 10A, 10B, 11A, 11B, 12A and 12B, only in case the slot 32 is a proper one for receiving the liquid container 11.

The structure of the first tank ID portion 22 and the second tank ID portion 23, representing the mechanical identification information (ID) of the container, are so determined that the plural liquid containers containing respectively different inks become non-interchangeable, but, within a single recording apparatus, the tank ID portion of either side, namely the first tank ID portion 22 or the second tank ID portion 23 alone is so constructed that the liquid containers become non-interchangeable. Such structure allows to avoid a situation where, in case of erroneously mounting a liquid container in a wrong position, if the user has a feeling that the ID portion of even a side can be passed, the user believes that the container can be mounted and continues the mounting operation thereby resulting in a breakage in the main body of the recording apparatus. (FIGS. 5B to 5D show examples of such structure, in which a circle mark (○) indicates a notched recess.) Also for a similar reason, the liquid containers having a same shape and of a same color but containing inks of different compositions to be regarded as non-interchangeable are so constructed as to become non-interchangeable in the first tank ID portion 22 or the second tank ID portion 23 only even between the different ink jet recording apparatuses.

Figure 13A:
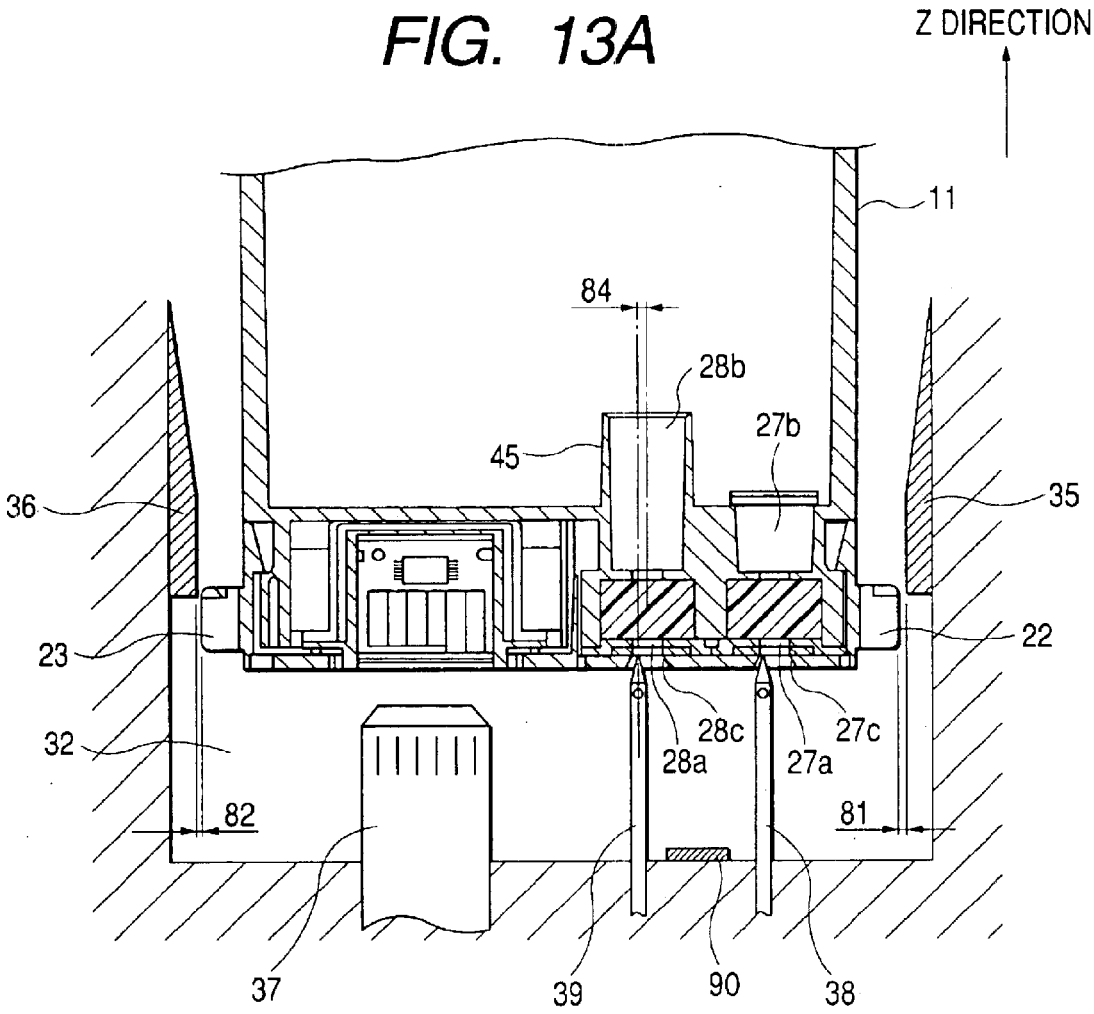
FIGS. 13A and 13B are respectively a cross-sectional view of the liquid container along a line passing through the center of the shorter side of the flat shape and an end view thereof, showing a part of the mounting process of the liquid container in a station base shown in FIG. 9, in a state where an air introducing connection needle and a liquid deriving connection needle fixed on the internal bottom of the slot start to impinge on an introducing portion on the bottom of the liquid container.
Figure 13B:
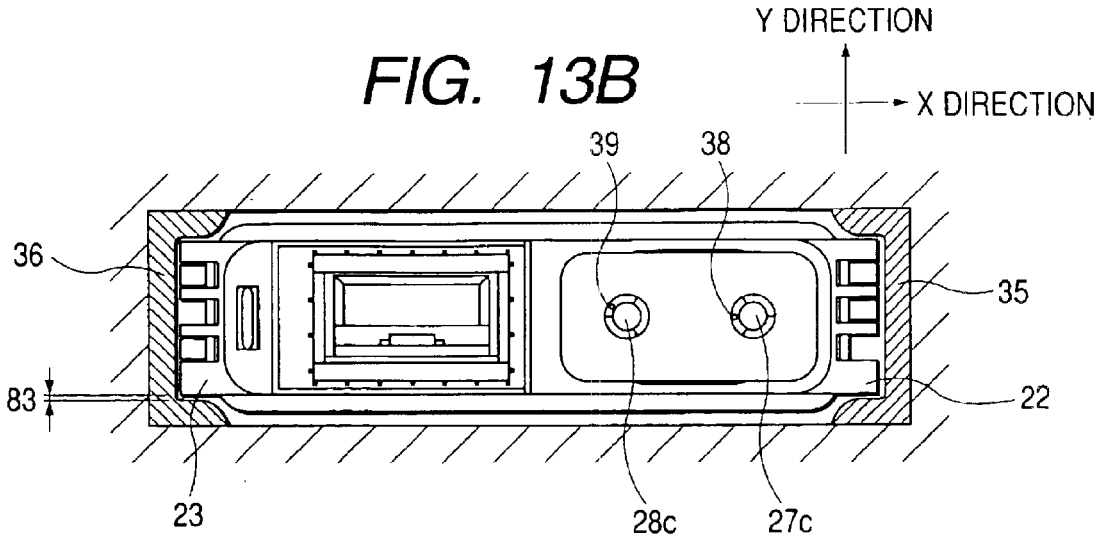

Thereafter, as the liquid container 11 is brought closer to the internal bottom of the slot 32, the external shapes of the first and second tanks ID portions 22, 23 of the liquid container 11 are defined in position by a first positioning portion 35 and a second positioning portion 36 on the internal lateral faces of the slot 32, as shown in FIGS. 13A and 13B, whereby the liquid container proceeds without the positional aberration in the horizontal direction (X-direction shown in FIG. 13A and Y-direction. (For example, clearances 81, 82 in the X-direction and a clearance 83 in the Y-direction are defined as dimensional tolerance.) Then, as shown in FIG. 13B when the introducing portions 27*c*, 28*c* on the lower face of the liquid container 11 reach the front ends of the connection needles 38, 39, the liquid deriving connection needle 38 and the air introducing connection needle 39 protruding on the bottom face of the slot 32 respectively impinge on the first introducing portion 27*c* of the first connection port 27*a* and the second introducing portion 38*c* of the second connection port 28*a*, on the bottom face of the liquid container 11. Thereafter, before the connection needles 38, 39 reach the elastic members 16*a*, 16*b*, the external shape portions of the tank ID portions 22, 23 are released from the positional definition by the positioning portions 35, 36.

Thereafter the container moves in the X- and Y-directions with reference to the connection needles.

Figure 14A:
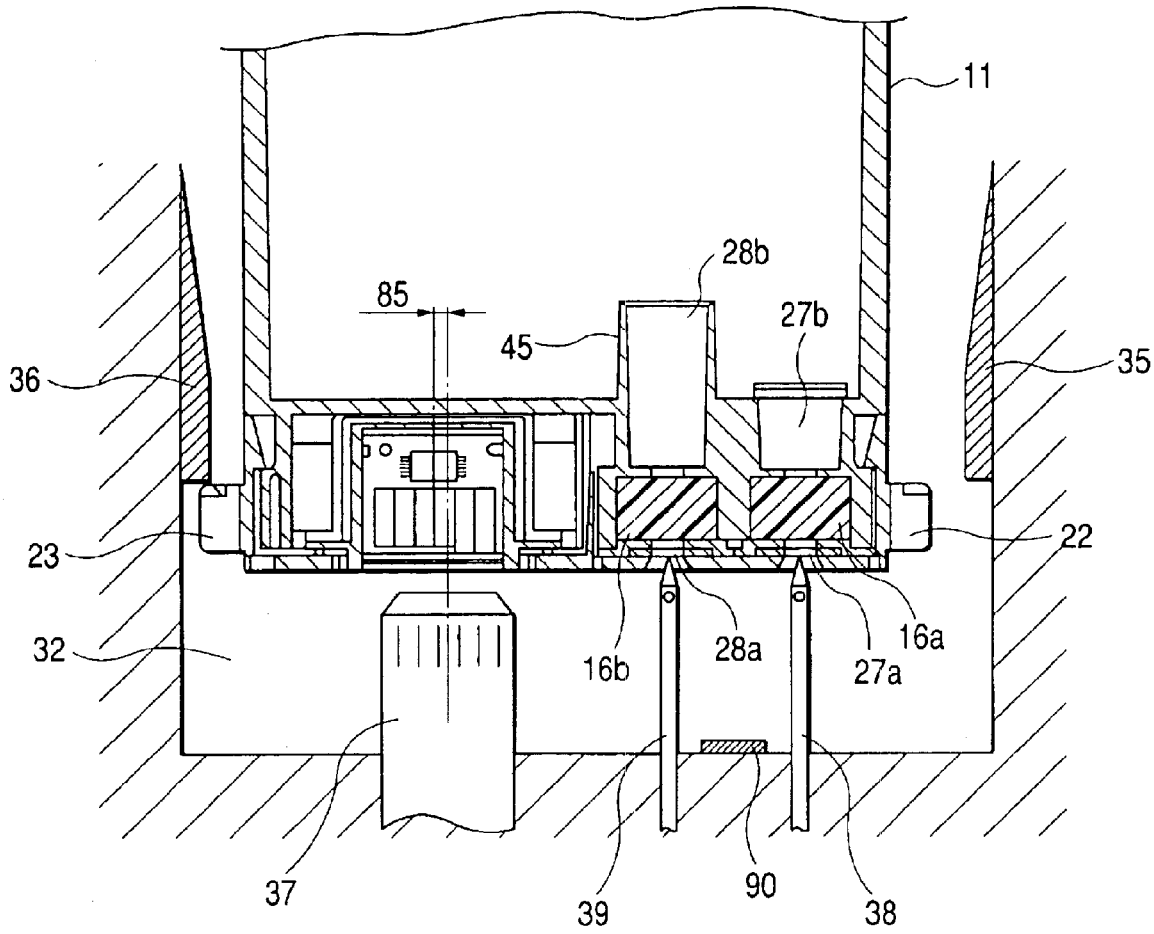
FIGS. 14A and 14B are respectively a cross-sectional view of the liquid container along a line passing through the center of the shorter side of the flat shape and an end view thereof, showing a part of the mounting process of the liquid container in a station base shown in FIG. 9, in a state where the air introducing connection needle and the liquid deriving connection needle fixed on the internal bottom of the slot start to enter elastic members provided in the connection ports on the bottom of the liquid container.
Figure 14B:
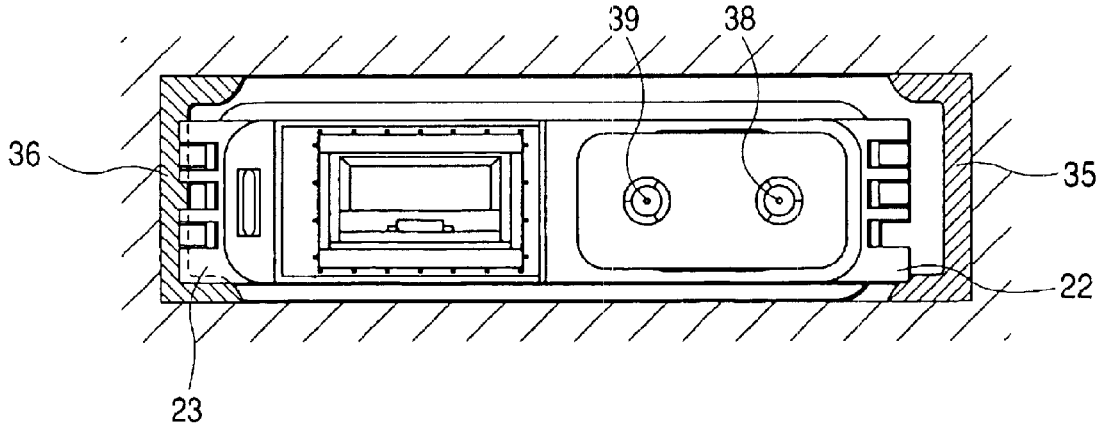
Figure 15A:
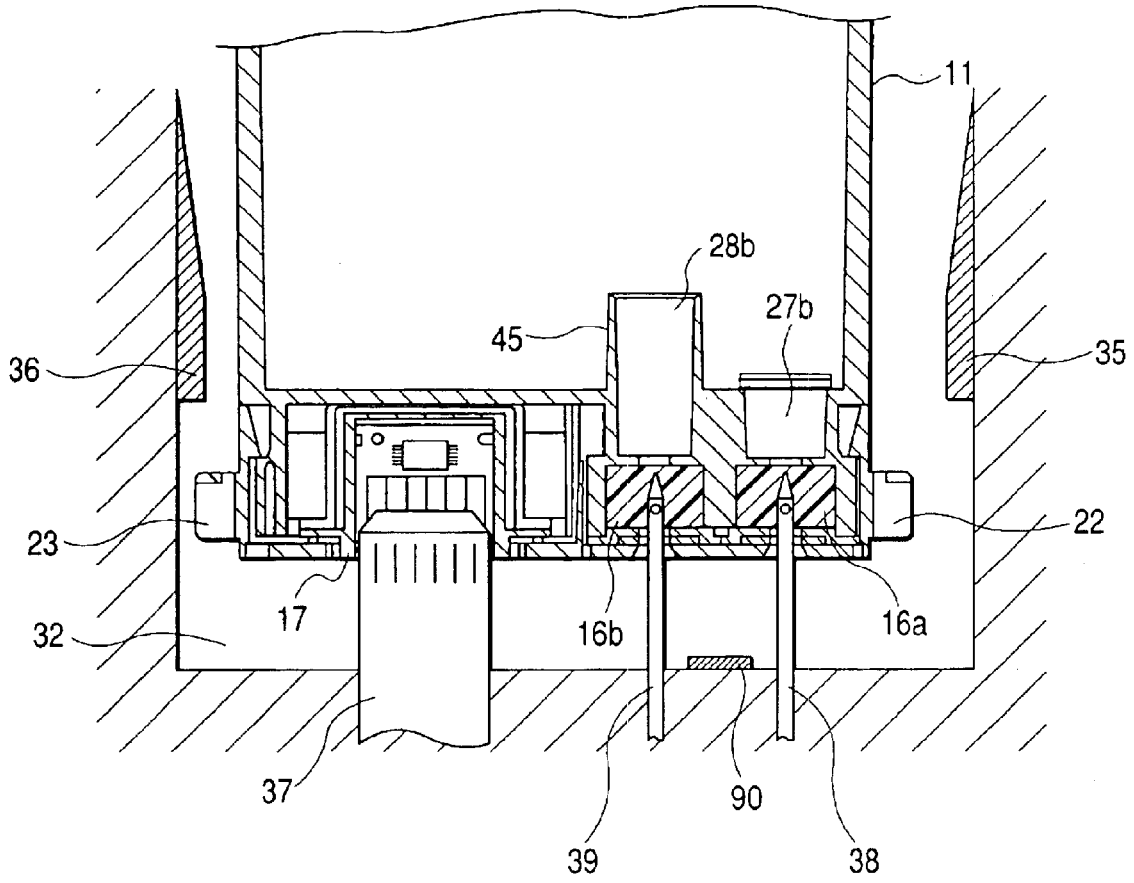
FIGS. 15A and 15B are respectively a cross-sectional view of the liquid container along a line passing through the center of the shorter side of the flat shape and an end view thereof, showing a part of the mounting process of the liquid container in a station base shown in FIG. 9, in a state where the air introducing connection needle and the liquid deriving connection needle fixed on the internal bottom of the slot penetrate the elastic members in the connection ports on the bottom of the liquid container and an identification information memory medium holder is in a position corresponding to an electrical signal connector fixed on the internal bottom of the slot thereby initiating equalization.
Figure 15B:
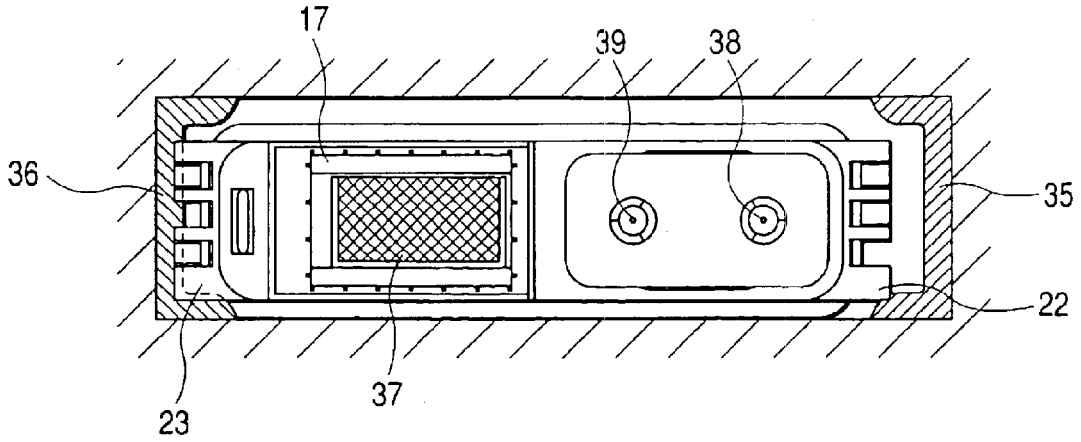

Consequently the liquid container 11 released from the engagement so moves that the connection ports 27*a*, 28*a* are respectively guided to the positions of the connection needles 38, 39 (in a specific illustrated example in FIG. 13A, the liquid container 11 so moves as to resolve the aberration in the central positions of the introducing portion 28*c* and the connection needle 29), whereby the connection needles 38, 39 start to substantially simultaneously enter the elastic members 16*a*, 16*b* provided in the connection ports 27*a*, 28*a* as shown in FIGS. 14A and 14B. Such needle insertion in a state where the liquid container is released from positionally limited state, it is rendered possible to avoid damaging the two connection needles 38, 39 by the liquid container and also to reduce the error in mounting.

In the course of insertion of the connection needles 38, 39 into the elastic members 16*a*, 16*b*, the front end of the electrical connector 37 on the internal bottom of the slot 32 starts to enter the memory medium holder 17 of the liquid container 11. Since the memory medium holder 17 is movably mounted, even if the memory medium holder 17 is displaced relative to the connector 37 (cf. aberration 85 in FIG. 14A), the memory medium holder 17 moves along the tapered front end portion of the electrical connector 37, whereby it can be securely inserted into the memory medium holder 17 without hindrance or uncomfortable feeling in the mounting.

Figure 16A:
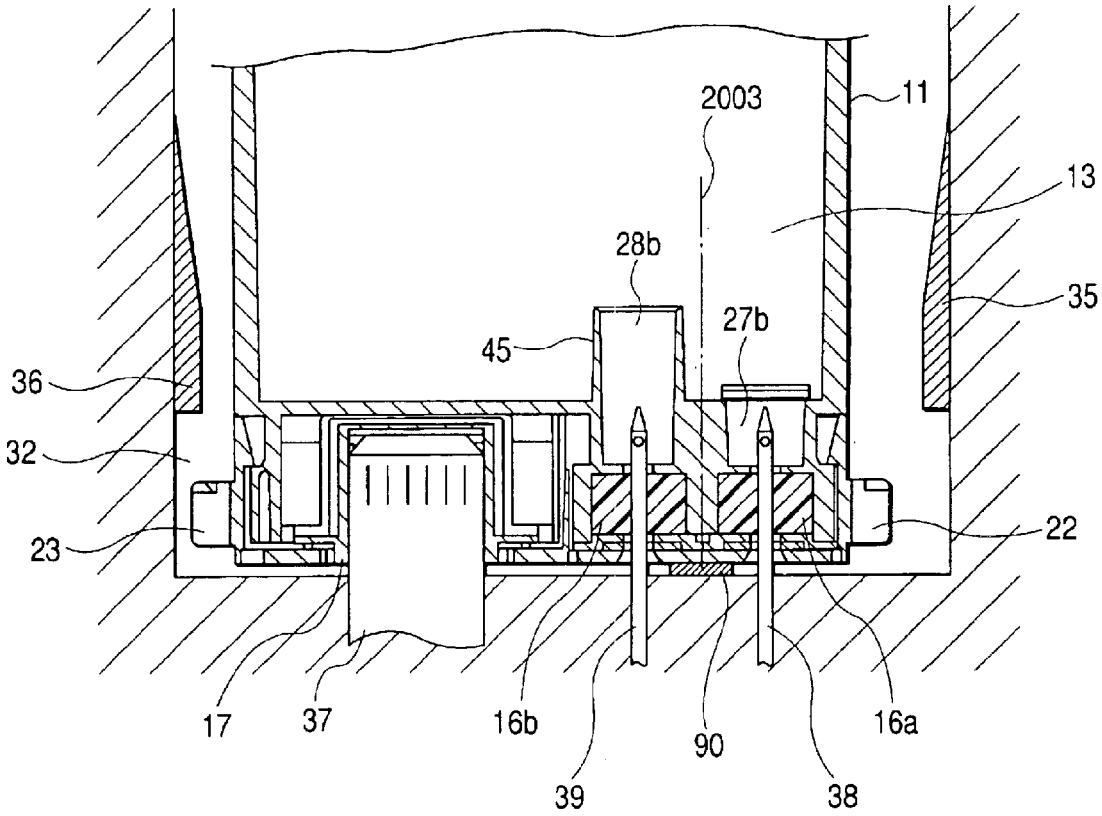
FIGS. 16A and 16B are respectively a cross-sectional view of the liquid container along a line passing through the center of the shorter side of the flat shape and an end view thereof, showing a part of the mounting process of the liquid container in a station base shown in FIG. 9, in a state upon completion of the mounting of the liquid container into the slot.
Figure 16B:
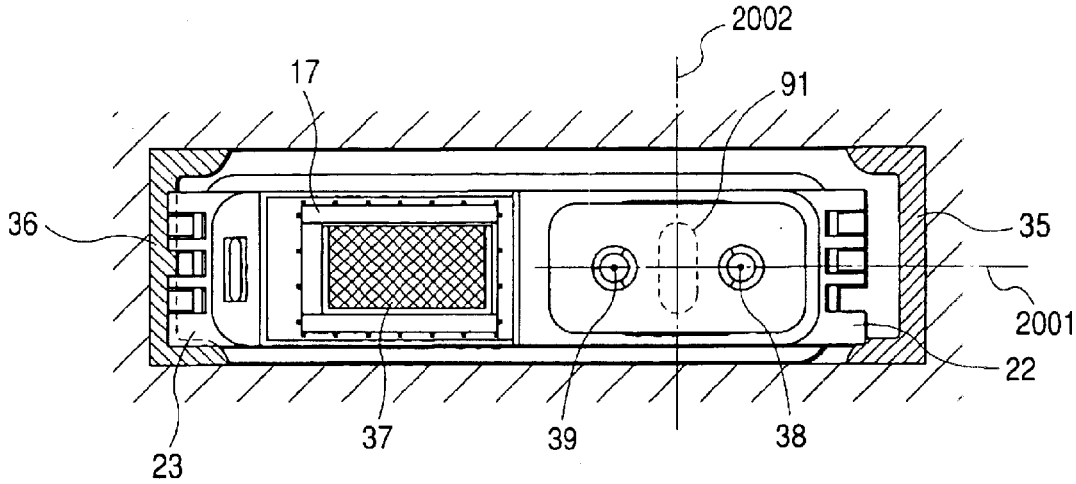

Thereafter, as shown in FIGS. 16A and 16B, the electrical connector 37 completely enters the memory medium holder 17 and the liquid deriving connection needle 38 and the air introducing connection needle 39 substantially simultaneously penetrate the first elastic member 16*a* and the second elastic member 16*b*. Then the bottom face of the liquid container impinges on a Z-direction positioning impingement portion 90 provided on the bottom of the station base, whereby the mounting is completed. Thus the liquid chamber 13 in the liquid container 11 and the external apparatus (for example ink jet recording head) utilizing the liquid in the liquid chamber 13 mutually communicate through the needle holes and the paths in the needles.

For achieving securer positional relationship between the liquid container 11 and the connection needles 38, 39, it is desirable to provide the station base with a lever for pushing down the top face of the liquid container 11 and to form an action point of such lever above the impinging portion between the two connection needles (on a vertical line 2003).

In the following there will be explained the relationship between the positions of the two connection ports on the bottom of the liquid container 11 and the component of the liquid contained in the liquid container 11. In the following there will be explained an ink jet recording apparatus as an example.

The ink employed in ink jet recording is available in dye-based ink and pigment-based ink, and the latter has certain types, such as self dispersion type employing a pigment provided with a hydrophilic radical in order to have affinity to the ink solvent, dispersion type stabilized with a surfactant, and resinous dispersion or microcapsule type employing resin of a low molecular weight.

In any case, pigment-based ink is not a solution but a dispersion. Therefore, in the ink jet recording apparatus of serial scan type in which the recording head is moved in a direction crossing the conveying direction of the recording medium, it is becoming known that the pigment precipitation phenomenon is unnegligible depending on the frequency and internal of use of the ink jet recording apparatus and the print number thereof, particularly in case of so-called out-carriage tank in which the ink tank is statically fixed, through such phenomenon is not so conspicuous in case of so-called on-carriage tank in which the ink tank (liquid container) moves with the ink jet recording head.

Furthermore, in case of the out-carriage tank in which the ink tank is positioned separately from the ink jet head, the ink tank capacity is often made large in order to reduce the frequency of ink replacement even in the user of a high frequency of use, so that the pigment precipitation is unnegligible in certain users.

Since the macroscopic ink composition in the ink chamber is constant except for slight evaporation of the ink solvent, the pigment precipitation phenomenon generates a pigment rich area toward the tank bottom and a pigment poor area in the upper part (though the ink liquid level lowers by the remaining ink in the ink chamber).

However, in a configuration of deriving the ink of the ink chamber from the tank bottom, such ink is derived from the pigment rich area so that there is supplied ink of increased pigment concentration. Also in the course until the ink is depleted in the ink tank, there is sometime derived ink in which the pigment concentration is significantly lower from that in the initial concentration of manufacture.

In case of employing pigment ink for black (Bk) only and employing dye inks for three colors (cyan (C), magenta (M) and yellow (Y)), the black ink is principally used for recording a black character while the blackish image, including gray, in the color image is principally formed by composite black (synthesized from C/M/Y), so that such concentration change did not become conspicuous and did not much affect the liquid discharging performance of the ink jet recording apparatus.

However, as the color image is becoming formed with pigments in all colors for the purposes requiring light fastness and weather resistance such as an outdoor poster, it has become evident that the relationship between the ink deposition amount on the recording sheet such as paper and the image density shifts significantly. Also in an application in which granularity is an important factor, the image formation is being executed with smaller ink droplets in order to reduce granularity, and, in such recording head, it has been made clear that the change in the pigment concentration may affect evidently the liquid droplet discharging characteristics.

In consideration of the foregoing, in the liquid container of the present invention, the first connection port 27*a*, 27*b* and the second connection port 28*a*, 28*b* enabling liquid derivation are positioned, on the bottom of the liquid container 11, close to an end in the longitudinal direction thereof, and the second connection port 28*a*, 28*b* is positioned close to the end in the longitudinal direction of the bottom of the liquid container 11 but closer to the center than the first connection port 27*a*, 27*b*.

Figure 17:
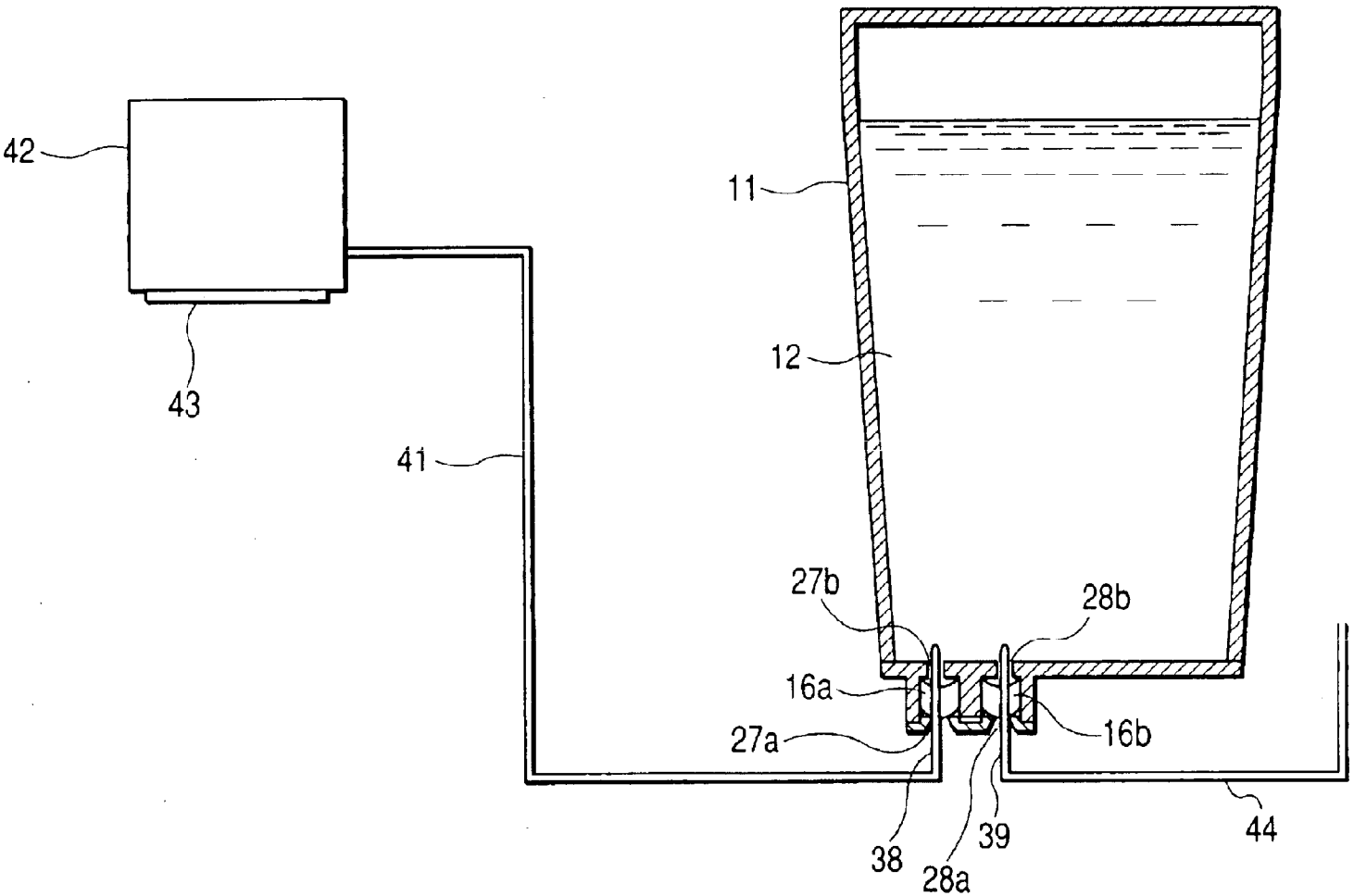
FIG. 17 is a view showing an example of the liquid supply system to an ink jet recording head, in which an embodiment of the liquid container of the present invention is applicable.
Figure 18:
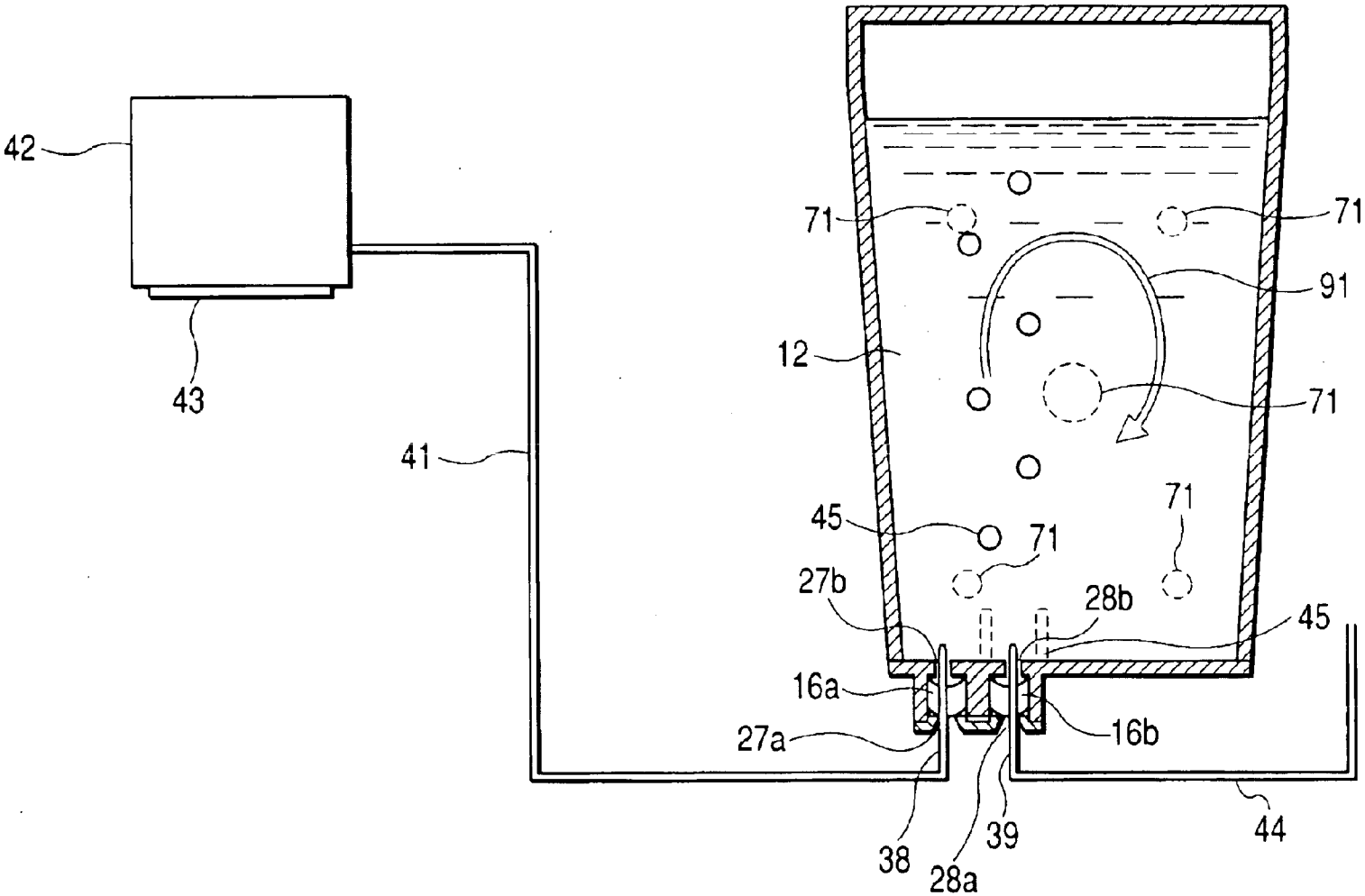
FIG. 18 is a view showing agitation of the contained liquid by a rising bubble flow generated by the introduced air, when the liquid container of the present invention is applied to the liquid supply system shown in FIG. 17.
Figure 19:
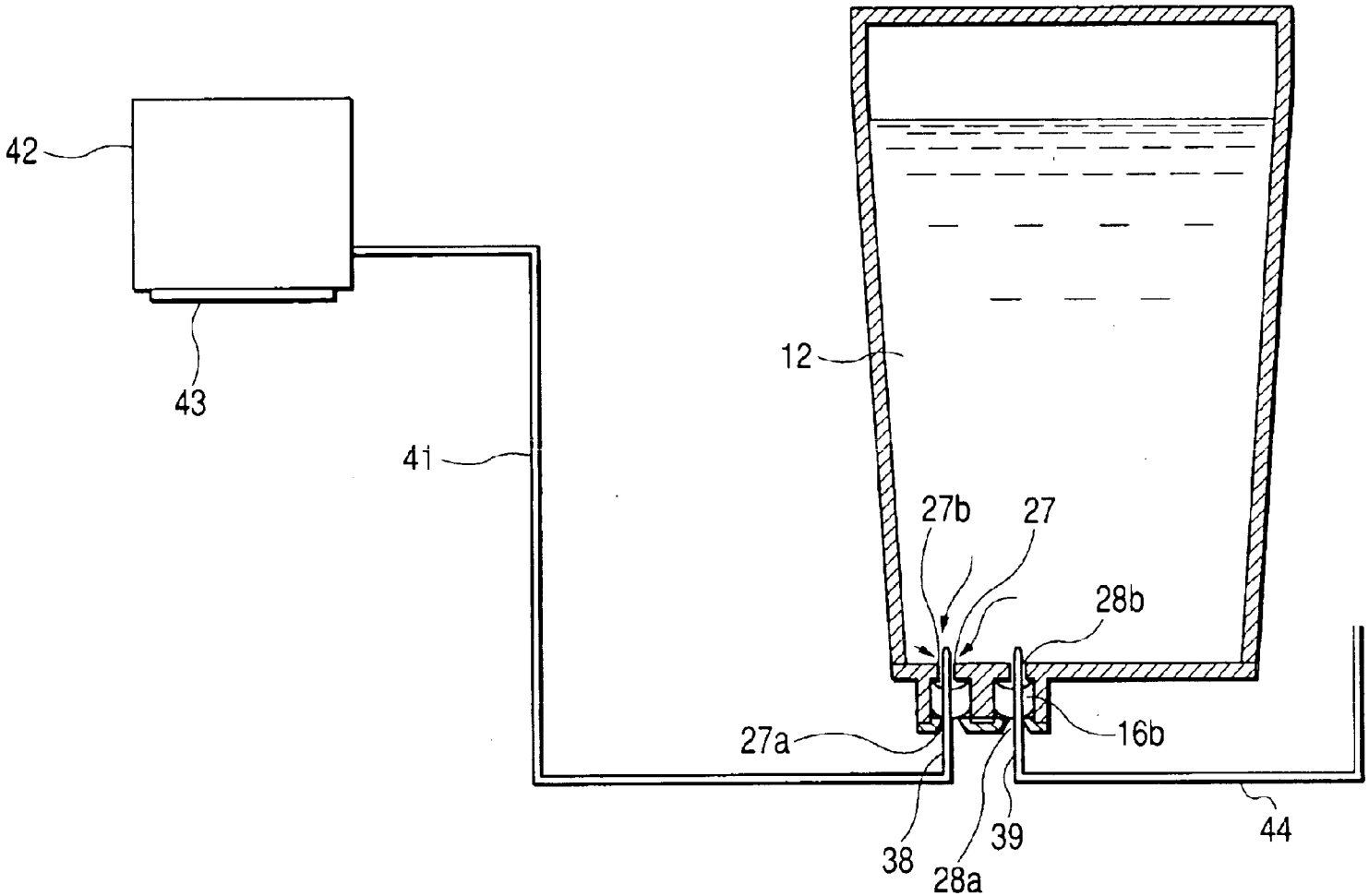
FIG. 19 is a view showing agitation of the contained liquid by ink derivation from the connection port closer to the end of the container bottom, when the liquid container of the present invention is applied to the liquid supply system shown in FIG. 17.

The liquid container 11 having such arrangement of the connection ports provide the following effects when employed in a liquid supply system shown in FIGS. 17 to 19.

In a liquid supply system shown in FIG. 17, the liquid deriving connection needle 38 is inserted through the elastic member 16*a* of the connection port 27*a* closer to the end of the bottom of the liquid container 11 of the aforementioned configuration, while the air introducing connection needle 39 is inserted into the elastic member 16*b* of the connection port 28*b* positioned close to the bottom of the liquid container 11 but closer to the center than the connection port 27*b*, an ink jet head 42 is connected to the liquid deriving connection needle 38 through a liquid supply pipe 41 and an air introducing pipe 44 directed upward at an end is connected at the other end to the air introducing connection needle 39. A face 43 having ink discharge port of the ink jet head 42 is positioned higher than the lowest point of the liquid derivation path from the liquid container 11 to provide the liquid path in the ink jet head 42 with a negative pressure, thereby forming a stable meniscus at the ink discharge port.

In such liquid supply system, along with the ink discharge from the ink jet head 42, the ink in the liquid container 11 is derived to the ink jet head 42 through the liquid deriving connection needle 38 and the liquid supply pipe 41. Since the liquid container 11 is composed of a casing which is not deformed by the derivation of the ink 12 contained therein, air of an amount corresponding to the ink derivation amount is introduced into the liquid container 11 through the air introducing pipe 44, thereby enabling ink supply to the ink jet head under a constant negative pressure. The ink discharge is executed by pushing out the liquid ink the nozzle by thermal or vibration energy of a heat generating element or a vibration element (not shown) provided in the vicinity of a discharge port of a liquid path (nozzle), and the nozzle after discharge is filled again with the ink by the capillary force of the nozzle, so that the ink is from time to time taken in from the liquid container 11.

Such liquid supply system can be realized by the mounting structure for the liquid container, explained in the foregoing with reference to FIGS. 9, 10A, 10B, 11A, 11B, 12A, 12B, 13A, 13B, 14A, 14B, 15A, 15B, 16A and 16B.

In the ink chamber in the liquid container 11 of the present invention, since the connecting portion for liquid derivation and that for air introduction are mutually close, the air introduced into the container forms bubbles to agitate the ink in the vicinity of the ink deriving portion and thereabove, whereby even the ink containing a component which tends to become uneven by the precipitation etc. can be supplied to the exterior in stable manner.

Also since the container is pointed from the ceiling thereof toward the bottom and the bottom is provided at an end area thereof with the connection port 28*b* for the air introducing connection needle 39, at the above-described ink supply, bubbles 45 float in a left-hand area shown in FIG. 18 and the rising bubbles 45 cause a slow clockwise convection in the ink. Such bubble flow and ink convection 91 agitate the ink 12 thus diffusing and homogenizing the pigment. Thus the configuration having the air introducing connection port close to the end of the container bottom hinders the proceeding of the pigment precipitation.

In order to achieve more effective ink agitation, namely diffusion of dispersed pigment, there are preferably provided ribs 71 protruding the internal walls of the ink container and to interfere with the rising bubbles 45 coming out from the air introducing connection needle 39. Such ribs can be relatively simply formed particularly in case of forming the liquid containing portion 14 by blow molding, and are also effective in prevent the container from crushing or inflation under an environmental change.

On the other hand, from the liquid deriving connection port 28*b* provided closer to the bottom end of the liquid container 11 of the present embodiment, there is derived liquid in an amount matching the air introducing amount into the ink chamber, whereby the ink itself flow as shown in FIG. 19 to diffuse and homogenize the pigment.

Particularly since the first connection port 27*b* provided close to the bottom end of the liquid container 11 is immediately surrounded by three wall faces extending toward the ceiling portion of the container, the ink in the vicinity can be easily moved and agitated even under a small ink derivation amount.

Also in the bottom portion inside the liquid container 11, in order to provide the wall effect in a direction lacking the wall close to the first connection port 27*b*, there may be provided a tubular member surrounding the second connection port 28*b*. Thus, in case a tubular portion 45 is provided in the second connection port, there is formed an area enclosed in every direction, including the bottom face but excluding the upper direction. Also in order to enhance such effect, it is also desirable to provide the first connection port in a position lower than the principal internal bottom face of the liquid chamber 14. The configuration of the present invention in which the two connection ports are both deviated provides means for resolving the drawbacks in the prior technology, regardless of the flatness or dimension of the liquid container, liquid level height or ink derivation speed (and corresponding air introducing speed).

In the configuration having the tubular portion 45, since the air rises in vibrating motion upwards from an upper end position 301 of the tubular portion 45, the ink present in a lower area 302 from the position 301 to the internal bottom face is not directly agitated by the air. However the effect of the present invention can also be exhibited even in the presence of the tubular portion 45, since the ink in the area 302 is agitated by an ink flow 303 resulting from the uprising air.

In the following there will be explained another configuration effective for ink agitation in the ink tank.

Figure 20:
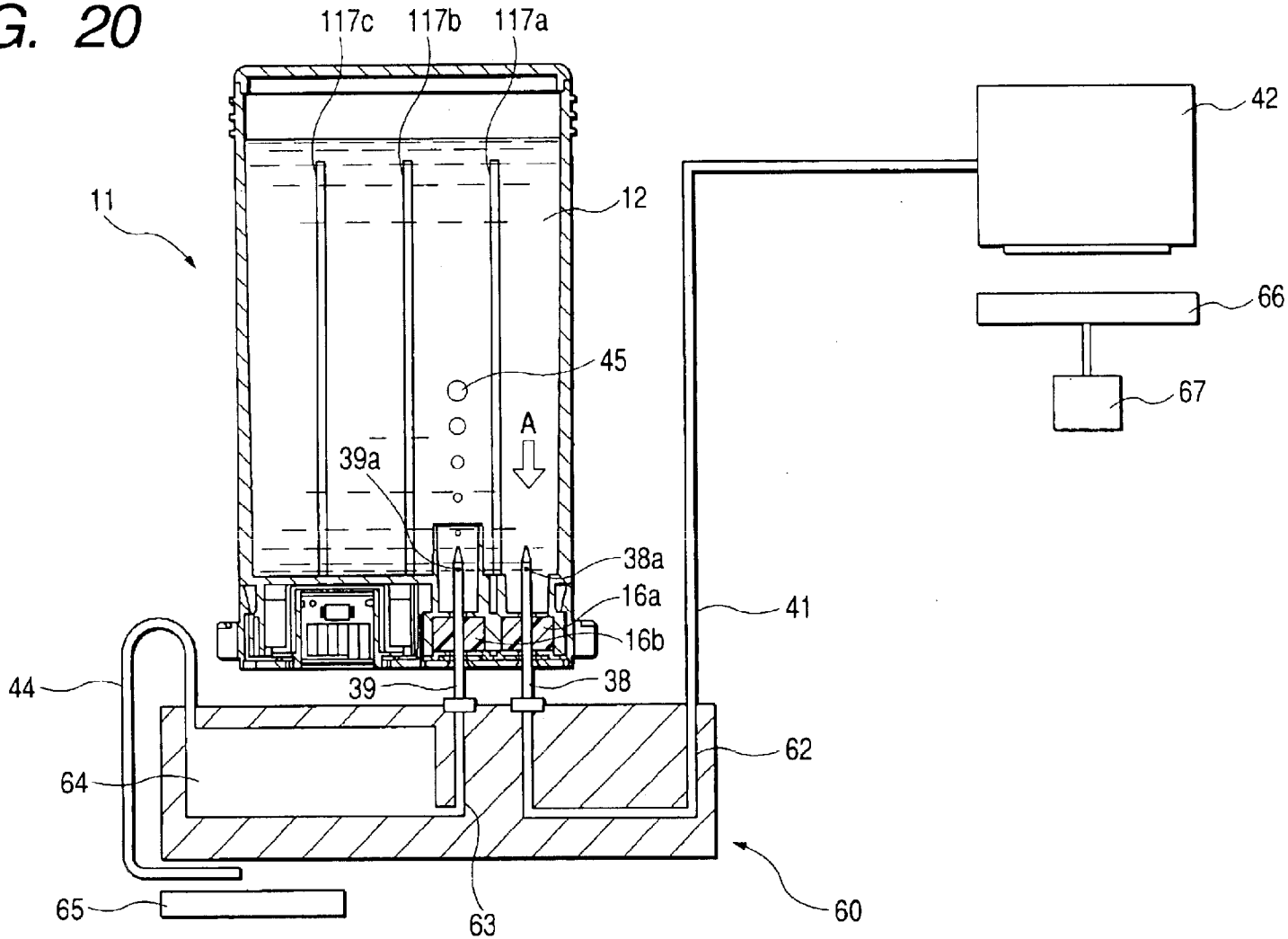
FIG. 20 is a schematic view showing the configuration of an ink supply system of the present invention.

FIG. 20 is a schematic view showing the configuration of an ink supply system constituting an embodiment of the present invention. The ink supply system shown in FIG. 20 serves to supply ink 12 contained in an ink tank unit 11 to an ink jet head 42 through a supply tube 41 constituting a supply unit 60, and is preferably applied to an ink jet recording apparatus.

The ink tank unit 11 is mounted detachably on a supply unit 60, which is provided with an ink supply needle 38 and an air introducing needle 39, with the front ends thereof upward, to be respectively inserted into a first connection port 27*b* formed on the bottom of the ink tank unit 11 and serving to supply the ink 12 in the ink tank unit 11 to the exterior and a second connection port 28*b* for introducing air into the ink tank unit 11.

The ink supply needle 38 is hollow and is provided with a needle hole 38*a* on the lateral face close to the front end. The lower end of the ink supply needle 38 is connected to an end of an ink supply path 62 provided in the supply unit, and the other end of the ink supply path 62 is connected to the ink jet head 42 through the ink supply tube 41.

The air introducing needle 39 is also hollow and is provided with a needle hole 39*a* on the lateral face close to the front end. The lower end of the air introducing needle 39 is connected through an air introducing path 63 to a buffer chamber 64 provided in the main body of the supply unit 60. The buffer chamber 64 constitutes a space for receiving the ink flowing back from the ink tank unit 11 through the air introducing needle 39 in case air in the ink tank unit 11 inflates for example by an environmental change. From the upper end of the buffer chamber 64, there extends a tube 44 opened at the end thereof. Below the end of the tube 44, there is provided an ink absorbent member 65 for absorbing the ink 12 flowing back into the buffer chamber 64 and overflowing therefrom.

The ink jet head 42 is provided with plural nozzles (not shown) opening on a lower face. The ink 12 supplied from the ink tank unit 11 through the ink supply needle 38, ink supply path 62 and ink supply tube 41 fills the nozzles in a state forming a meniscus. In each nozzle there is provided energy generating means (not shown) for providing ink in the nozzle with discharge energy. The energy generating means is driven to provide the ink in the nozzle with energy, thereby discharging from the nozzle. As the energy generating means, there may also be employed an electrothermal converting element such as a heat generating resistor for rapidly heating the ink in the nozzle to induce film boiling therein, thus generating a bubble in the nozzle and discharging ink by the pressure of such bubble generation. In addition, there may also be employed an electromechanical converting member such as a piezo element, an electromagnetic wave-mechanical converting member or an electromagnetic wave-thermal converting member utilizing electromagnetic wave or laser light.

The ink jet head 42 is provided in a position higher than the ink tank unit 11. Thus the interior of the ink jet head 42 has a desired negative pressure state, whereby the ink can be maintained in the nozzle without being attracted into or leaking from the nozzle.

Under the ink jet head 42, there is provided a cap 66 for capping the ink discharge face, having the apertures of the nozzles, of the ink jet head 42 in a non-operated state of the system. The cap 66 is connected to a suction unit 67, which is activated, in a state where the ink discharge face of the ink jet head 42 is covered by the cap 44, to forcedly suck the ink in the nozzle, thereby eliminating abnormal substance or viscosified ink from the nozzle and stably maintaining the discharge characteristics of the ink jet head 30.

The ink tank unit 11 is provided with an ink container for containing the ink 12 and a bottom cover which also serves as a joint in mounting the ink tank unit 11 to the supply unit 60.

The ink unit 11 has a substantially rectangular shape having four lateral walls 11*a* to 11*d*, an upper wall 11*e* and a bottom wall 11*f*, and ink 12 is contained in a liquid chamber composed of these six walls. Among these lateral walls, the mutually opposed two lateral walls 11*b*, 11*d* have the largest area, and the distance therebetween is shortest within the liquid chamber. Thus, in the present embodiment, the liquid chamber has a substantially flat shape. The bottom wall 11*f* is provided with an ink supply port 27*a* and an air introducing port 28*a* arranged in a direction parallel to the largest area lateral walls 11*b*, 11*d*. The ink supply port 27*a* and the air introducing port 28*a* are formed, in the direction parallel to the largest area lateral walls 11*b*, 11*d*, in a position offset from the center of the ink container 11, and the ink supply port 27*a* is in the vicinity of the lateral wall 11*a*.

The ink supply port 27*a* and the air introducing port 28*a* are respectively sealed by seal members 16*a*, 16*b* whereby the interior of the ink chamber is tightly closed. The seal members 16*a*, 16*b* are composed of a material which can be penetrated by a needle but can close the interior of the ink unit 11 when the needle is extracted, such as a rubber stopper.

On the internal face of the ink unit 11, there are provided plural agitation stimulating ribs 117*a* to 117*f*, respectively in three units in mutually opposed positions on the largest area lateral walls 11*b*, 11*d*, extending toward the upper wall 11*e* from the bottom wall 11*f*. Also, among the agitation stimulating ribs 117*a* to 117*f*, at least one (117*a*, 117*d* in the illustrated example) is positioned between the ink supply port 27*a* and the air introducing port 28*a*.

In the following there will be explained the function of the aforementioned ink supply system.

Figure 21:
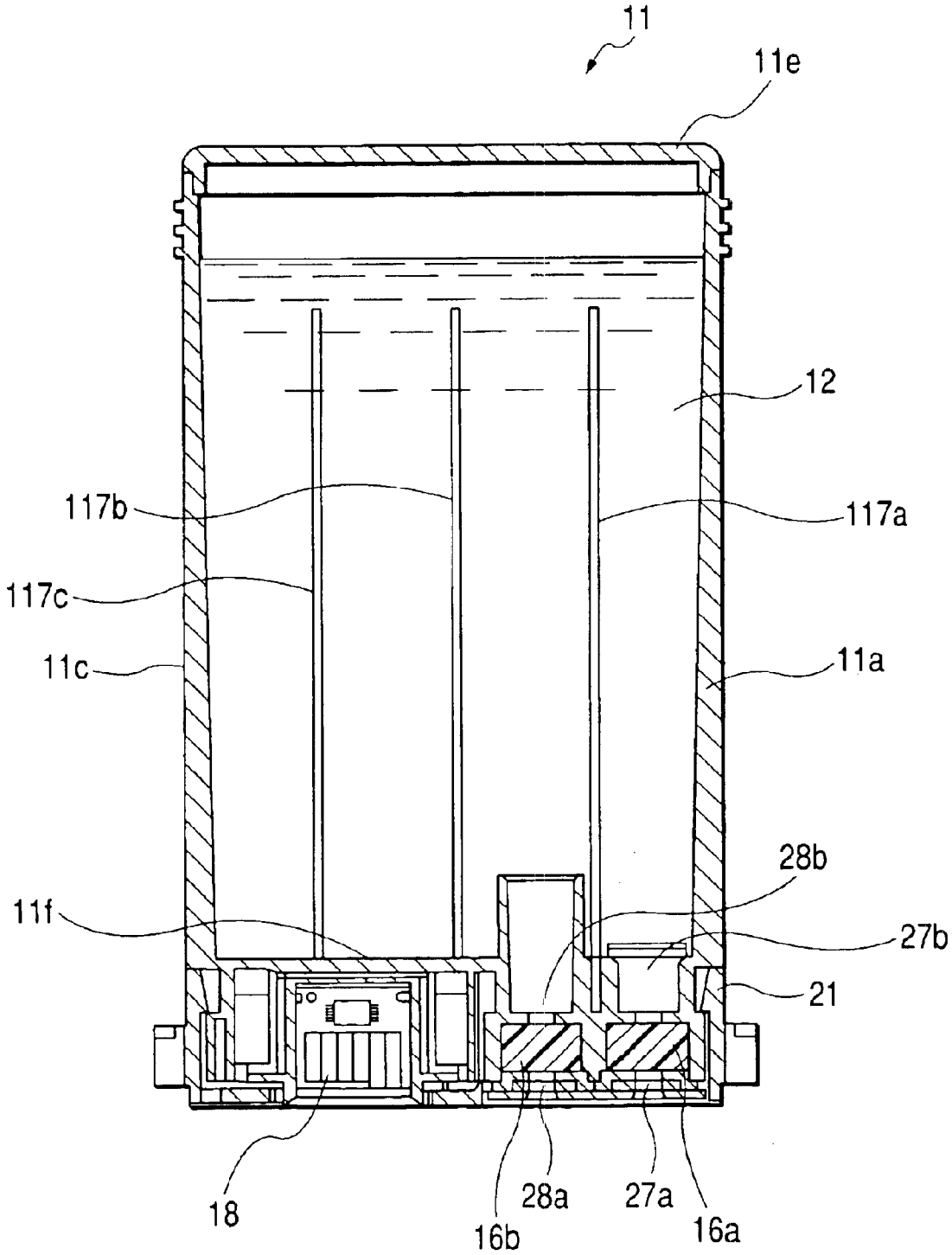
FIG. 21 is a cross-sectional view of an ink tank unit, along a plane parallel to a lateral face of the largest area.

In the state where the ink tank unit 11 is mounted on the supply unit 60, as shown in FIG. 21, the ink supply needle 38 penetrates the seal member 16*a* to position the needle hole 38*a* inside the ink tank unit 11, and the air introducing needle 39 penetrates the seal member 16*b* to position the needle hole 39*a* inside the ink tank unit 11. In the non-operated state of the ink supply system, the ink discharge face of the ink jet head 42 is capped by the cap 66. If the ink tank unit is left standing for a long period in a state mounted on the supply unit 60, the dispersed particles such as pigment in the ink 12 gradually precipitate by the influence of gravity, thereby generating a difference in the ink concentration between the upper and lower parts of the ink unit 11. More specifically the ink concentration becomes higher in the upper part of the ink unit 11 and lower in the lower part thereof.

When the ink supply system is operated in such state, at first there is executed the aforementioned sucking operation of the ink jet head 42, thereby sucking the ink 12 of a predetermined amount from the ink jet head 42 and a matching amount of ink is sucked from the ink unit 11 through the ink supply needle 38, ink supply path 62 and ink supply tube 41. In such operation, since the ink supply needle 38 is positioned at the bottom of the ink unit 11 where the concentration of the ink 12 is higher, the ink unit 11 discharges the ink of higher concentration in the vicinity of the ink supply needle 38. The suction operation of the ink jet head 42 is executed until the ink 12 of such higher concentration is discharged therefrom. Also, the ink suction from the ink unit 11 generates therein an ink flow toward the needle hole 38*a* of the ink supply needle 38 (indicated schematically by a white arrow A in FIG. 20).

On the other hand, the ink suction from the ink unit 11 generates a reduced pressure therein, but, since the interior thereof communicates with the air through the air introducing needle 39, air introducing path 63, buffer chamber 64 and tube 44, air is introduced into the ink unit 11 through the tube 44 etc. so as to maintain a constant pressure in the ink unit 11 and maintaining balance with the atmospheric pressure, along with the suction of the ink 12 from the ink unit 11. The introduced air rises as a bubble 45 in the ink 12. The rising bubble 45 generates an upward ink flow above the air introducing needle 39. Such upward ink flow brings the ink of higher concentration in the bottom portion of the ink unit 11 to the upper area of ink of lower concentration, thereby achieving mixing of the both.

Figure 22:
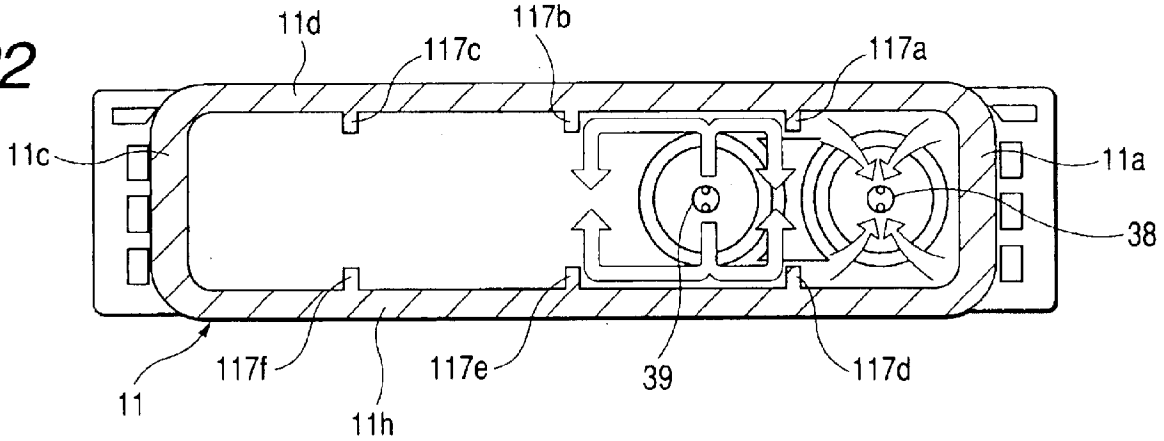
FIG. 22 is a view showing ink flow in the ink container, in the cross section shown in FIG. 21.

Such flow of the ink 12 will be explained in more details with reference to FIG. 22.

As explained in the foregoing, the air introducing needle 39 is provided with two needles holes 39*a*, respectively opposed to the lateral walls lib, 11*d* of the ink unit 11. Therefore, when the bubbles are emitted from the needle holes 39*a*, there are generated ink flows toward the lateral walls 11*b*, 11*d* around the needle holes 39*a*. Since the distance between the lateral walls 11*b*, 11*d* is shortest within the liquid chamber, the ink flows collide with the lateral walls 11*b*, 11*d* and are separated into a flow toward the lateral wall 11*a* at the side of the ink supply needle 38 and a flow toward the lateral wall 11*da* at the opposite side. The ink flows along the lateral walls 11*b*, 11*d* collide with the ribs 117*a*, 117*b*, 117*d*, 117*e* formed thereon, and change direction again.

In this manner, by the air emission from the needle holes 39*a*, the ink around the air introducing needle 39 rises along with the rise of the bubbles, while changing direction by the agitation stimulating ribs 117*a*, 117*b*, 117*d*, 117*e*. As a result, the rising ink flow above the air introducing needle 29 is perturbed to further stimulate the ink agitation in the ink unit 11.

Also the agitation stimulating ribs 117*a*, 117*d* present between the air introducing needle 29 and the ink supply needle 38 also serve that, among the ink flows along the lateral walls 11*b*, 11*d*, that directed toward the ink supply needle 38 does not join the ink flow sucked from the needle hole 38*a* of the ink supply needle 38. This effect prevents the rising ink of higher concentration from gathering in the vicinity of the ink supply needle 38.

The ink agitation is executed in order that, after the suction operation of the ink jet head 42, the ink of higher concentration is not supplied thereto from the ink unit 11. Consequently, in such ink agitation, it is not necessary to agitate the entire ink in the ink unit 11 but enough to agitate adjust the ink concentration in the vicinity of the ink supply needle 38.

In the present embodiment, the ink supply port 27*b* (cf. FIG. 21) is so provided that the ink supply needle 38 is positioned in the vicinity of the lateral wall 11*a* of the ink unit 11, namely in the corner portion, and the ink supply needle 38 is surrounded by walls in three directions. It is rendered possible to efficiently discharge the ink of higher concentration present around the ink supply needle 38, by inserting the ink supply needle 38 in a position surrounded by as many walls as possible. Also by positioning the air introducing port 28*b* (cf. FIG. 21) in such a position that the air introducing needle 29 is inserted in a position adjacent to the ink supply needle 39, the ink derivation from the ink supply needle 38 and the bubble emission from the air introducing needle 39 have more enhanced effects thereby further stimulating the ink agitation.

In the foregoing there has been explained the function of the agitation stimulating ribs 117*a* to 117*f* at the suction operation of the ink jet head 42, but, even after such suction operation, the aforementioned ink derivation from the ink supply needle 38 and the bubble emission from the air introducing needle 39 take place in the ink unit 11 along with the ink consumption in the ink jet head 42. Consequently, the ink in the ink unit 11 is constantly agitated during the ink supply therefrom to the ink jet head 42.

Figure 23:
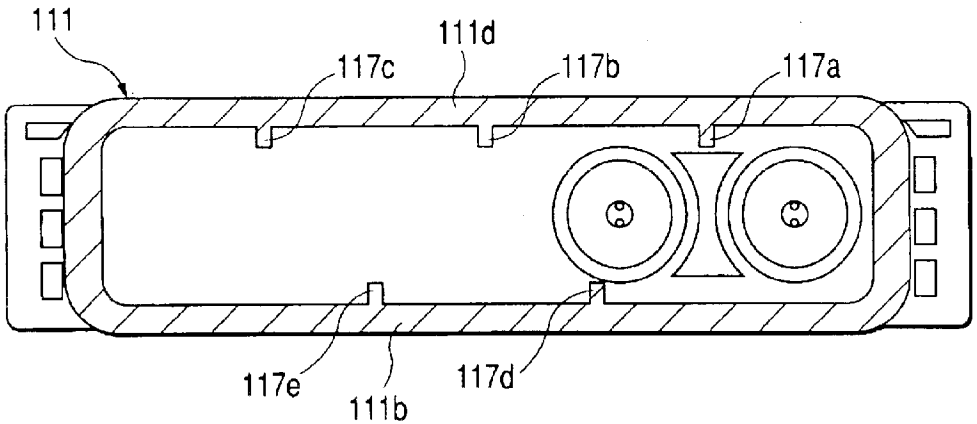
FIG. 23 is a cross-sectional view showing a variation of the arrangement of agitation stimulating ribs.

The needle holes 39*a* of the air introducing needle 39 are opened toward the lateral walls 11*b*, 11*d* in the present embodiment, but the direction of such needle holes is not restricted as long as the direction of the ink flow generated by the bubble emission from the needle holes 39*a* can be changed by the agitation stimulating ribs and may be formed upwards. Also the number of the needle hole 39*a* may be one, three or more as long as the agitation stimulating effect for the ink flow can be attained. Also in the present embodiment there has been shown a structure where the ribs 117*a* to 117*c* on the lateral wall 11*d* and those 117*d* to 117*f* on the lateral wall 11*b* are mutually opposed, but the agitation stimulating ribs need not be mutually opposed on the mutually opposed lateral walls 11*b*, 11*d* but can be arranged in a mutually staggered manner as shown in FIG. 23.

In the following there will be explained certain variations of the position of the needle hole of the air introducing needle and the form of the agitation stimulating ribs.

Figure 24:
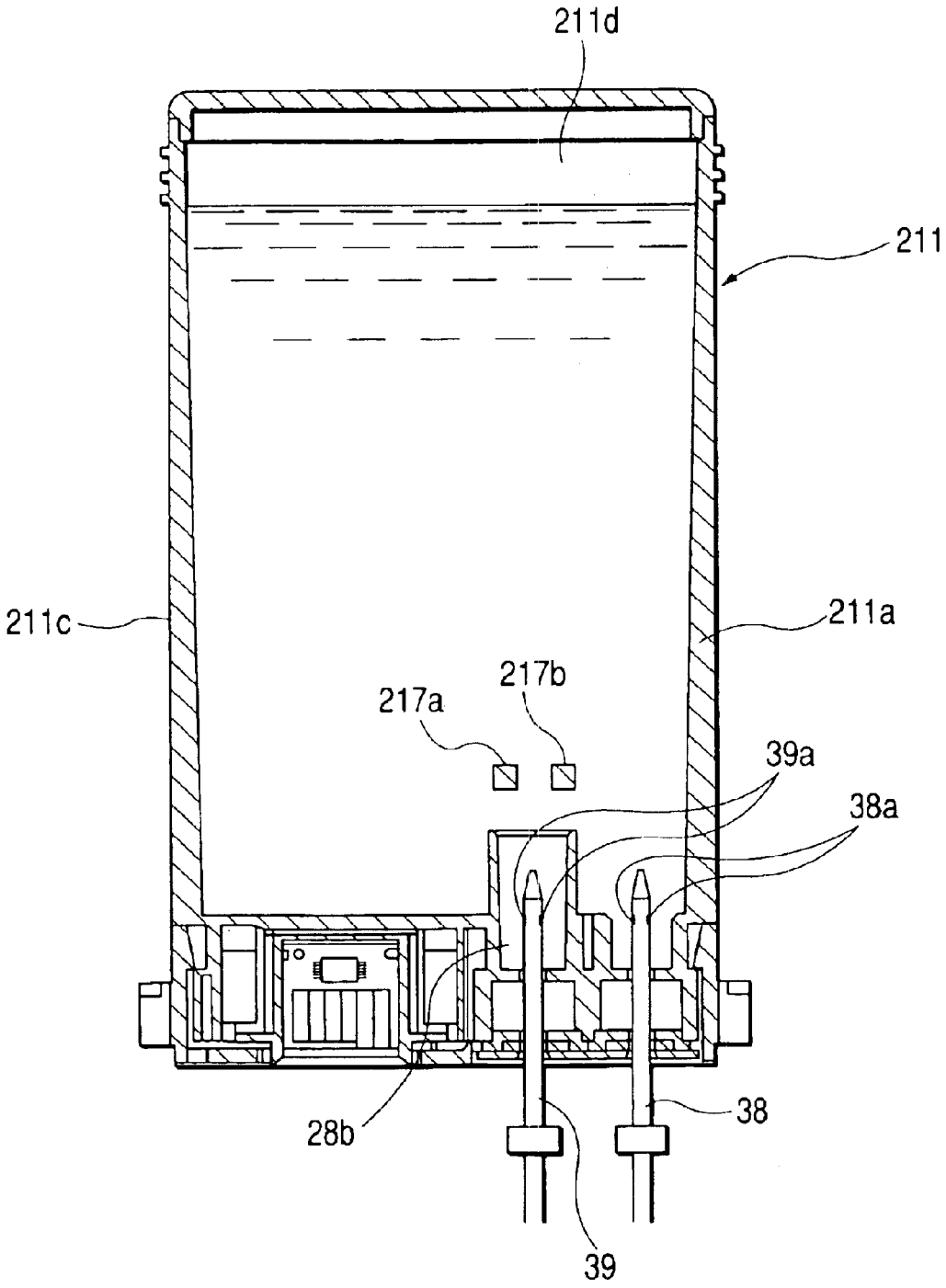
FIG. 24 is a cross-sectional view showing another variation of the arrangement of agitation stimulating ribs.

In an example shown in FIG. 24, the air introducing needle 39 is provided with two needle holes 39*a* toward two lateral walls 211*a*, 211*c* defining the distance of two lateral walls of largest area 211*d* (the other one not shown) in an ink container 211. The ink supply needle 38 is also provided with two holes 38*a*. On the other hand, the ink container 211 is provided, at the bottom side thereof and above the air introducing port 28*b* in which the air introducing needle 39 is inserted, with two agitation stimulating ribs 217*a*, 217*b*, which are pillar-shaped ribs connecting the largest area lateral walls 211*d* (the other one not shown) and are provided in positions collided by the rising ink flow generated by the bubble emission from the two needle holes 39*a* of the air introducing needle 39. Other configurations are similar to those shown in FIG. 20 and will not be explained further.

Figure 25:
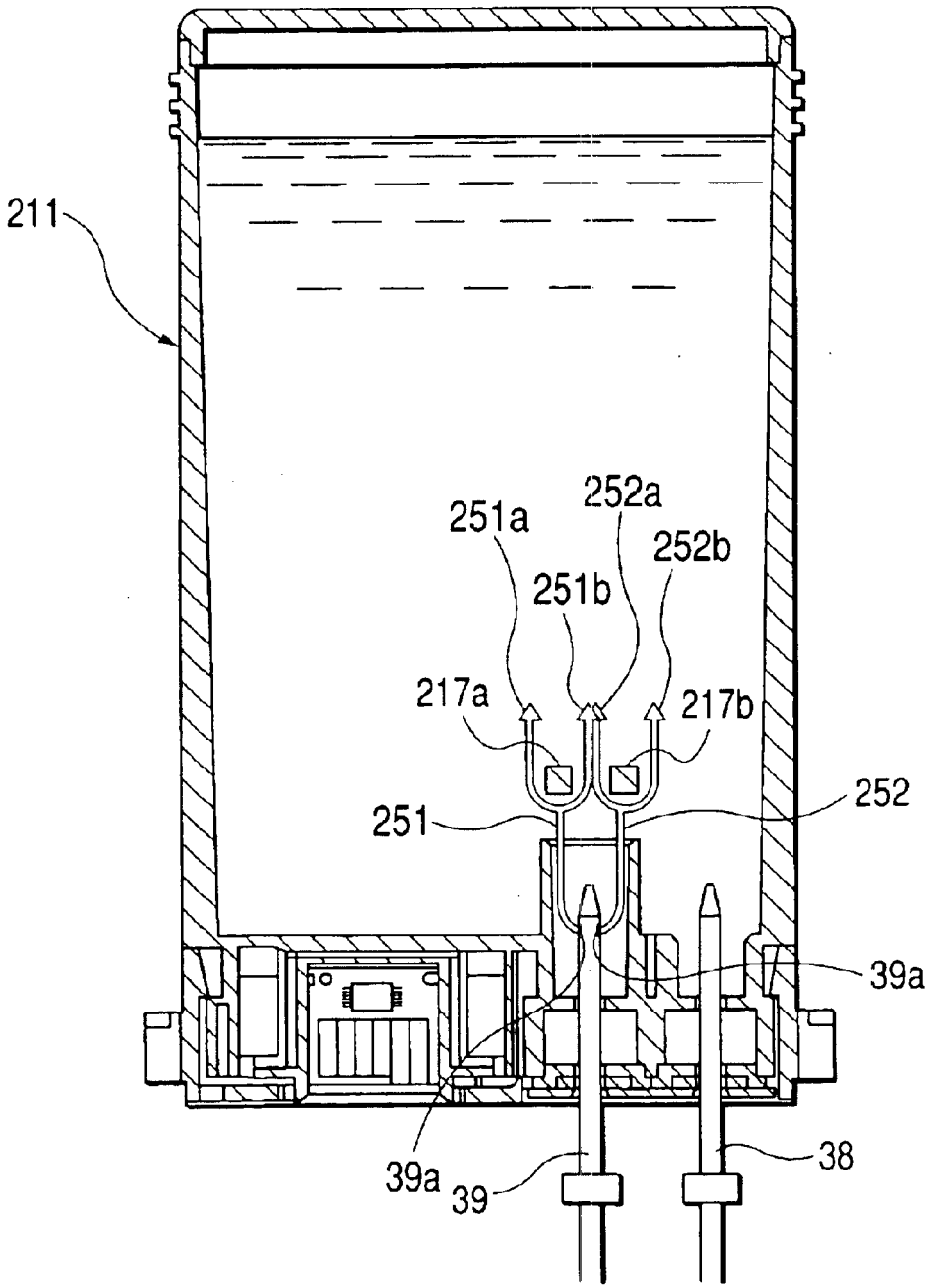
FIG. 25 is a view showing ink flow generated by the agitation stimulating ribs shown in FIG. 24.

In the configuration shown in FIG. 24, in the suction operation of the ink jet head (not shown), the ink in the ink container 211 is sucked through the needle holes 38*a* of the ink supply needle 38 and air is introduced through the air introducing needle 39 into the ink container 211 and is emitted as bubbles from the needle holes 39*a* of the air introducing needle 39. The bubble emitted from the two needle holes 39*a* respectively generates two rising ink flows 251, 252 from the needle holes 39*a* of the air introducing needle 39, as shown in FIG. 25. The ink flows 251, 252 collide with the agitation stimulating ribs 217*a*, 217*b* thus being perturbed to generate further rising perturbed ink flows 251*a*, 251*b*, 252*a*, 252*b*. As a result, the ink flow influences a wider area, thus effectively agitating the ink in such area.

Figure 26:
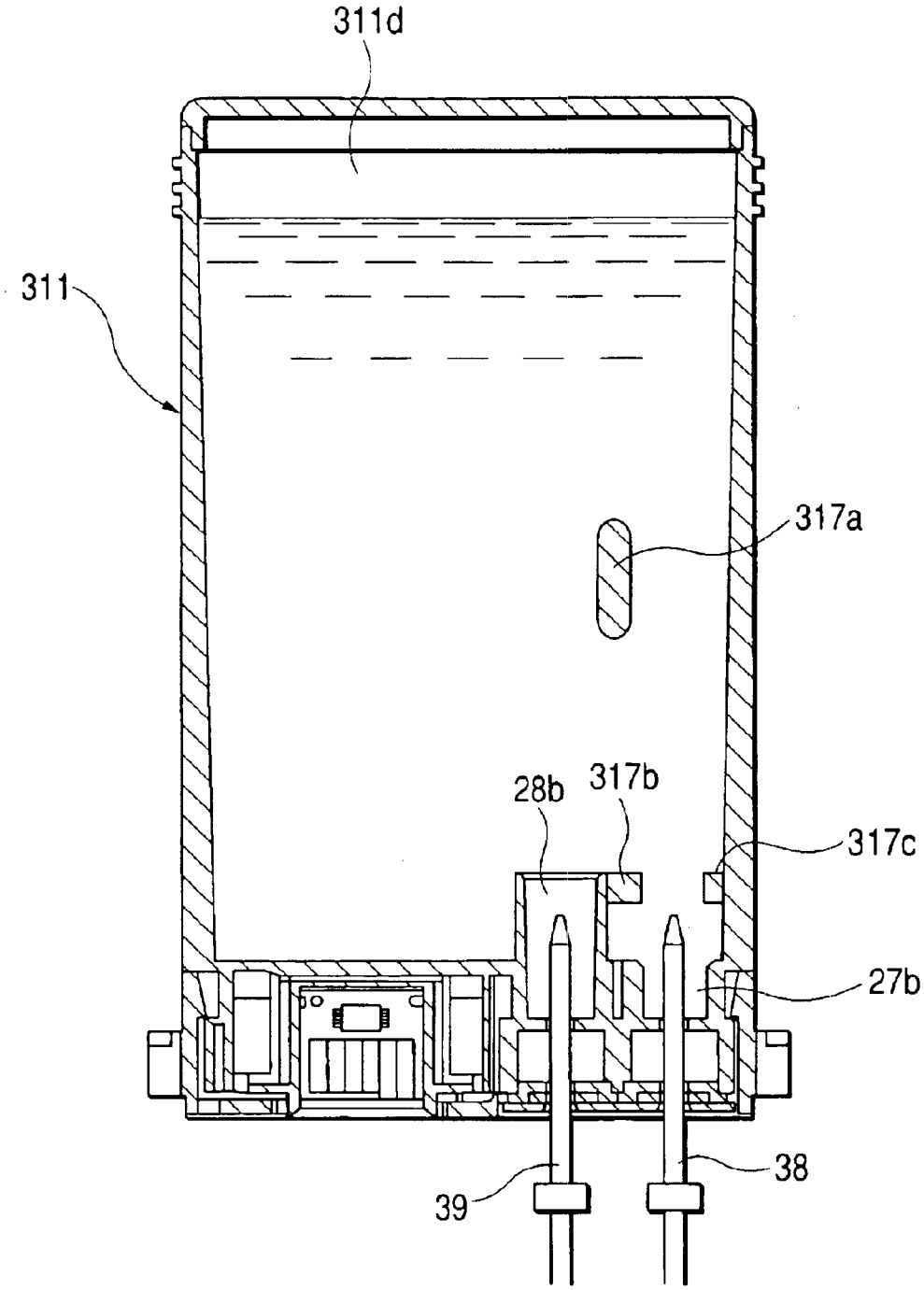
FIG. 26 is a cross-sectional view showing another variation of the agitation stimulating ribs.

In an example shown in FIG. 26, the ink container 311 is provided with three agitation stimulating ribs 317*a* to 317*c*, in which the agitation stimulating rib 317*a* is provided in a middle area in the vertical direction of the ink container 311 and between the ink supply port 27*b* and the air introducing port 28*b*. Other ribs 317*b*, 317*c* are positioned at the bottom side of the ink container 311 and above the ink supply port 27*b*. The agitation stimulating ribs 317*a* to 317*c* are formed, as in those shown in FIG. 24, as pillar-shaped ribs connecting the two largest area lateral walls 311*d* (the other being not shown) of the ink container 311.

Figure 27:
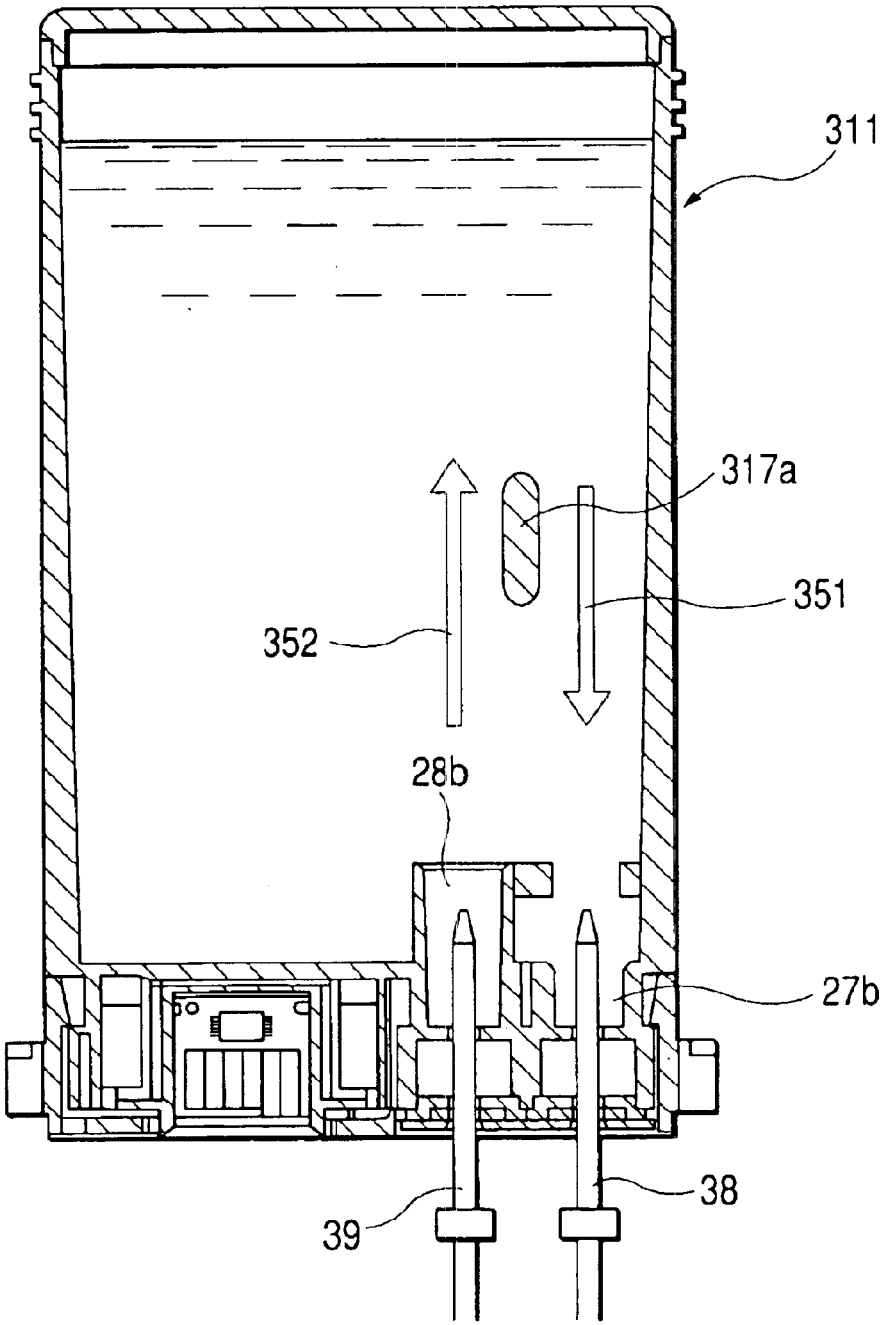
FIG. 27 is a view showing ink flow generated by the agitation stimulating ribs shown in FIG. 26.

In the configuration shown in FIG. 26, in the suction operation of the ink jet head (not shown), there is generated an ink flow as shown in FIG. 27. More specifically, in the ink container 311, there are generated an ink flow 351 toward the ink supply needle 38 by ink derivation therefrom and an upward ink flow 352 from the air introducing needle 39 by the bubble emission from the air introducing needle 39.

Figure 28:
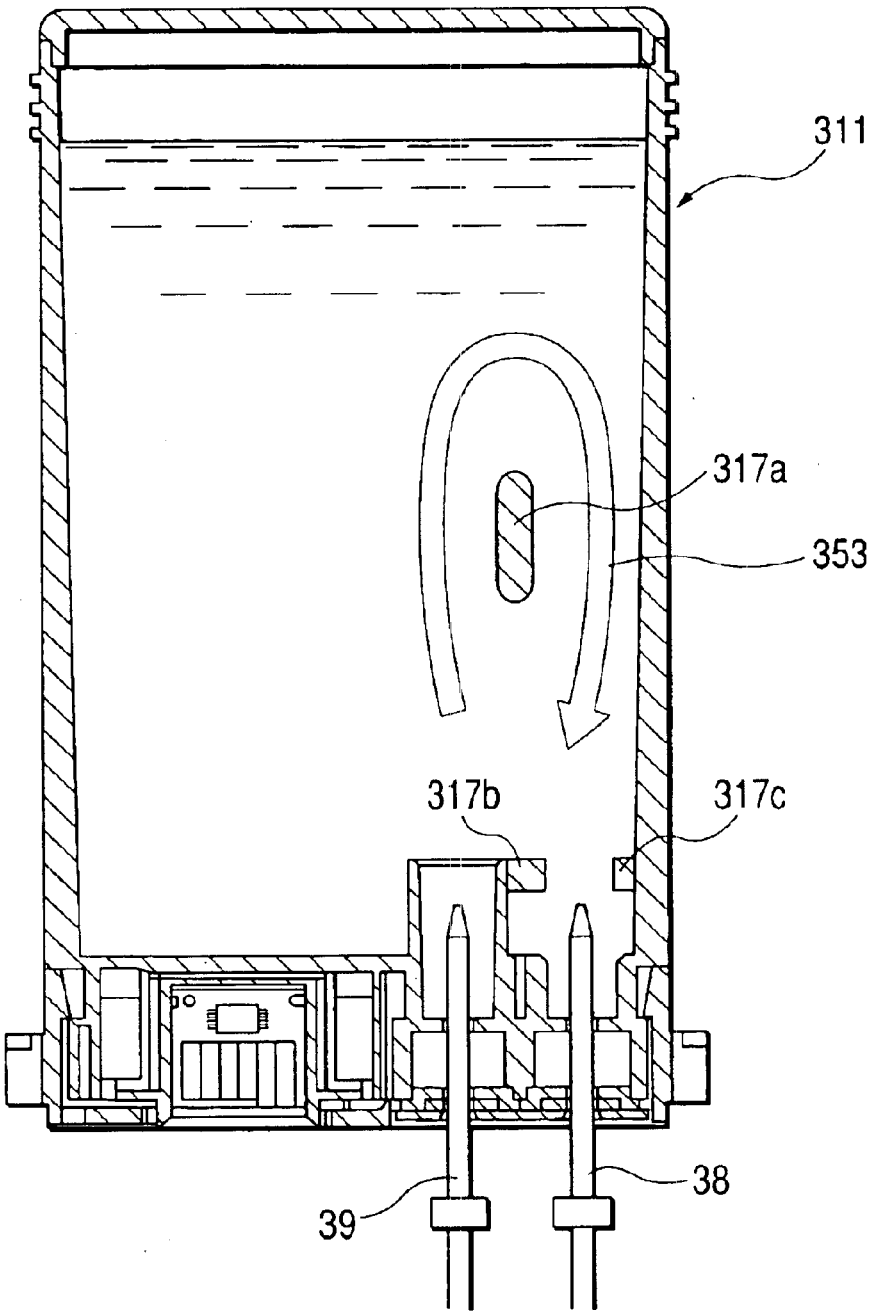
FIG. 28 is a view showing ink circulating flow generated by the agitation stimulating ribs shown in FIG. 26.

Since the agitation stimulating rib 317 is positioned between the ink supply port 316*a* and the air introducing port 28*b*, the two ink flows 351, 352 are rectified in such a manner that the ink flow 351 toward the ink supply needle 38 is present at a side of the agitation stimulating rib 317*a* and the upward ink flow 352 from the air introducing needle 39 is present at the other side. The ink flows 351, 352 eventually forms, as shown in FIG. 28, a circulating flow rising from the air introducing needle 39, then trespassing the agitation stimulating rib 317*a* and descending toward the ink supply needle 38. Such circulating flow 353 effectively replaces the ink of higher concentration in the bottom side of the ink container 311 and the ink of lower concentration in the upper part thereof.

As the agitation stimulating rib 317*a* is positioned in the middle portion of the ink container 311, the bubble emission from the air introducing needle 39 also generates, under the agitation stimulating rib 317*a*, an ink flow in the lateral direction, through limited in amount. Such ink flow, if united with the ink flow toward the ink supply needle 38, hinders the sufficient ink agitating effect since the ink of higher concentration is sucked from the ink supply needle 38. Therefore, the agitation stimulating ribs 317*b*, 317*c* are provided in the vicinity of the ink supply needle 38 for preventing the ink of higher concentration from gathering in the vicinity of the ink supply needle 38.

Figure 29:
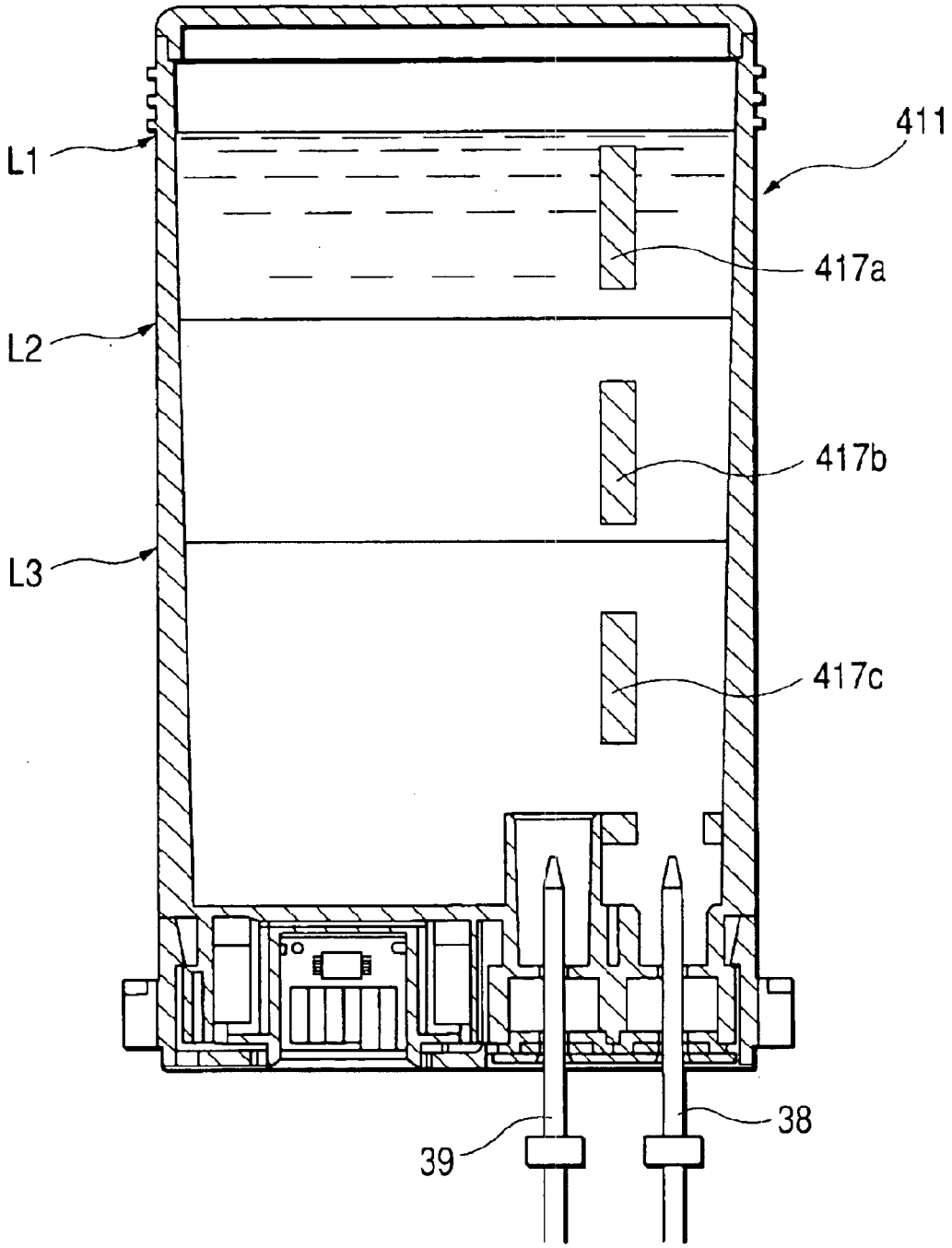
FIG. 29 is a cross-sectional view showing still another variation of the agitation stimulating ribs.

The agitation stimulating rib 317*a*, having the aforementioned ink flow rectifying effect, is not limited in the number thereof or in the vertical position in the ink container 311, and, as shown in FIG. 29, there may be provided plural agitation stimulating ribs 417*a* to 317*c* with gaps therebetween in the vertical direction of the ink container 411. By the ink supply from the ink container 411 to the exterior, the ink level therein varies from L1 to L2 and then to L3. The presence of the plural agitation stimulating ribs 317*a* to 317*c* securely generates a circulating flow as shown in FIG. 28 even when the ink liquid level reaches a position L1 or L2, thereby obtaining sufficient ink agitation stimulating effect even when the ink in the ink container 411 is decreased.

Figure 30:
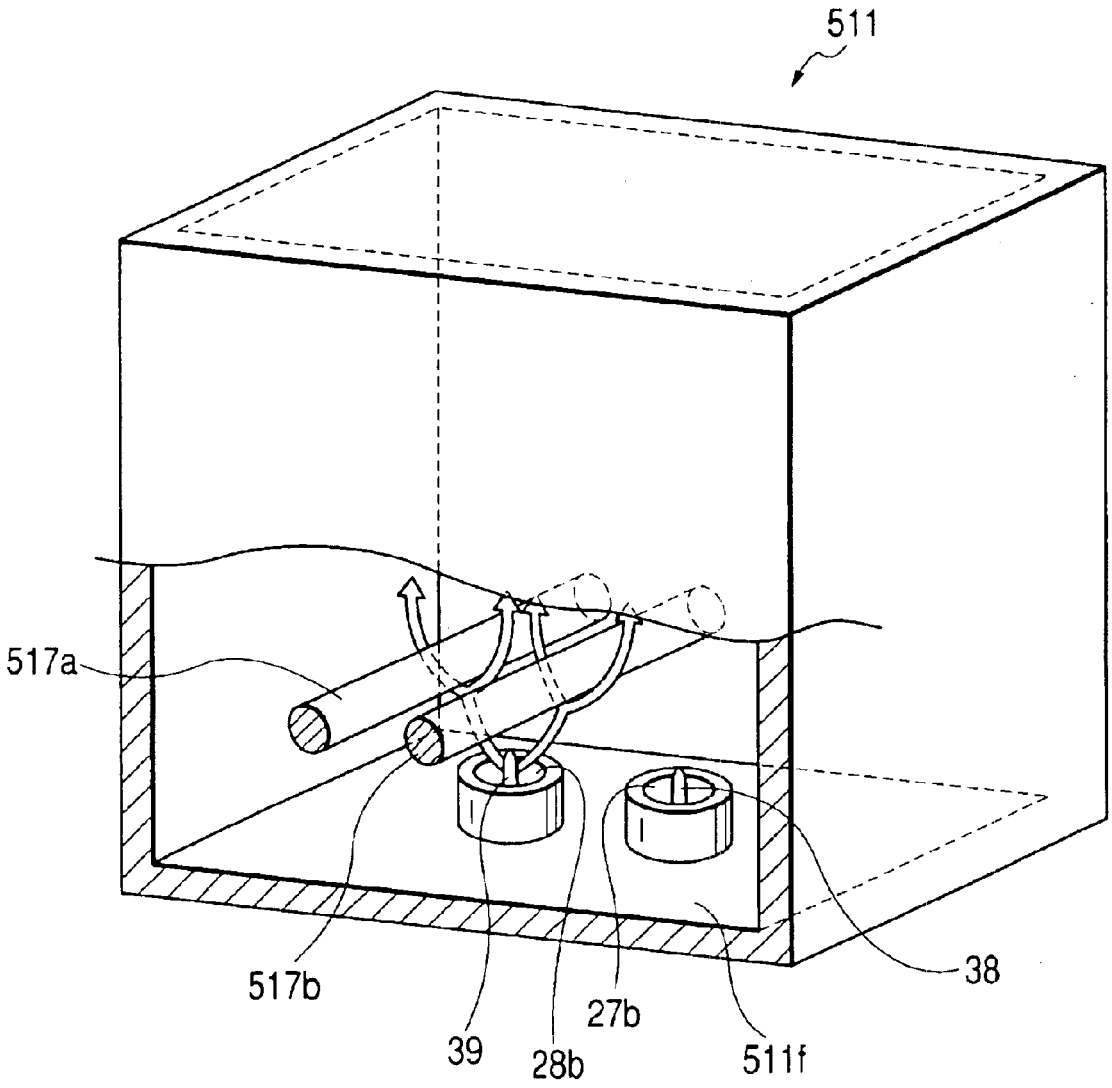
FIG. 30 is a partially cut-off perspective view of the ink container, showing an example of agitation stimulating ribs in a cubic ink container.

FIG. 30 shows, different from the ink containers explained in the foregoing, an example of a substantially cubic ink container 511. Also the ink supply port 27*b* and the air introducing port 28*b* are positioned in an approximately central area of a bottom wall 511*f* of the ink container 511. In such configuration, it is difficult to achieve ink agitation utilizing the lateral walls of the ink container 511, as explained in FIG. 22. In the present embodiment, as in the configuration shown in FIG. 24, agitation stimulating ribs 517*a*, 517*b* are provided in a position above the air introducing port 28*b* and to be collided by the rising ink flow generated by the bubble emission from the needle hole (not shown) of the air introducing needle 39 inserted into the ink container 511 through the air introducing port 28*b*. Thus, even in the ink container 511 of cubic shape, the ink therein can be effectively agitated as in the example shown in FIG. 24.

Figure 31:
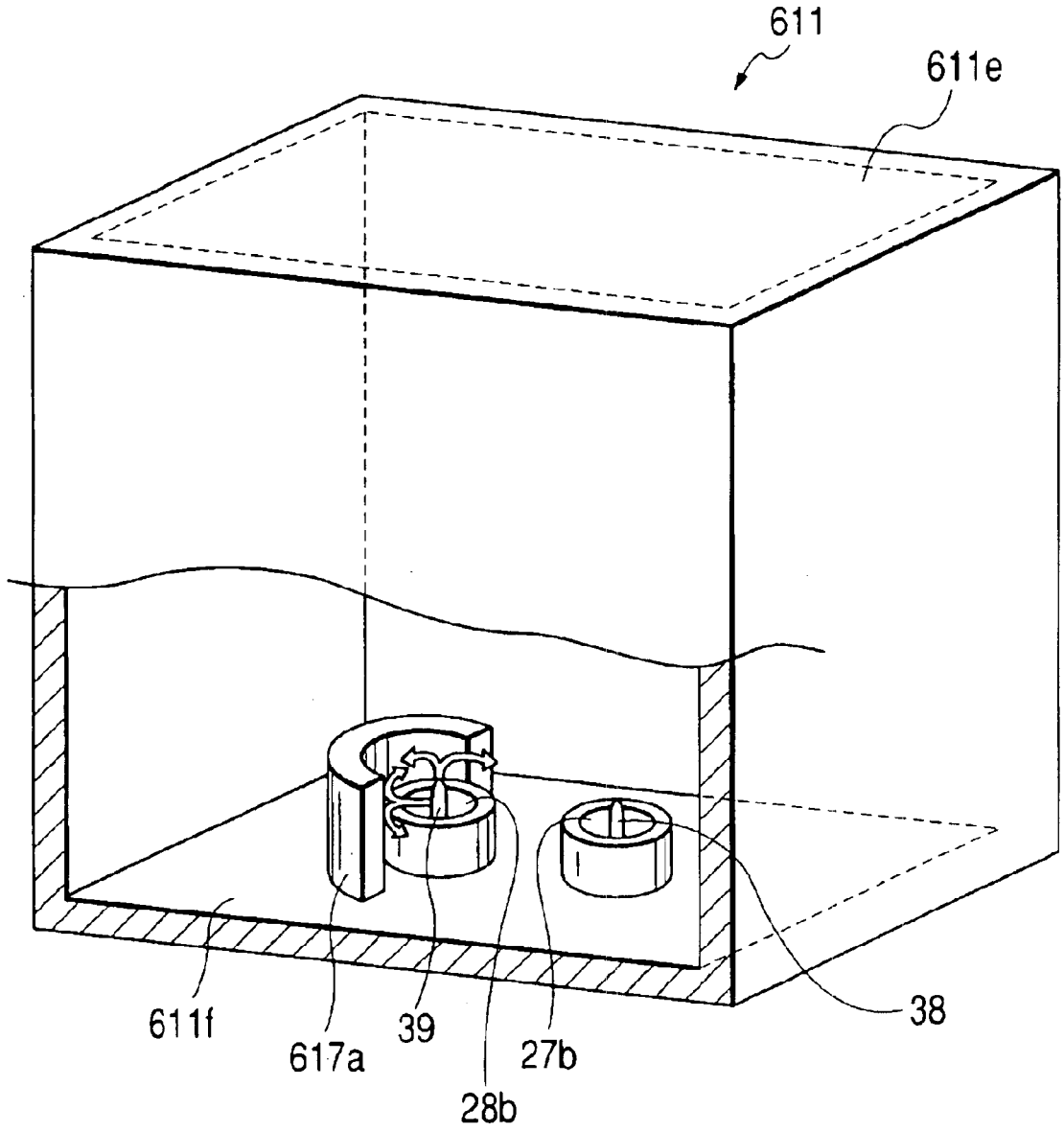
FIG. 31 is a partially cut-off perspective view of the ink container, showing another example of the agitation stimulating ribs in a cubic ink container.
Figure 32A:
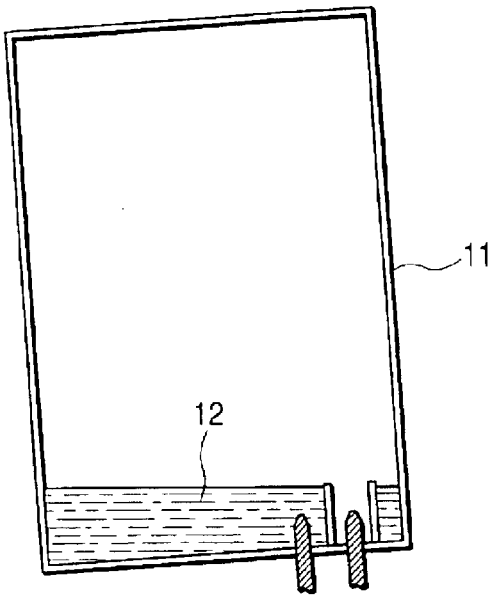
FIGS. 32A, 32B, 32C and 32D are views showing another effect in the positional definition of a tubular member.
Figure 32B:
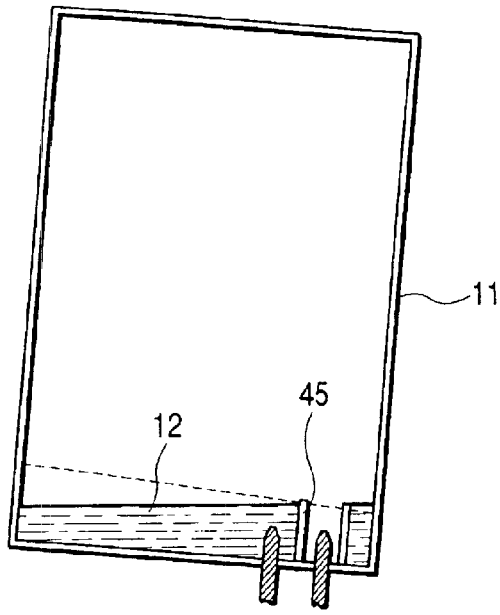
Figure 32C:
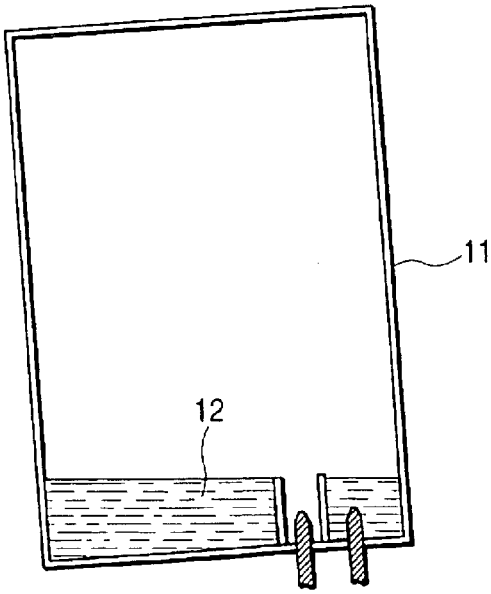
Figure 32D:
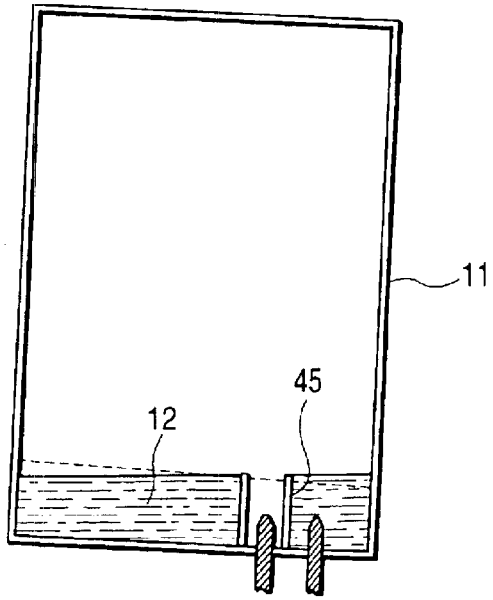

FIG. 31 shows, as in the example shown in FIG. 30, a substantially cubic ink container 611 in which the ink supply port 27*b* and the air introducing port 28*b* are positioned in an approximately central area of a bottom wall 611*f* and which is difficult to achieve ink agitation utilizing the lateral walls of the ink container 511. In such a structure, the present embodiment stimulates ink agitation by a configuration different from that shown in FIG. 30. In the present embodiment, a wall-shaped agitation stimulating rib 617*a* is provided extending from the bottom wall 611*f* of the ink container 611, in the vicinity of the air introducing port 28*b* and in a position to be collided by the ink flow generated by the bubble emission from the air introducing needle 39 inserted into the ink container 611 through the air introducing port 28*b*.

The collision of the ink flow toward the agitation stimulating rib 617*a* therewith changes the direction of the ink flow, thus perturbing the ink flow. Thus, even in the ink container 611 of cubic shape, the ink therein can be effectively agitated.

In case the air introducing needle 39 is provided with plural needle holes, the agitation stimulating rib 617*a* is preferably formed in an arc shape when seen from above, as shown in FIG. 31. Thus the ink flows generated by the bubble emission from the needle holes and flowing toward the agitation stimulating rib 617*a* collide with and flow along the agitation stimulating rib 617*a*, thus colliding each other and generating larger perturbation of the ink flow, whereby the ink agitation is further stimulated.

In the foregoing, there have been explained examples of the ink container provided internally with agitation stimulating ribs. The ink container is preferably formed by a plastic material, which is not particularly limited as long as the properties of the contained ink are not affected even under a prolonged storage. Also it can be formed by various plastic molding methods such as injection molding or blow molding. In case of injection molding, the ink container can be formed, for example, by molding the main body of the container and the cover thereof separately and then adhering these parts. The blow molding is often employed for forming containers and is also preferable for forming the liquid container of the present invention. In the blow molding, however, since the thickness becomes almost equal in various portions, the agitation stimulating rib appears as a recess on the external surface of the ink container.

In the present invention, as explained in the foregoing, the liquid container having the liquid supply portion and the air introducing portion in the bottom is provided with a liquid agitating structure for agitating the liquid flow generated in the liquid chamber by the air introduction thereinto from the air introducing portion, whereby the liquid in the liquid chamber can be effectively agitated by a simple operation of liquid supply from the liquid supply portion to the exterior, even in case the liquid shows a difference in the concentration between the upper and lower parts by a prolonged standing of the liquid container. After such operation, the liquid having a stable concentration by the agitation can be supplied to the exterior. Particularly the ink jet recording apparatus of the present invention can utilize the ink of stabilized concentration for image recording, thereby capable of forming an image of high quality even after a prolonged pause. The liquid agitating structure can be formed by a rib protruding from the internal wall of the liquid chamber and is therefore is quite simple.

As a reference, there will be explained reference examples of the configuration incapable of exhibiting the effect of the present invention, with reference to FIGS. 35A to 35D. A configuration shown in FIG. 35A cannot exhibit sufficient function in executing ink supply under strong agitation in the immediate vicinity of the ink deriving area, since the ink deriving port 29 and the air introducing port 30 are separated. Also a configuration shown in FIG. 35B can exhibit the aforementioned function because the two connection ports are mutually close, but the bubble flow rising from the center of the bottom divides the convection as indicated by 93, 94 whereby an ink flow capable of sufficient agitation may not be induced. Also a configuration shown in FIG. 35C have two connection ports both positioned close to the end respectively achieving a function of the present invention, but cannot exhibit sufficient function in executing ink supply under strong agitation in the immediate vicinity of the ink deriving area, as in the case of FIG. 35A. Also a configuration shown in FIG. 35D having the air introducing port 28 at the center and the ink deriving port at the end generates divided convection flows 96, 97 as in the case of FIG. 35B, but may not be able to generate an ink flow for sufficient agitation for the ink deriving port 29 positioned at the end.

However, even in such arrangements of the ink deriving port 29 and the air introducing port 28, there can be expected an improvement by forming an agitation stimulating structure such as a rib.

Naturally, as explained in the foregoing, there is preferred the arrangement of the ink deriving port and the air introducing port deviated to the end with respect to the ink tank because of the expected agitation effect, and there is further preferred a configuration in which the agitation stimulating structure is additionally provided. Also, as explained in the foregoing, the presence of the agitation stimulating structure relaxes the limitation on the arrangement of the ink deriving port and the air introducing port.

In the following there will be given an explanation on the tubular member.

Referring to FIGS. 7, 16A and 16B, a funnel-shaped tubular member 45 extends vertically so as to surround the entire periphery of the second connection port 28 for air introduction. In a state where the liquid container is mounted in the slot 32, the needle hole of the air introducing connection needle 39 penetrating the second connection port 28 opens in a position lower than the upper end of the tubular portion 45. Also in the liquid supply system to the ink jet head shown in FIGS. 17 to 19, this needle hole is positioned lower than the ink discharge face of the ink jet head 42.

The air introduced from the needle hole of the air introducing connection needle 39 forms discontinuous bubbles because the ink meniscus formed at the needle hole repeats destruction and formation, and a sufficient clearance is formed between the external periphery of the needle 39 and the internal periphery of the tubular portion 45 in order to achieve prompt rising of the bubbles without staying inside the tubular portion 45. Also, as the lateral face of the tubular portion 45 functions as a wall to the first connection port 27, the bubbles from the second connection port 28 cannot easily move to the first connection port 27 and cannot be derived therefrom.

The upper end of the tubular portion 45 is rounded in order to promptly separate the ink inside and outside the tubular portion 45 when the liquid level is lowered from a position slightly above the upper end of the tubular portion 45. It is thus rendered possible to judge whether the remaining ink amount is over or under a threshold value, by forming the connection needles 38, 39 with a conductive material and utilizing the electroconductivity of the ionic component in the ink. More specifically, the ink container can be so formed that the ink amount remaining in the liquid chamber 13 is 10% or larger of the initial amount when the ink 12 in the liquid container 11 covers the upper end of the tubular portion 45 to enable electric conduction between the connection needle 39 inside the tubular portion 45 and the connection needle 38 outside the tubular portion 45 but the remaining ink amount is 10% or less when such electric conduction is lost. Also the tubular portion 45 serves as an agitation stimulating structure for eliminating the precipitation in the pigment ink as explained in the foregoing.

As explained in the foregoing, it is preferable to position the two connection ports in mutual proximity and in an end portion of the flat bottom and more preferable to position the ink deriving connection port closer to the end and the air introducing connection port slightly closer to the center. In the following there will be explained, with reference to FIGS. 32A to 32D, another effect in case the air introducing connection port closer to the center.

Figure 35A:
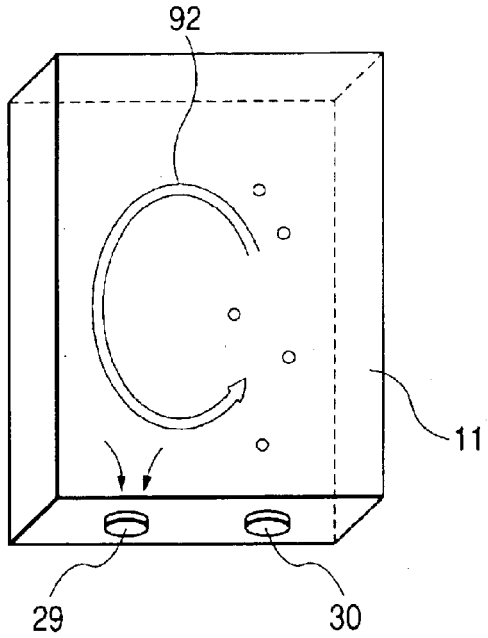
FIGS. 35A, 35B, 35C and 35D are views showing comparison with embodiments of the present invention.
Figure 35B:
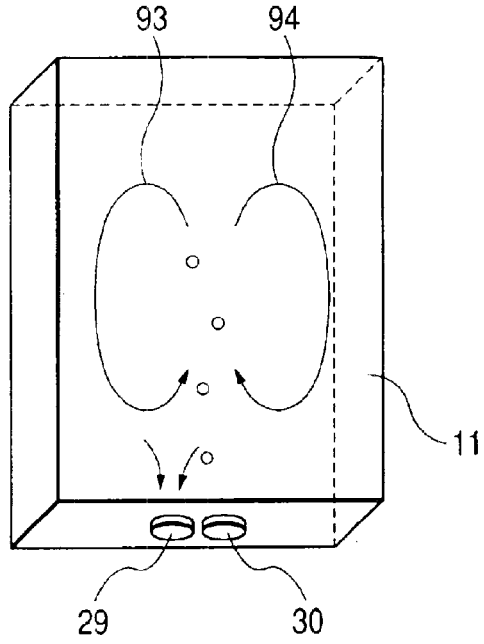
Figure 35C:
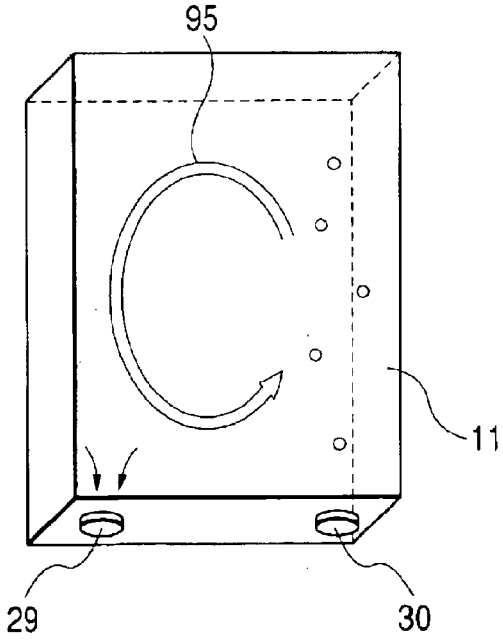
Figure 35D:
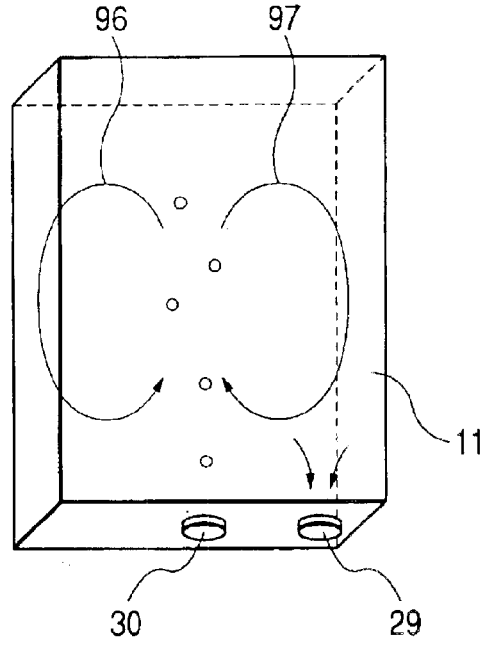
Figure 36:
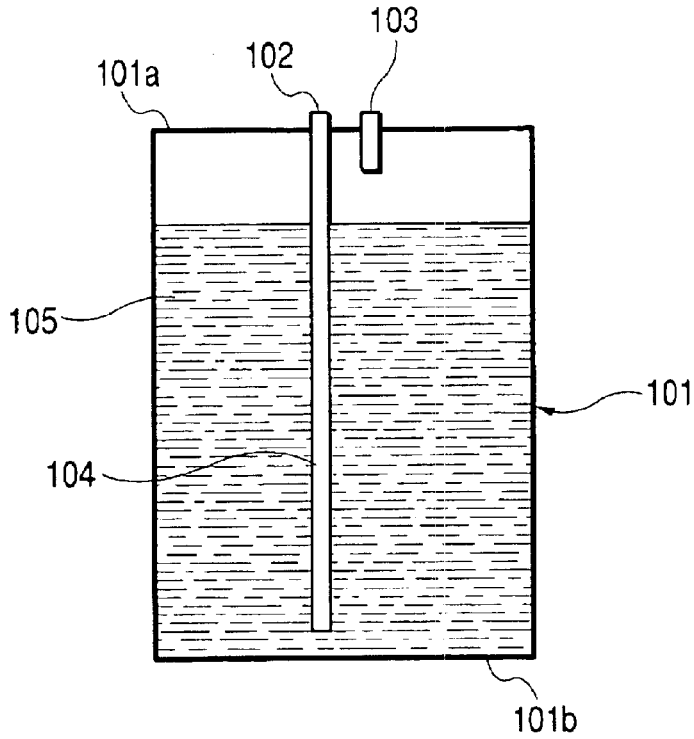
FIGS. 36 and 37 are views showing examples of the conventional liquid container.
Figure 37:
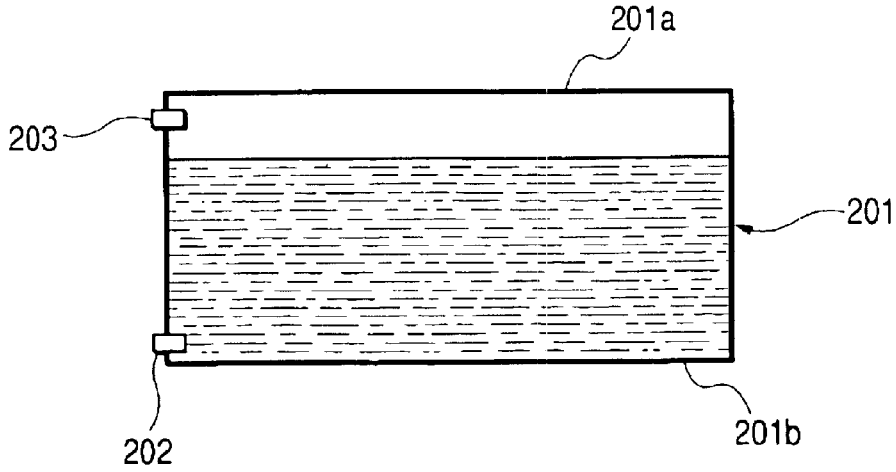

FIGS. 32A to 32D show cases where the two connection ports are positioned close to an end of the bottom of a flat container, but the recording apparatus with the liquid container 11 is somewhat inclined from the horizontal plane or a desired angle, or the ink tank is inclined with respect to the main body. In case the tubular portion 45 is provided at the end of the longitudinal cross section of the flat ink, the remaining ink amount becomes significantly different depending on the rotational position about the shorter side of the flat shape as shown in FIGS. 35A and 35B, but such difference can be made smaller by positioning the air introducing connection port, among the two connection ports at the end, closer to the center as shown in FIGS. 35C and 35D.

It is thus rendered possible to avoid a situation where the ink remains in the ink tank in an unexpectedly large amount or the ink in the supply path from the ink tank to the recording head is unexpectedly consumed (resulting in air introduction toward the recording head), in the course of continued in consumption from an ink low point (when the liquid level in the ink tank passes the upper end position of the tubular portion 45) to an ink end point (ink tank being empty), by a process of judging the ink end point by electrically counting the ink amount required in the printing or in resolving the clogging of the recording head.

Such effect can also be obtained in case the station base SB is slightly inclined from the vertical position in the recording apparatus.

It is also possible to form a tubular portion and a filter around the aperture of the first connection port 27 on the bottom of the liquid chamber 13 so as to cover the liquid deriving connection needle 38, whereby the ink guided from the ink chamber 13 passes through such filter. Such filter can be composed of a fibrous member, a fibrous sheet, a foamed member, a member formed from beads or a foamed member formed by dissolution, of a material same as that constituting the tank.

In the following there will be explained a recording apparatus provided with a liquid supply system suitable for the liquid container of the aforementioned configuration with reference to FIG. 33, which shows an ink jet recording apparatus as an example of the apparatus in which the liquid container of the present invention is applicable.

Figure 33:
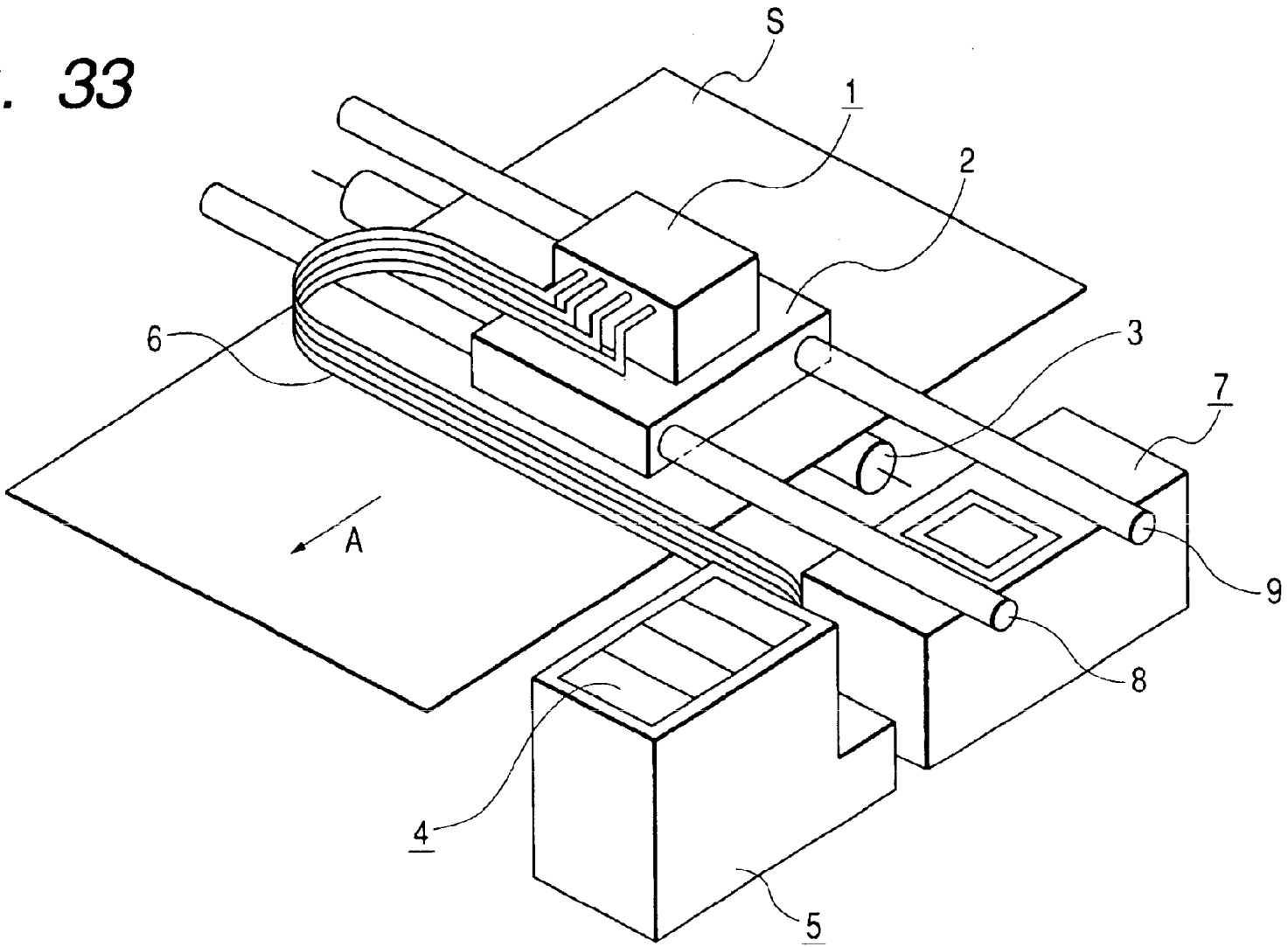
FIG. 33 is a view showing an ink jet recording apparatus advantageously employing the liquid supply system embodying the present invention.
Figure 34:
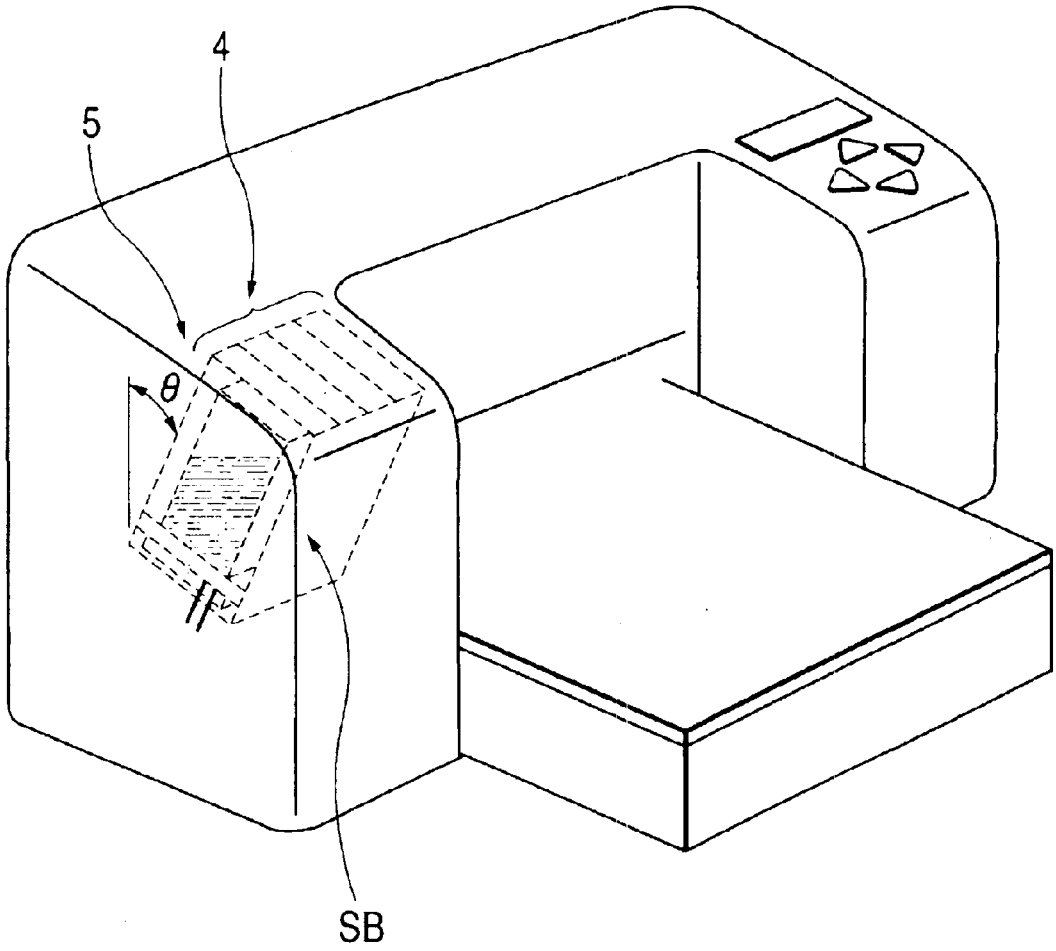
FIG. 34 is a view showing the relationship between another ink jet recording apparatus and a station base.

The ink jet recording apparatus shown in FIG. 33 is a recording apparatus of serial type, capable of repeating the reciprocating motion (main scanning) of an ink jet head (corresponding to the ink jet head 42 as shown in FIG. 17 etc.) 1 and the conveying (sub scanning) of a recording sheet (recording medium) S such as an ordinary recording paper, a special paper, an OHP film sheet etc. by a predetermined pitch and causing the ink jet head 1 to selectively discharge ink in synchronization with these motions for deposition onto the recording sheet S, thereby forming a character, a symbol or an image.

Referring to FIG. 33, the ink jet head 1 is detachably mounted on a carriage 2 which is slidably supported by two guide rails 8, 9 and is reciprocated along the guide rails 8, 9 by drive means such as an unrepresented motor. The recording sheet S is conveyed by a conveying roller 3 in a direction crossing the moving direction of the carriage 2 (for example a perpendicular direction A), so as to be opposed to an ink discharge face of the ink jet head 1 and to maintain a constant distance thereto.

The ink jet head 1 is provided with plural nozzle arrays for discharging inks of respectively different colors. Corresponding to the colors of the inks discharged from the ink jet head 1, plural independent ink tanks 4 (corresponding to the liquid containers 11 of the present invention) are detachably mounted on an ink supply unit 5 (corresponding to the station base 31 in FIG. 9). The ink supply unit 5 and the ink jet head 1 are connected by plural ink supply tubes 6 respectively corresponding to the ink colors, and, by mounting the ink tanks 4 on the ink supply unit 5, the inks of respective colors contained in the ink tanks 4 can be independently supplied to the nozzle arrays in the ink jet head 1.

In a non-recording area which is within the reciprocating range of the ink jet head 1 but outside the passing range of the recording sheet S, there is provided a recovery unit 7 so as to be opposed to the ink discharge face of the ink jet head 1. The recovery unit 7 is provided with a cap portion for capping the ink discharge face of the ink jet head 1, a suction mechanism for forced ink suction from the ink jet head 1 in the capped state of the ink discharge face, a cleaning blade for wiping off the smear on the ink discharge face etc. The aforementioned suction operation is executed by the recovery unit 7 prior to the recording operation of the ink jet recording apparatus.

When the ink jet recording apparatus is operated after a long pause, the recovery unit 7 sucks ink of higher concentration present in the ink supply tube 6, and the ink of which concentration is stabilized by agitation is used for actual recording.

Also in case the ink jet recording apparatus has not been used for a long period whereby the pigment component in the ink and the fine resinous particles for improving the fixation on the recording sheet S are precipitated in the bottom portion of the ink tank 4, the configuration of the present invention allows to resolve such precipitation or deviated distribution to obtain an image of high quality in which the concentration of such pigment component and fine resinous particles is thus stabilized, thus avoiding the conventional deterioration in the image quality or the trouble of causing the user to detach the ink tank 4 and to shake it for resolving the precipitation.

In the foregoing there has been explained an ink jet recording apparatus of serial type, but the present invention is likewise applicable to an ink jet recording apparatus employing a line-type ink jet head in which the nozzle arrays are formed over the entire width of the recording medium.

As explained in the foregoing, the present invention assumes a container configuration having two fluid connection ports on the container bottom, positioning both fluid connection ports close to the end of the container bottom and directly containing the liquid in the liquid chamber in the container, thereby providing a liquid container capable of stable liquid supply to the exterior until the contained liquid is almost depleted, easy replacement without drawbacks such as liquid leakage and simple detection of the remaining amount and also of deviated distribution of the liquid component by a simple structure. It is more effective to form the container in a pointing form toward the bottom and to position the fluid connection aperture communicating with the air closer to the center.

What is claimed is:

1. An ink container detachably mounted to an ink container mounting portion of an ink jet printer having an ink deriving tube for deriving ink from the ink container and an air introducing tube for introducing air into the ink container, the ink deriving tube and the air introducing tube being arranged upward in a vertical direction, said ink container comprising:

a container main body for containing ink; and a connecting portion to which the ink deriving tube and the air introducing tube are connected, said connecting portion being provided at a bottom surface of said container main body in a mounted state thereof on the mounting portion;

wherein both of the ink deriving tube and the air introducing tube are arranged in the mounting portion so that both of the ink deriving tube and the air introducing tube can be connected to said ink container at a portion deviated to either one of side walls with respect to a center portion of said bottom surface of said container main body, wherein said connecting portion of said ink container is arranged at a position where the ink deriving tube and the air introducing tube can be connected thereto.

2. An ink container according to claim 1, wherein at least an inner space of said ink container is pointed toward said bottom surface.

3. An ink container according to claim 1, further comprising an identification information structure for mechanically holding identification information of said ink container at a part of a shorter one of said side walls.

4. An ink container according to claim 1, further comprising an information memory element capable of holding identification information of said ink container at a position of said bottom surface different from a position to which the ink deriving tube and the air introducing tube are connected, and composed of an electric, magnetic, optical or a combined system.

5. An ink container according to claim 4, wherein said information memory element is an element capable of alteration, deletion or additional writing of the memorized information in addition to readout of the memorized information from the exterior of said ink liquid container.

6. An ink container according to claim 1, wherein said ink container contains ink, and said ink container is mounted to the mounting portion and recording is executed so that the ink contained in said ink container is derived from the ink driving tube and air is introduced into inside of said ink container from the air introducing tube.

7. An ink container according to claim 6, wherein said ink is a pigment ink.

8. An ink container according to claim 1, wherein said ink container has an external shape of a flat thin type of rectangular solid, wherein said connecting portion comprises multiple connection elements including an ink deriving connection element to which the ink deriving tube is connected and an air introducing connection element to which the air introducing tube is connected, wherein each connection element is independently provided at a portion deviated from a center portion of said bottom surface to a shorter one of the side surfaces, and wherein said ink deriving connection element is placed at a position closer to a side surface of the shorter side and said air introducing connection element is placed at a position closer to a center than said ink deriving connection element.

9. An ink container according to claim 8, wherein said ink deriving connection element and said air introducing connection element are positioned on a line substantially passing through a center in a direction of the shorter side of said ink container.

10. An ink container according to claim 8, wherein said air introducing connection element is provided with a tubular member near the bottom surface, the tubular member being oriented inward of said container main body and projecting slightly.

11. An ink container according to claim 8, wherein a filter is disposed at said ink deriving connection element.

12. An ink container according to claim 8, wherein an elastic member is disposed at said ink deriving connection element and said air introducing connection element.

13. An ink container according to claim 8, wherein a bottom surface of said ink deriving connection element is disposed at a position lower than said bottom surface.

14. An ink container detachably mounted to an ink container mounting portion of an ink jet printer having an ink deriving tube for deriving ink from said ink container and an air introducing tube for introducing air into said ink container, the ink deriving tube and the air introducing tube being arranged upward in a vertical direction, said ink container comprising:

a container main body for containing ink, said container main body having an external shape of a flat thin type of rectangular solid; and a connecting portion to which said ink deriving tube and said air introducing tube are connected, said connecting portion being provided at a bottom surface of said container main body in a mounted state thereof on the mounting portion, wherein both of the ink deriving tube and the air introducing tube are arranged in the mounting portion so that both of the ink deriving tube and the air introducing tube are connected to said ink container at a portion deviated to either one of side walls of a shorter side with respect to a center portion of the bottom surface of said container main body, wherein said connecting portion comprises multiple connection elements including an ink deriving connection element to which the ink deriving tube is connected and an air introducing connection element to which the air introducing tube is connected, wherein each connection element is independently provided at a portion deviated from a center portion of said container main body bottom surface to either one of the side surfaces of the shorter side, and wherein said ink deriving connection element is placed at a position closer to a side surface of the short side and said air introducing connection element is placed at a position closer to a center than said ink deriving connection element, and wherein said ink container contains ink, and said ink container is mounted to the mounting portion and recording is executed so that the ink contained in said ink container is derived from said ink deriving connection element and air is introduced into the inside of said ink container from said air introducing connection element.

15. An ink container according to claim 14, wherein said ink is a pigment ink.

16. An ink container according to claim 14, wherein said air introducing connection element is provided with a tubular member, the tubular member being oriented inward of said container main body and projecting slightly.

17. An ink container according to claim 14, wherein a bottom surface of said ink deriving connection element is disposed at a position lower than said bottom surface.

* * * * *